US008454135B2

(12) United States Patent
Umeda et al.

(10) Patent No.: US 8,454,135 B2
(45) **Date of Patent: *Jun. 4, 2013**

(54) AIR BUBBLE REMOVAL IN AN INK JET PRINTER

(75) Inventors: Takaichiro Umeda, Nagoya (JP); Hikaru Kaga, Aisai (JP); Tsuyoshi Suzuki, Owariasahi (JP); Seiji Shimizu, Ogaki (JP); Takamasa Usui, Nagoya (JP); Yoichiro Shimizu, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 1410 days.

This patent is subject to a terminal disclaimer.

(21) Appl. No.: 12/071,787

(22) Filed: Feb. 26, 2008

(65) Prior Publication Data

US 2008/0174645 A1 Jul. 24, 2008

Related U.S. Application Data

(63) Continuation-in-part of application No. 11/073,874, filed on Mar. 8, 2005, now Pat. No. 7,364,279, and a continuation-in-part of application No. 11/193,359, filed on Aug. 1, 2005, which is a continuation-in-part of application No. PCT/JP2004/001084, filed on Feb. 3, 2004.

(30) Foreign Application Priority Data

| | | |
|---|---|---|
| Feb. 4, 2003 | (JP) | 2003-027649 |
| Sep. 1, 2003 | (JP) | 2003-308308 |
| Sep. 1, 2003 | (JP) | 2003-308475 |
| Nov. 14, 2003 | (JP) | 2003-385796 |
| Mar. 26, 2004 | (JP) | 2004-092314 |
| Mar. 26, 2004 | (JP) | 2004-092315 |
| Mar. 26, 2004 | (JP) | 2004-092316 |

(51) Int. Cl.
*B41J 2/17* (2006.01)
*B41J 2/19* (2006.01)

(52) U.S. Cl.
USPC ..... 347/84; 347/92

(58) Field of Classification Search
USPC ..... 347/84, 85, 92; 137/1, 614.04
See application file for complete search history.

(56) References Cited

U.S. PATENT DOCUMENTS 3,777,771 A * 12/1973 De Visscher ..... 137/1
4,419,678 A 12/1983 Kasugayama et al.

(Continued)

FOREIGN PATENT DOCUMENTS

EP 0 770 490 A2 5/1997
JP A-61-35254 2/1986

(Continued)

*Primary Examiner* — Stephen Meier
*Assistant Examiner* — Carlos A Martinez
(74) *Attorney, Agent, or Firm* — Oliff & Berridge, PLC

(57) ABSTRACT

An ink jet printer including a carriage which is movable relative to a sheet of paper, a recording head which is mounted on the carriage and records an image on the sheet by ejecting a droplet of ink toward the sheet, one or more ink tanks which store the ink or inks to be supplied to the recording head, a buffer tank which is mounted on the carriage, and one or more ink flow passages in which the inks are supplied from the ink tanks to the recording head via the buffer tank. The buffer tank has, at a height position higher than a height position where the recording head is provided, one or more air buffer chambers which accommodate respective amounts of the inks, and collect air bubbles produced in the ink flow passages.

5 Claims, 48 Drawing Sheets

U.S. PATENT DOCUMENTS

| | | | | |
|---|---|---|---|---|
| 4,536,777 | A | 8/1985 | Matsumoto | |
| 4,586,058 | A | 4/1986 | Yamazaki et al. | |
| 4,628,333 | A | 12/1986 | Terasawa | |
| 5,221,936 | A | 6/1993 | Saito et al. | |
| 5,280,300 | A | 1/1994 | Fong et al. | |
| 6,447,084 | B1 | 9/2002 | Uetsuki et al. | |
| 6,478,415 | B2 | 11/2002 | Barinaga et al. | |
| 6,550,901 | B2 | 4/2003 | Iida | |
| 7,364,279 | B2 * | 4/2008 | Usui et al. | 347/84 |
| 7,410,248 | B2 * | 8/2008 | Umeda et al. | 347/85 |
| 7,661,805 | B2 * | 2/2010 | Usui | 347/92 |
| 7,762,278 | B2 * | 7/2010 | Adams et al. | 137/614.04 |
| 2001/0052370 | A1 | 12/2001 | Shinada et al. | |
| 2004/0183873 | A1 | 9/2004 | Steinmetz et al. | |
| 2004/0183876 | A1 * | 9/2004 | Mizuno et al. | 347/92 |
| 2005/0253909 | A1 | 11/2005 | Usui | |
| 2007/0188565 | A1 | 8/2007 | Shimizu et al. | |

FOREIGN PATENT DOCUMENTS

| | | | |
|---|---|---|---|
| JP | A-05-318755 | | 12/1993 |
| JP | A-11-348315 | | 12/1999 |
| JP | A-2000-103074 | | 4/2000 |
| JP | A-2000-103084 | | 4/2000 |
| JP | A-2002-240310 | | 8/2002 |
| JP | 2004255861 | * | 9/2004 |
| WO | WO 2004/069545 A1 | | 8/2004 |
| WO | WO2004069545 | * | 8/2004 |

* cited by examiner

FIG.33A
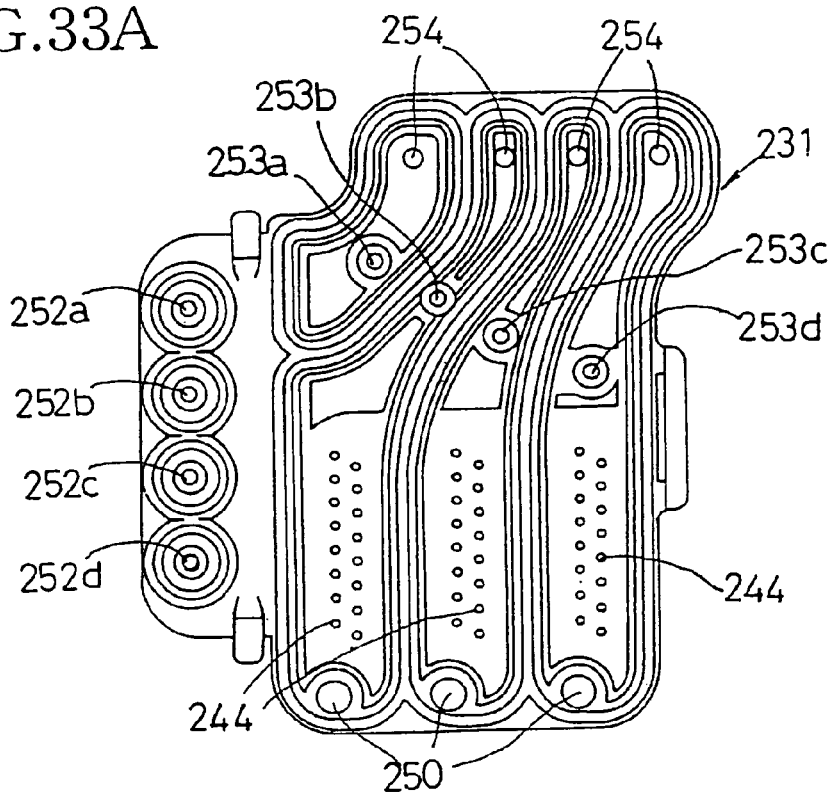
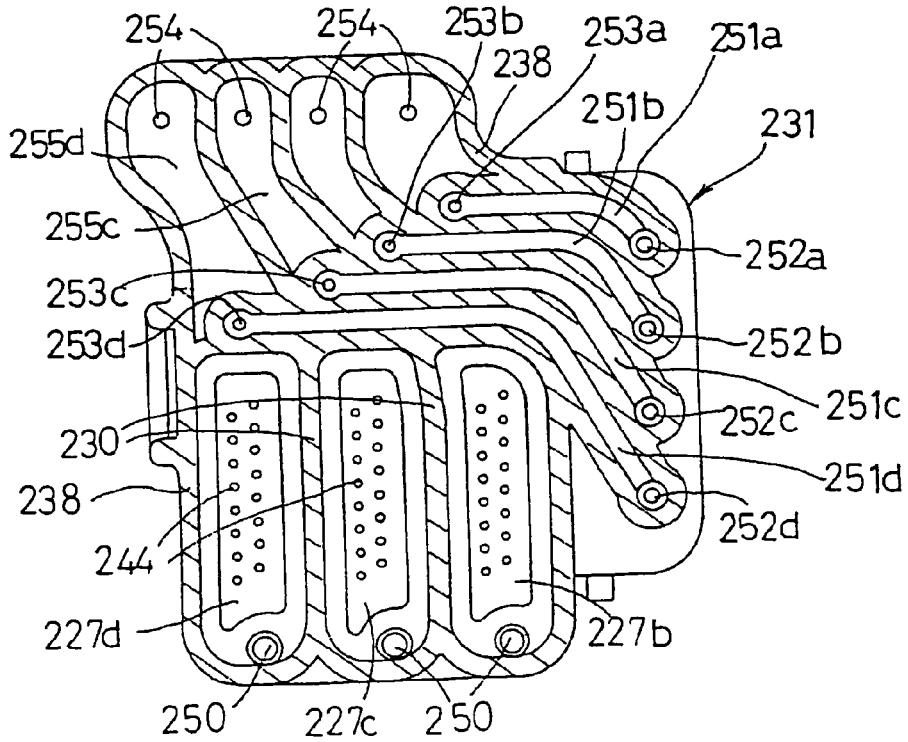
FIG.33B

FIG.34A
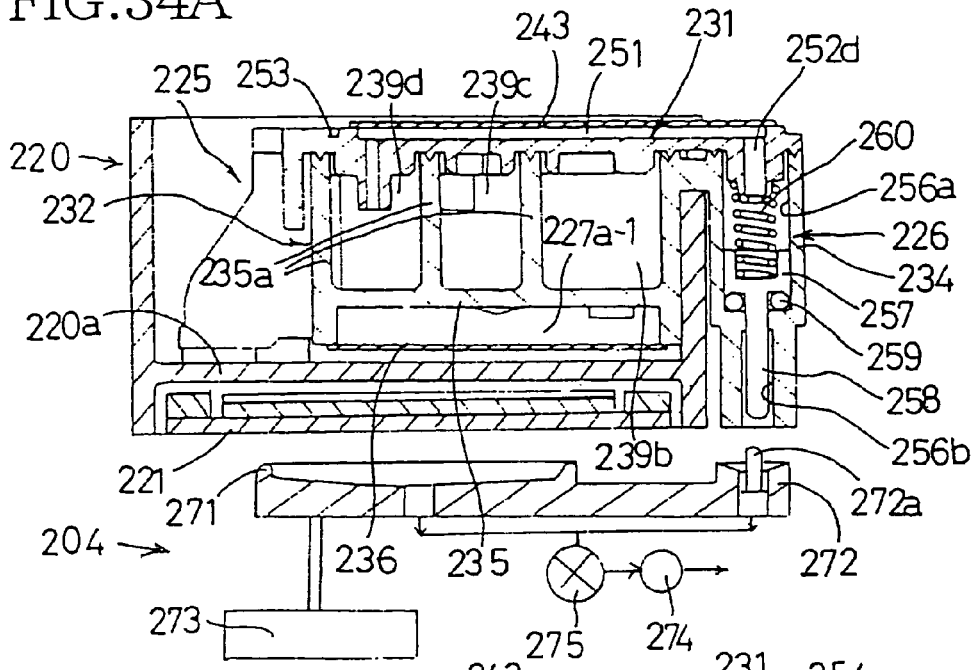
FIG.34B
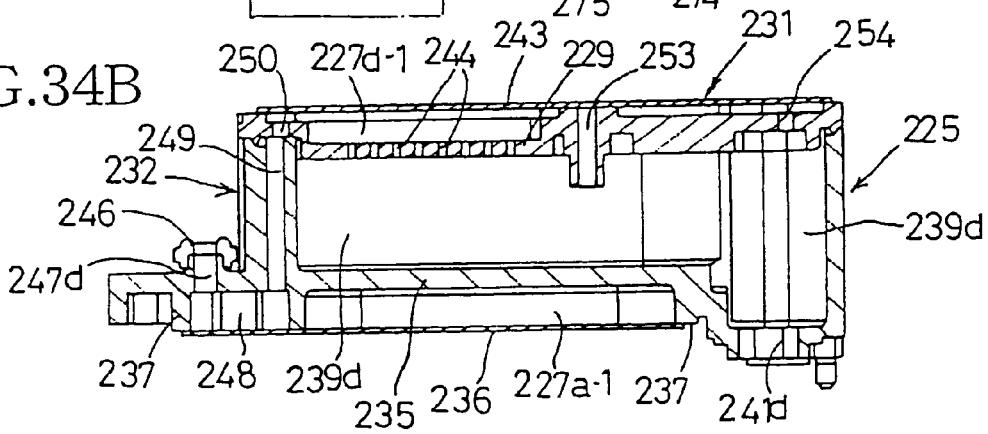
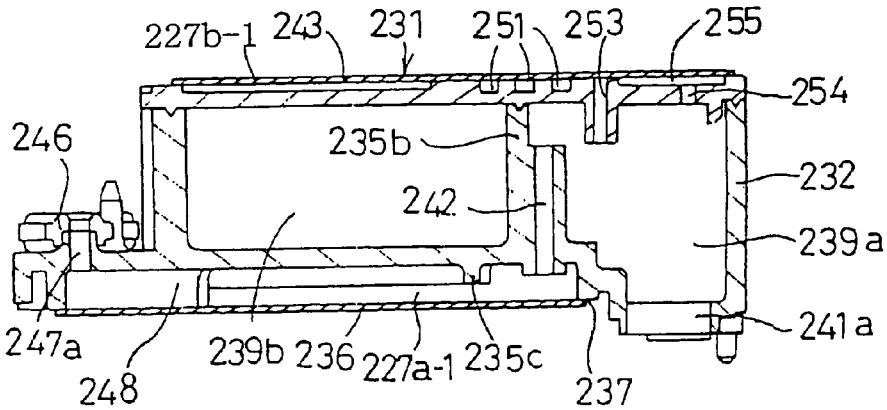
FIG.34C

FIG.40A
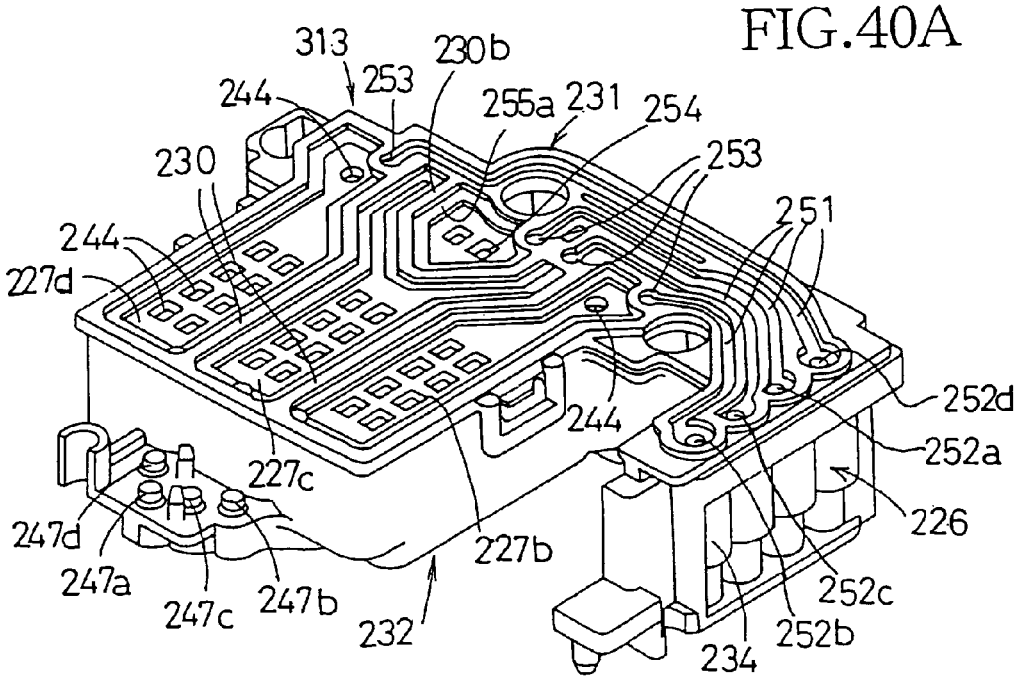
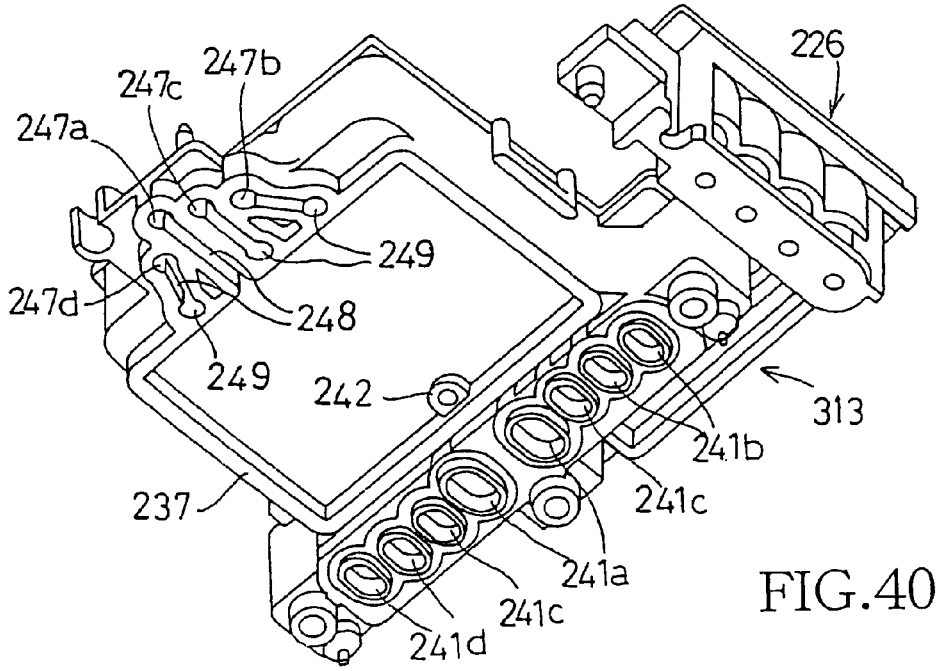
FIG.40B

FIG.41A
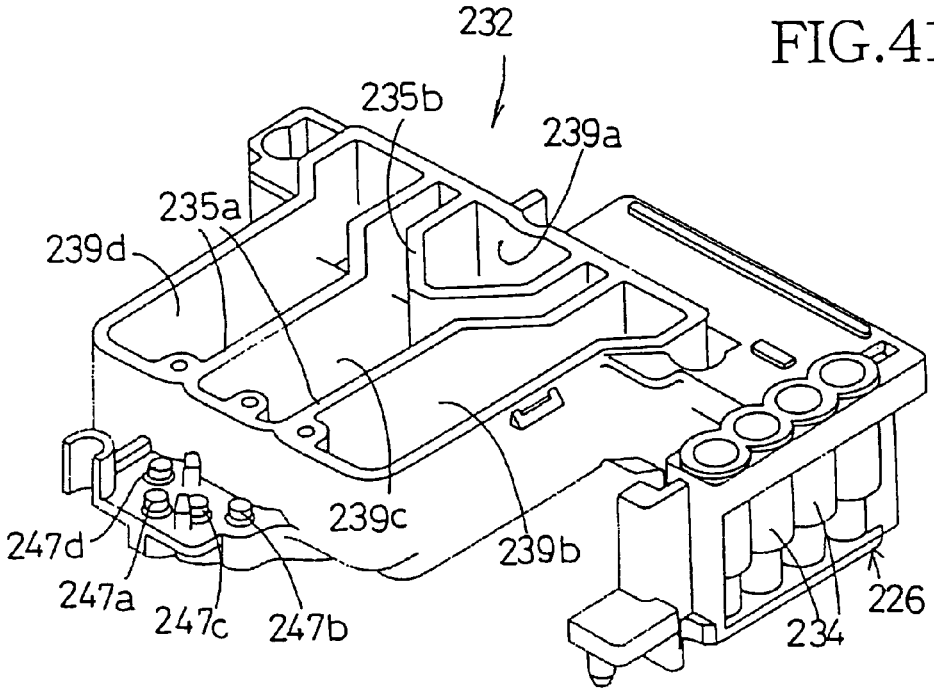
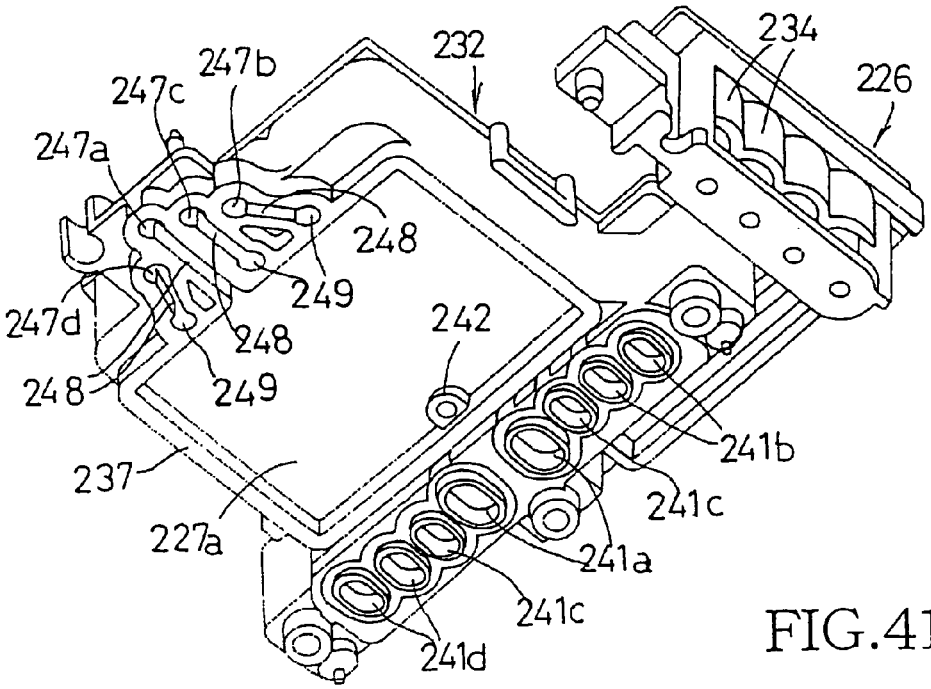
FIG.41B

AIR BUBBLE REMOVAL IN AN INK JET PRINTER

This is a Continuation-in-Part of application Ser. No. 11/073,874 filed Mar. 8, 2005 which is based on Japanese Patent Application Nos. 2004-092314, 2004-092315, and 2004-092316, filed on Mar. 26, 2004, and is a Continuation-in-Part of application Ser. No. 11/193,359 which is a Continuation-in-Part of International Application No. PCT/JP2004/001084 filed Feb. 3, 2004, which claims the benefits of Japanese Patent Application No. 2003-027649 filed Feb. 4, 2003, Japanese Patent Application No. 2003-308308 filed Sep. 1, 2003, Japanese Patent Application No. 2003-308475 filed Sep. 1, 2003, and Japanese Patent Application No. 2003-385796 filed Nov. 14, 2003, the contents of all prior applications are incorporated herein by reference in their entireties.

BACKGROUND OF THE INVENTION

1. Field of the Invention

The present invention relates to an ink jet printer and particularly to such an ink jet printer which can not only collect air bubbles generated in one or more ink flow passages, so as to maintain its high recording quality, and but also efficiently remove the collected air bubbles.

2. Discussion of Related Art

There has conventionally been known a tube-supply-type ink jet printer which supplies ink to a printing head mounted on a movable carriage, via a flexible tube, from an ink tank fixed in a housing. An example of this ink jet printer is disclosed by Japanese Patent Publication P2000-103084A. However, in the ink jet printer, if air bubbles (or air) are contained in the ink present in the recording head, the printing head may fail to eject the ink, or the recording quality of the head may lower.

In the tube-supply-type ink jet printer, air cannot be prevented from permeating the tube and dissolving in the ink, because of the natural property of the material used to form the tube. Thus, it has been needed to provide an air buffer chamber (or an air bubble collecting chamber) on an upstream side of the recording head, collect the air bubbles in the air buffer chamber, and remove the thus collected air bubbles.

In the ink jet printer disclosed by the above-indicated Patent Document, the printing head has, in an upper portion thereof, a manifold (i.e., an air buffer chamber or an air bubble collecting chamber), and the ink tank and a circulating pump are fixed in position in the housing. The circulating pump is driven or operated to circulate the ink from the ink tank to a first ink flow passage, then the manifold, a second ink flow passage, and again the ink tank, so that the air bubbles generated in the circulation channel are returned to the ink tank and are removed. Meanwhile, at a maintenance position in the housing, a sucking and purging device sucks ink from an ink ejecting nozzle of the recording head.

However, in the above-indicated ink jet printer, since the ink tank communicates with the atmosphere, air (or air bubbles) is likely to mix with the ink being circulated. In addition, it is needed to employ an ink returning tube for circulating the ink from the circulating pump back to the ink tank. Thus, the ink jet printer is complicated and is increased in size.

Furthermore, in the case where an ink jet printer employs a plurality of ink tanks corresponding to a plurality of color inks so as to record a full-color image, the printer needs to employ a plurality of air buffer chambers (i.e., a plurality of air bubble collecting chambers) corresponding to the ink tanks, respectively. Hence, when a maintenance operation is performed, it is needed to remove concurrently the air bubbles from all the air buffer chambers. Thus, it has been desired to finish substantially simultaneously the respective operations of removing the air bubbles from all the air buffer chambers, and thereby improve the efficiency of those operations.

SUMMARY OF THE INVENTION

It is therefore an object of the present invention to provide an ink jet printer which is free from at least one of the above-identified problems.

It is another object of the present invention to provide such an ink jet printer which can efficiently remove air bubbles collected in an air buffer chamber or an air-bubble collecting chamber which is provided, together with a printing head, on a carriage.

It is another object of the present invention to provide such an ink jet printer which can be produced in a small size.

According to a first aspect of the present invention, there is provided an ink jet printer, comprising: a printing head for performing printing on a print medium by ejecting ink from nozzles; an ink tank for storing the ink to be supplied to the printing head; an ink passage through which the ink is supplied from the ink tank to the printing head; a buffer tank which stores the ink supplied through the ink passage; and an air-discharging device which discharges an air accumulated in the buffer tank through an air-discharge passage and which includes a valve member operable to open and close a communication opening that is provided in the air-discharge passage a part of which functions as a valve chamber and having: a valve portion which opens and closes the communication opening and which includes a sealing member; and a rod portion connected to the valve portion, wherein the sealing member moves together with the rod portion in a direction to open and close the communication opening.

In the present ink jet printer constructed as described above, the air-discharging device, with high reliability, discharges the air flow from the buffer tank through the air-discharge passage. Therefore, the air accumulated in the buffer tank can be discharged, so that the ink-jet printer is capable of performing a reliable printing operation without adverse influence of air.

According to a second aspect of the present invention, there is provided an ink jet printer, comprising: a printing head for performing printing on a print medium by ejecting ink from nozzles; an ink tank for storing the ink to be supplied to the printing head; an ink passage through which the ink is supplied from the ink tank to the printing head; a buffer tank which stores the ink supplied through the ink passage; and an air-discharging device which discharges an air accumulated in the buffer tank through an air-discharge passage and which includes a valve member operable to open and close a communication opening that is provided in the air-discharge passage a part of which functions as a valve chamber and having: a valve portion which opens and closes the communication opening and which includes a sealing member; and a rod portion connected to the valve portion, wherein the air-discharging device further includes retaining means for retaining the sealing member on the rod portion such that the sealing member is movable together with the rod portion in a direction to open and close the communication opening.

According to the present inkjet printer, the discharging of accumulated air in the buffer tank is realized by a structure that the air-discharging device includes retaining means for retaining the sealing member on the rod portion such that the sealing member is movable together with the rod portion in a direction to open and close the communication opening.

According to present inkjet printer, the retaining means retains the sealing member on the rod portion, so that, when the valve member is operated to open the communication opening provided in the air-discharge passage, the sealing member is moved together with the rod portion as a unitary component in a direction to open the communication opening. Accordingly, when the valve member is placed in its open state, the communication opening is prevented from being kept closed by the sealing member, in other words, the communication opening can be opened with high reliability, permitting the air to be discharged therethrough.

BRIEF DESCRIPTION OF THE DRAWINGS

FIG. 33A is a plan view of an upper case of the ink jet printer of FIG. 27.

FIG. 33B is a bottom view of the upper case of the ink jet printer of FIG. 27.

FIG. 34A is a cross-section view taken along arrows indicated at 34A, 34A in FIG. 30.

FIG. 34B is a cross-section view taken along arrows indicated at 34B, 34B in FIG. 30.

FIG. 34C is a cross-section view taken along arrows indicated at 34C, 34C in FIG. 31.

FIG. 40A is a perspective top view of a case member (i.e., upper and lower cases fixed to each other) of the ink jet printer of FIG. 37.

FIG. 40B is a perspective bottom view of the case member of FIG. 40A.

FIG. 41A is a perspective top view of the lower case of the ink jet printer of FIG. 37.

FIG. 41B is a perspective bottom view of the lower case of FIG. 41A.

DETAILED DESCRIPTION OF THE PREFERRED EMBODIMENTS

Figure 1:
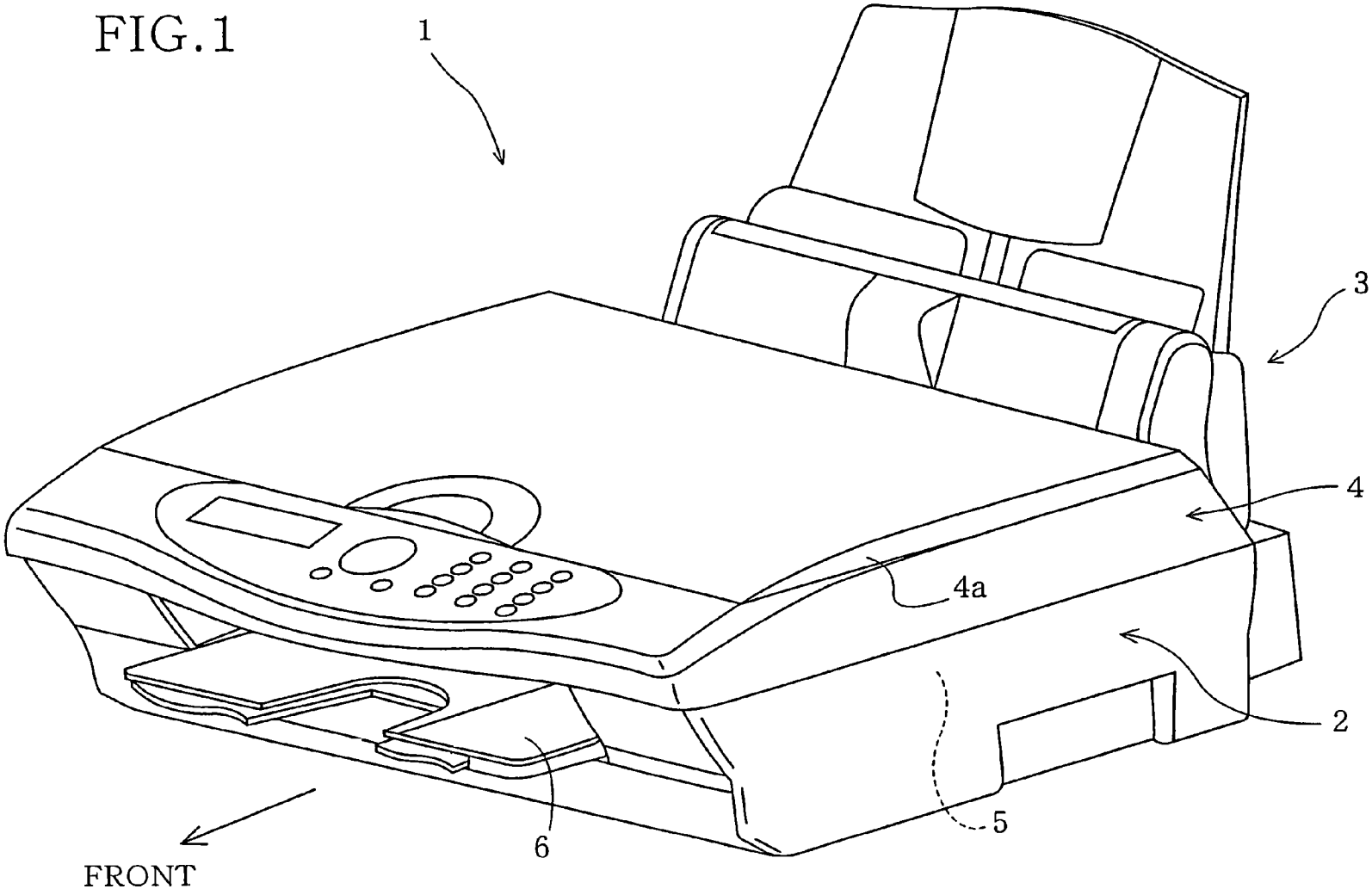
FIG. 1 is a perspective view of a multi-function apparatus employing an ink jet printer as a first embodiment of the present invention.

Hereinafter, there will be described a preferred embodiment of the present invention by reference to the drawings. A first embodiment of the present invention relates to a multi-functional apparatus (MFC) 1 having a printer function, a copier function, a scanner function, and a facsimile function. As shown in FIG. 1, the MFC 1 includes a housing 2; a sheet supplying device 3 provided in a rear end portion of the housing 2; and an original reading device 4, for the copier and facsimile functions, that is provided in an upper portion of the housing 2, and in front of the sheet supplying device 3. An ink jet printer 5 (described later) for the printer function entirely occupies a lower portion of the housing 2, below the original reading device 4; and a sheet collecting tray 6 is provided in front of the ink jet printer 5, so as to collect a recording medium, e.g., a sheet of paper, P, on which recording or printing has been performed by the printer 5.

The original reading device 4 is constructed such that the reading device 4 is pivotable upward and downward about a horizontal axis member, not shown, provided in a rear end portion thereof. When a user opens a cover member 4*a* upward, the user can see a support glass plate on which an original is to be placed and below which an image scanner for reading the original is provided.

Figure 2:
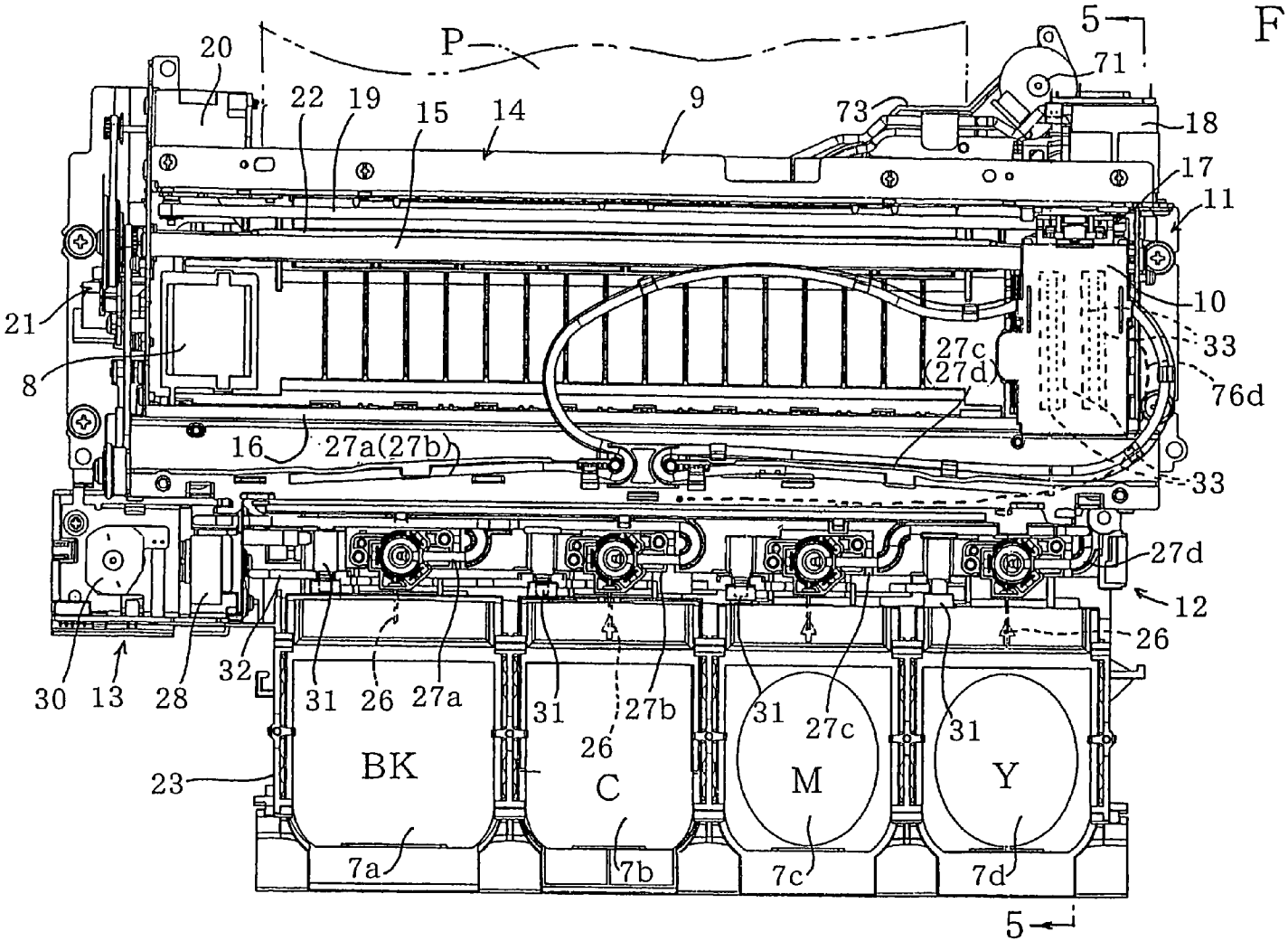
FIG. 2 is a plan view of a recording portion of the ink jet printer.

When the user pivots the entirety of the original reading device 4 upward, the user can see the full-color ink jet printer 5 including four ink tanks, i.e., four ink cartridges 7 including a black ink cartridge 7*a*, a cyan ink cartridge 7*b*, a magenta ink cartridge 7*c*, and a yellow ink cartridge 7*d* (also see FIG. 2). The user can replace each of the ink cartridges 7 with a new one.

Next, the construction of the ink jet printer 5 will be briefly described by reference to FIGS. 2 through 5. The ink jet printer 5 includes a recording portion, i.e., a printing portion 9; a maintenance unit 11; an ink supplying portion 12; and an air supplying portion 13. The printing portion 9 is incorporated in a frame member 14, and includes a printing head unit 10 that ejects ink toward the recording paper P to record an image (e.g., a character, a symbol, etc.) thereon. The maintenance unit 10 performs maintenance of the printing head unit 10 of the printing portion 9. The ink supplying portion 12 supplies the respective inks of the ink cartridges 7*a* to 7*d* to the printing head unit 10. The air supplying portion 13 supplies pressurized air (i.e., positive pressure air) to each of the ink cartridges 7*a* to 7*d*.

Figure 3:
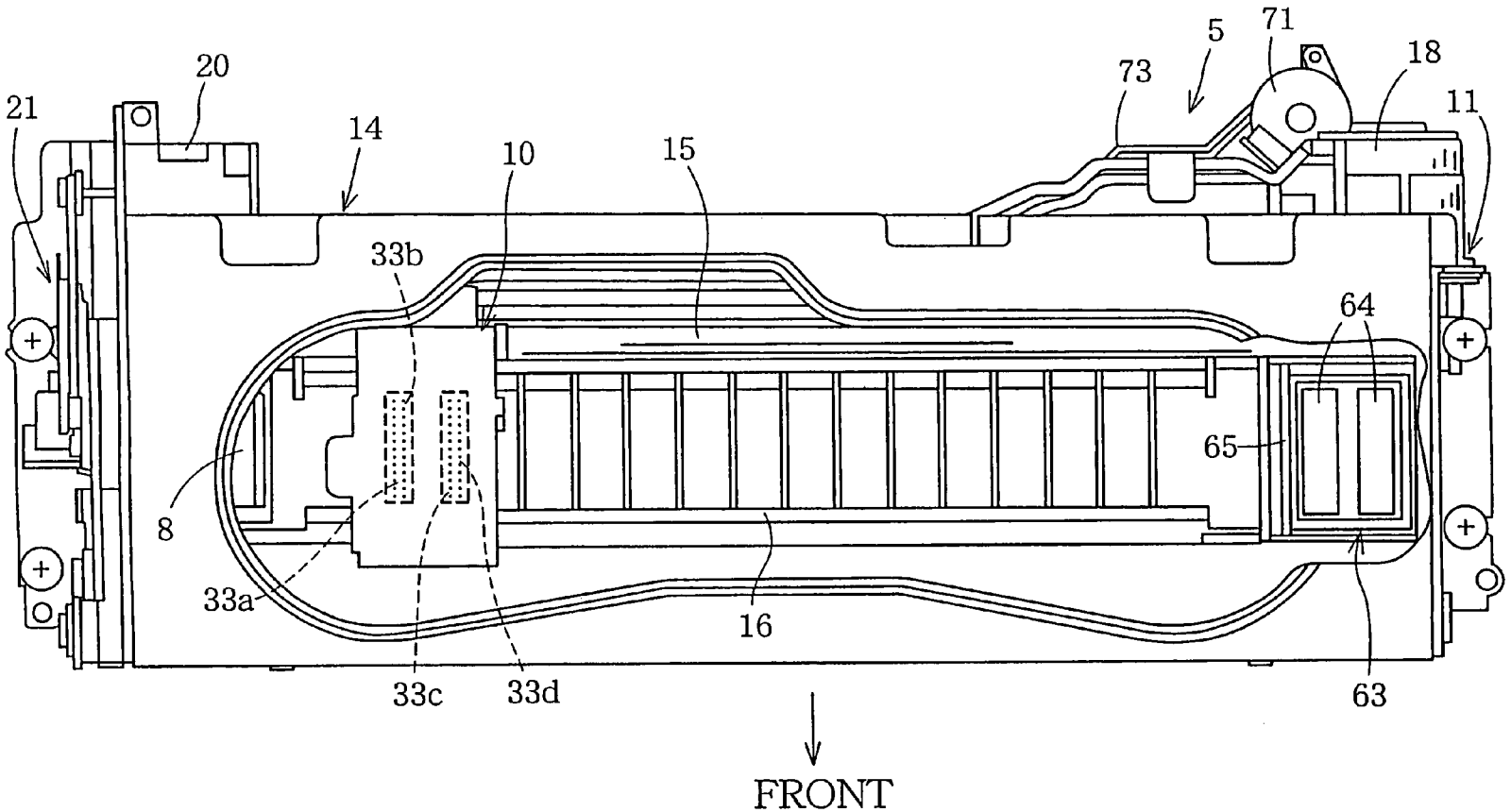
FIG. 3 is a plan view of a housing of the ink jet printer.
Figure 5:
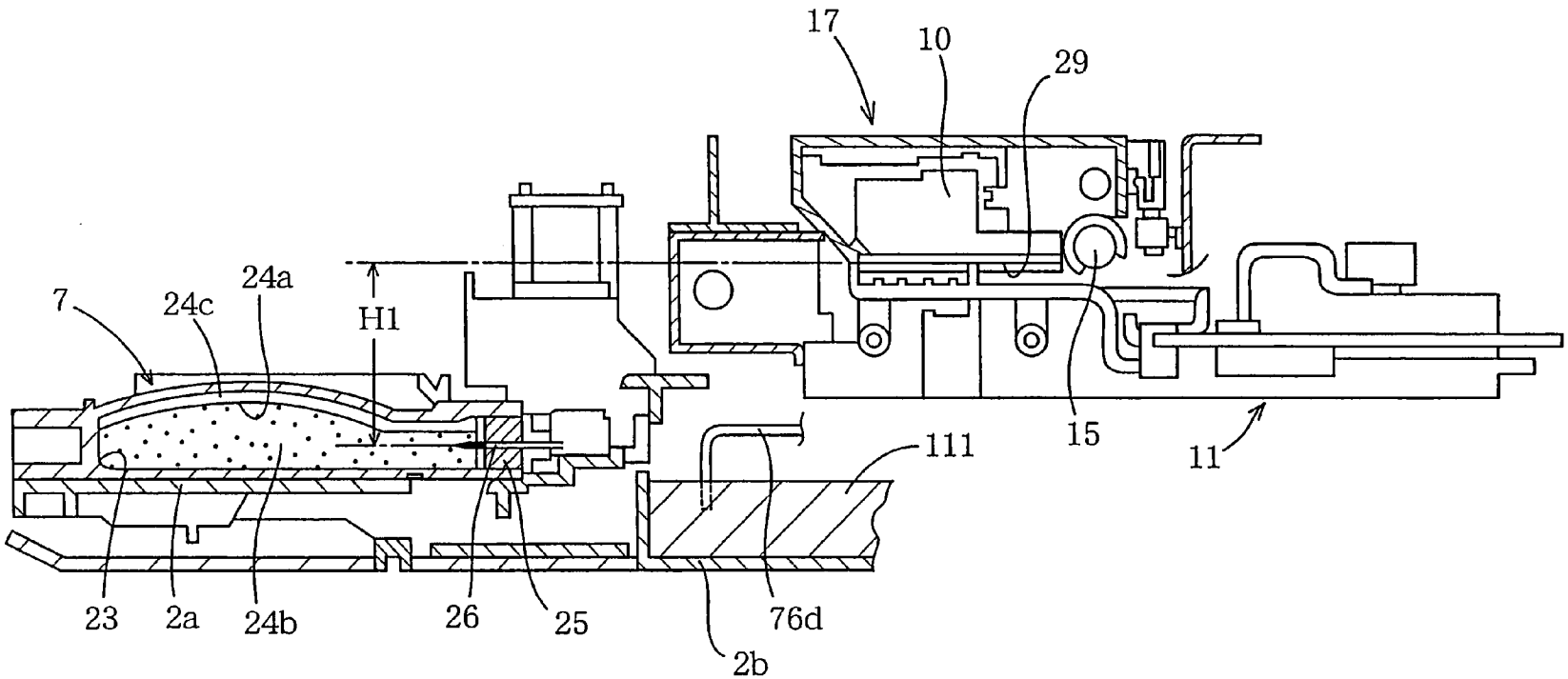
FIG. 5 is a cross-section view taken along arrows indicated at 5, 5 in FIG. 2.

As shown in FIGS. 2, 3, and 5, the printing portion 9 and the maintenance unit 11 are accommodated in the frame member 14 that has a box-like configuration and is open upward through a generally elliptic hole. A rear guide bar 15 and a front guide bar 16 that are parallel to each other and are each elongate in a lengthwise direction of the FMC 1, are provided in the frame member 14, and a carriage 17 is placed on the two guide bars 15, 16, such that the carriage 17 is freely movable relative the same 15, 16. The printing head unit 10 is integrally attached to the carriage 17, and is thus mounted on the same 17.

A carriage drive motor 18, provided in rear of the frame member 14, and an endless, timing belt 19 cooperate with each other to reciprocate the carriage 17 on the front and rear guide bars 16, 15, in the widthwise direction of the FMC 1 (FIG. 2). A sheet supplying motor 20, also provided in rear of the frame member 14, cooperates with a transmission device 21 that includes a belt, a gear, etc. and is provided on a side surface of the frame member 14, to drive or rotate a main feed roller 22, located below the rear guide roller 15, that cooperates with another feed roller (not shown), located below the front guide roller 16, to feed the recording paper P such that the paper P passes in a horizontal posture under a lower surface of the printing head unit 10, and the paper P on which recording has been finished is fed toward, and discharged into, the sheet collecting tray 6.

At an ink flushing position in one of opposite side areas outside the width of the recording paper P being fed (i.e., the left-hand side area in FIGS. 2 and 3), an ink collecting portion 8 is provided; and, at a head waiting position in the other side area, the maintenance unit 11 is provided. Thus, during a recording operation of the FMC 1, the printing head unit 10 is periodically moved to the ink flushing position where the head unit 10 ejects ink to prevent clogging of nozzles and the ink collecting portion 8 collects the thus ejected ink. At the head waiting position, the maintenance unit 11 performs a cleaning operation to clean a nozzle supporting surface 29 of the head unit 10. In addition, the maintenance unit 11 performs a recovering operation to suck selectively each of the different color inks, and a removing operation to remove air bubbles, or air, from a buffer tank 36, described later.

Figure 4:
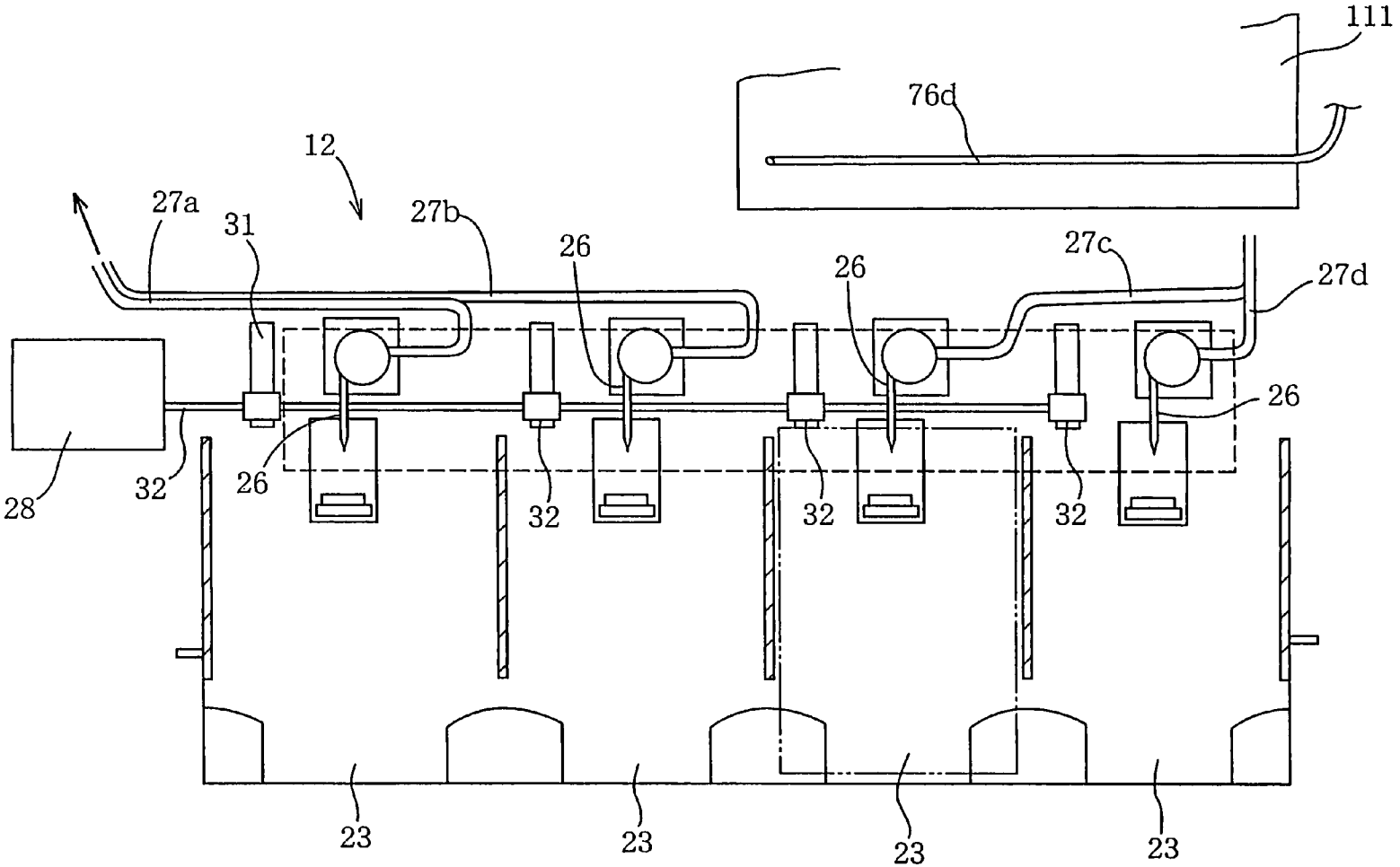
FIG. 4 is a schematic plan view of four ink tank accommodating portions and an ink supply portion of the ink jet printer.

Next, the construction of the ink supplying portion 12 is described. As shown in FIGS. 2, 4, and 5, four cartridge accommodating portions 23 are provided below a sheet feed path through which the recording paper P is fed, and above a front portion of a lower partition plate 2*a* of the housing 2, such that the cartridge accommodating portions 23 are located at a height position lower than the nozzle supporting surface 29 as the lower surface of the printing head unit 10. Each of the four ink cartridges 7*a* to 7*d* can be inserted, in a direction from the front side to the rear side, in a corresponding one of the cartridge accommodating portions 23. Thus, as shown in FIG. 2, the black (BK) ink cartridge 7*a*, the cyan (C) ink cartridge 7*b*, the magenta (M) ink cartridge 7*c*, and the yellow (Y) ink cartridge 7*d* are parallel to each other, are each in a horizontal posture, and are arranged in an array in the order of description in a direction from the left side, to the right side, of the MFC 1.

In each of the four ink cartridges 7 (7*a* to 7*d*), a flexible membrane member 24*a* is adhered to an inner wall surface thereof so as to separate an inner space thereof into a lower, ink chamber 24*b* and an upper, air chamber 24*c*. The membrane member 24*a* provides a flexible partition wall of the each ink cartridge 7.

Each of the four ink cartridges 7 has an air hole, not shown, that is formed through a thickness of a rear wall thereof and provides air communication between the air chamber 24*c* and the atmosphere, and additionally has a seal member 25 that is formed of, e.g., silicone and seals the rear wall of the ink chamber 24*b* from outside.

The four cartridge accommodating portions 23 have respective hollow ink needles 26 that project horizontally from respective rear walls thereof, in a frontward direction opposite to the direction in which the four ink cartridges 7*a* to 7*d* are inserted. Respective base end portions of the four ink needles 26 are connected via respective flexible ink passages 27*a*, 27*b*, 27*c*, 27*d* to the printing head unit 10. Respective intermediate portions of the black (BK) ink passage 27*a* and the cyan (C) ink passage 27*b* are superposed on each other and are bound together; and respective intermediate portions of the magenta (M) ink passage 27*c* and the yellow (Y) ink passage 27*d* are superposed on each other and are bound together.

The air supplying portion 13 includes an air pump 28, such as a diaphragm type air pump; a drive motor 30 that drives or operates the air pump 28; four compression pads 31 projecting frontward parallel to the corresponding ink needles 26; and an air tube 32 connecting the air pump 28 to each of the four compression pads 31. In the state in which the four ink cartridges 7 are inserted and fixed in the cartridge accommodating portion 23, the four compression pads 31 are held in compressed contact with the respective air holes of respective rear walls of the corresponding ink cartridges 7, owing to respective biasing forces of corresponding biasing springs, not shown. In this state, when the air pump 28 is driven by the drive motor 30, the pressurized or positive pressure air is supplied to the respective air chambers 24*c* of the four ink cartridges 7*a* to 7*d*, so that the positive pressure can be applied to the respective inks present in the respective ink chambers 24*b*.

As shown in FIG. 5, the nozzle supporting surface 29 of the printing head unit 10, where nozzles 33 open, is located at a height position higher by a water head, H, than the four ink needles 26. Therefore, during the recording operation, a negative pressure (i.e., a back pressure) corresponding to the water head H is naturally exerted to the nozzles 33 of the head unit 10. When the color inks are initially introduced into a printing head 34 of the printing head unit 10, first, suction cap members 64, described later, are held in close contact with the nozzles 33, and then a suction pump 68 is driven to apply suction to the nozzles 33, as known in the art, so that the inks are fed from the ink cartridges 7*a* to 7*d* to the printing head 34. To this end, the air pump 28 may be operated to apply the positive pressure to each of the respective inks present in the ink cartridges 7*a* to 7*d*.

Next, the respective constructions of the printing head unit 10 and an air discharging valve device, i.e., an air-discharging device 41, both mounted on the carriage 17, will be described by reference to FIGS. 3, 6A, 6B, 7, 8, 9, 10, 11A, and 11B. In the present embodiment, the full-color printing head unit 10 includes, as shown in FIGS. 6B and 10, the printing head 34 having four arrays of nozzles 33 (33*a*, 33*b*, 33*c*, 33*d*, FIG. 3) corresponding to the four color inks; an actuator 35, such as a flat piezoelectric element, that is bonded to an upper surface of the printing head 34; the buffer tank 36 having four air buffer chambers, i.e., four air bubble collecting chambers 40 (40*a*, 40*b*, 40*c*, 40*d*); and a case 37 that is adjacent a side wall of the buffer tank 36 and incorporates the air-discharging device 41.

As shown in FIG. 3, the lower surface of the printing head 34 supports the four arrays of nozzles 33*a*, 33*b*, 33*c*, 33*d* corresponding to the black (BK) ink, the cyan (C) ink, the magenta (M) ink, and the yellow (Y) ink, respectively, in the order of description, in the direction from the left side to the right side, such that each of the four arrays of nozzles 33*a* to 33*d* extends in a direction perpendicular to directions in which the carriage 17 is reciprocated. Each of the nozzles 33 is exposed to face an upper surface of the recording paper P. The printing head 34 has, like a known printing head, a plurality of pressure chambers, not shown, which communicate with the plurality of nozzles 33, respectively, and each of which accommodates a corresponding one of the four color inks supplied from the buffer tank 36, and the printing head 34 ejects a droplet of ink from an arbitrary one of the nozzles 33 when a corresponding one of the pressure chambers is actuated by a corresponding portion of the piezoelectric actuator 35.

Figure 10:
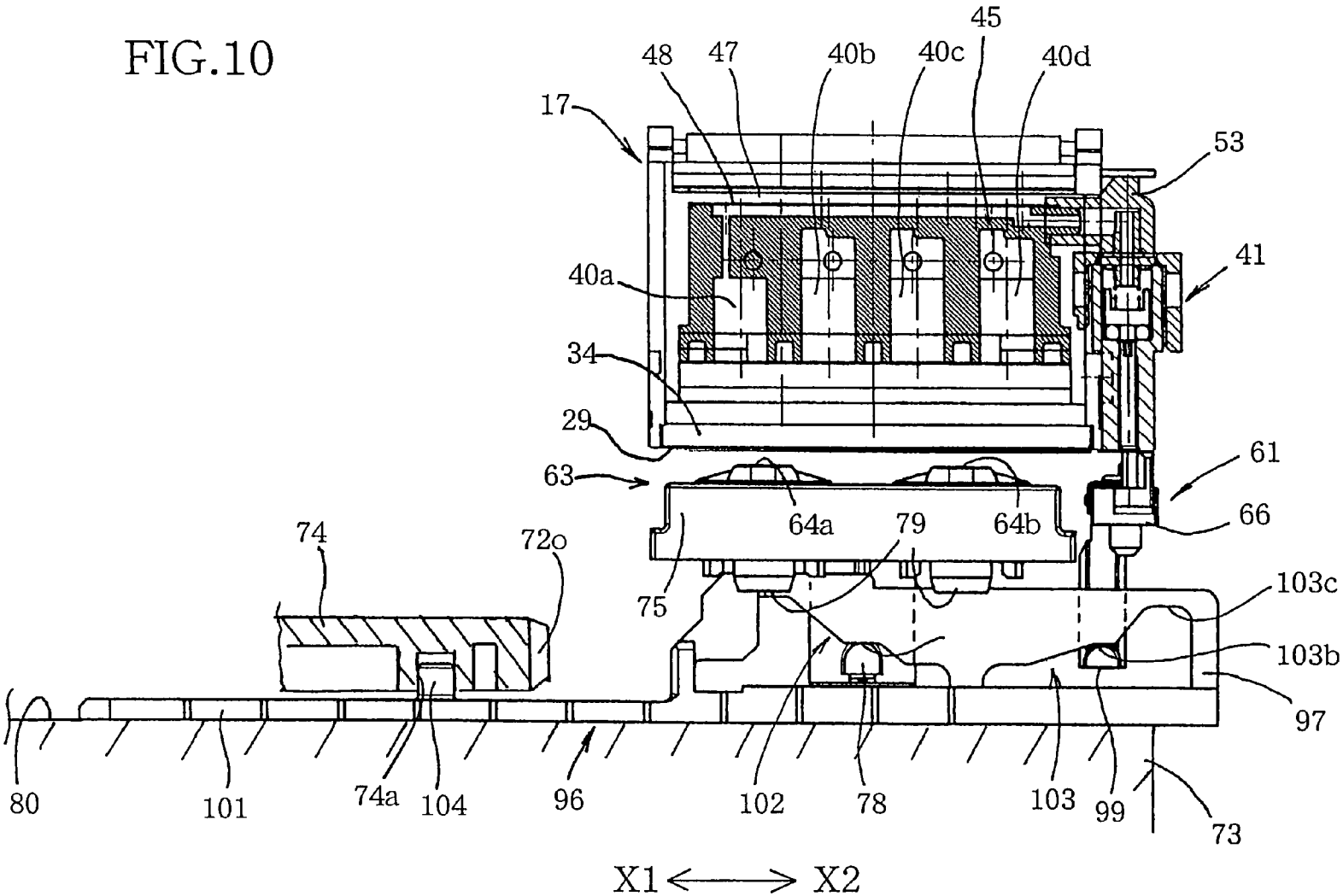
FIG. 10 is a side elevation view showing respective positions of the carriage, a translational cam, a recovering device, and the air-bubble removing device in a waiting state.

As shown in FIG. 10, the buffer tank 36 has the four bubble collecting chambers 40 (40*a*, 40*b*, 40*c*, 40*d*) that correspond to the four color inks, respectively, and are separated from each other by respective partition walls. The buffer tank 36 is formed of a synthetic resin, and has a generally rectangular shape in its plan view. The buffer tank 36 has, on one side surface thereof, four ink flow inlets 39 that project horizontally from the one side surface and are connected via respective tubes, not shown, to a joint member 38, not described in detail, to which respective ends of the four ink passages 27*a* to 27*d* are connected. Under a bottom wall of the buffer tank 36, there are provided four ink flow chambers 42 from which the four inks flow to the four arrays of nozzles 33 of the printing head 34 via respective outlets 43 that are oriented downward. Each of the four bubble collecting chambers 40 and a corresponding one of the four ink flow chambers 42, located under the each bubble collecting chamber 40, are substantially separated from each other by a filter member 44 that extends horizontally. Each of the four filter members 44 is provided by a mesh member formed of a stainless steel wire. When ink flows slowly during the recording operation, each filter member 44 allows the ink to flow from the bubble collecting chamber 40 to the ink flow chamber 42, while preventing air bubbles and dust present in the ink from flowing toward the printing head 34. Each filter member 44 has, in an end portion thereof remote from the ink flow inlet 39, an opening 44*a* whose flow resistance is sufficiently lower than that of the mesh member or portion. On the other hand, when ink flows fast during the recovering or purging operation, described later, each filter 44 allows a sufficient amount of ink to flow through the opening 44*a* thereof to the ink flow chamber 42.

Figure 6A:
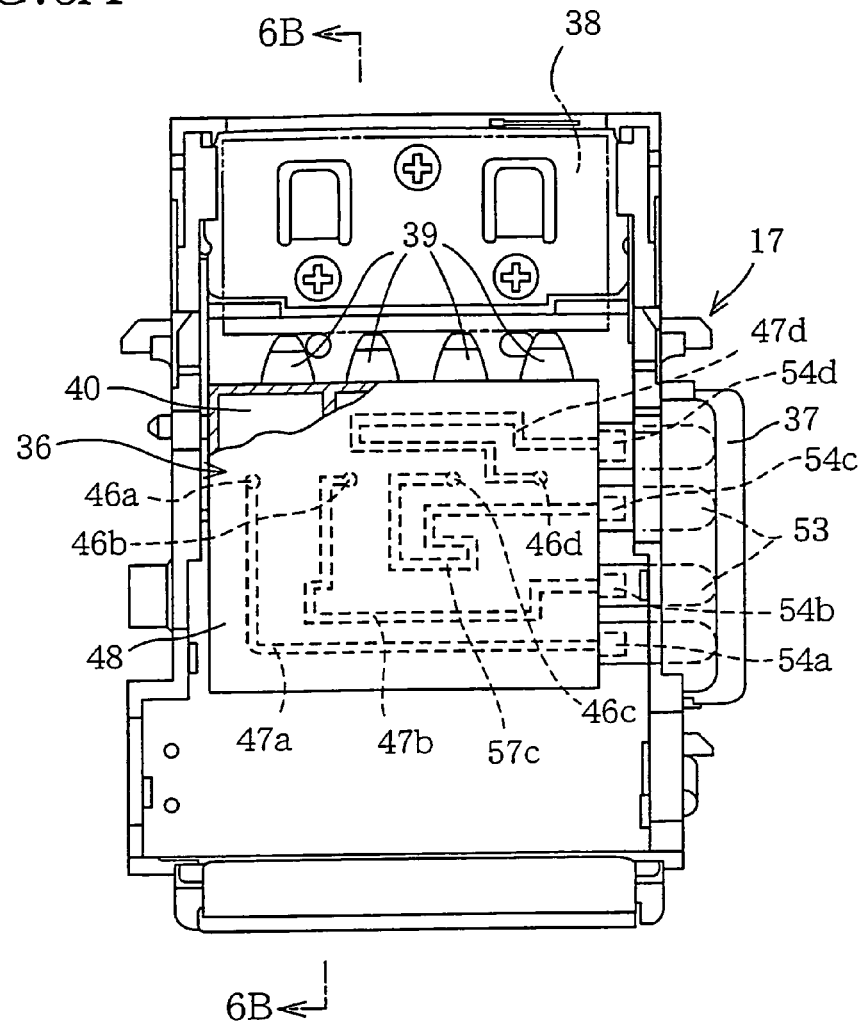
FIG. 6A is a plan view of a carriage on which a buffer tank is mounted.
Figure 6B:
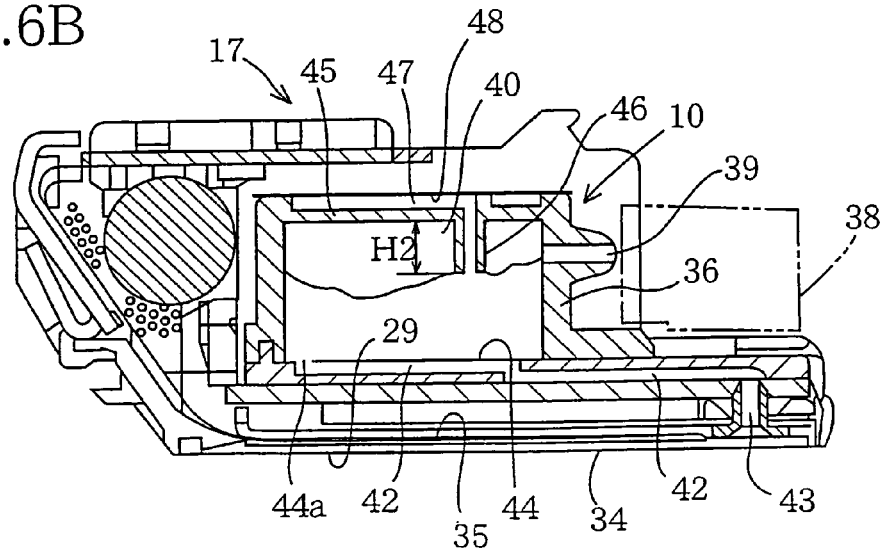
FIG. 6B is a cross-section view taken along arrows indicated at 6B, 6B in FIG. 6A.
Figure 7:
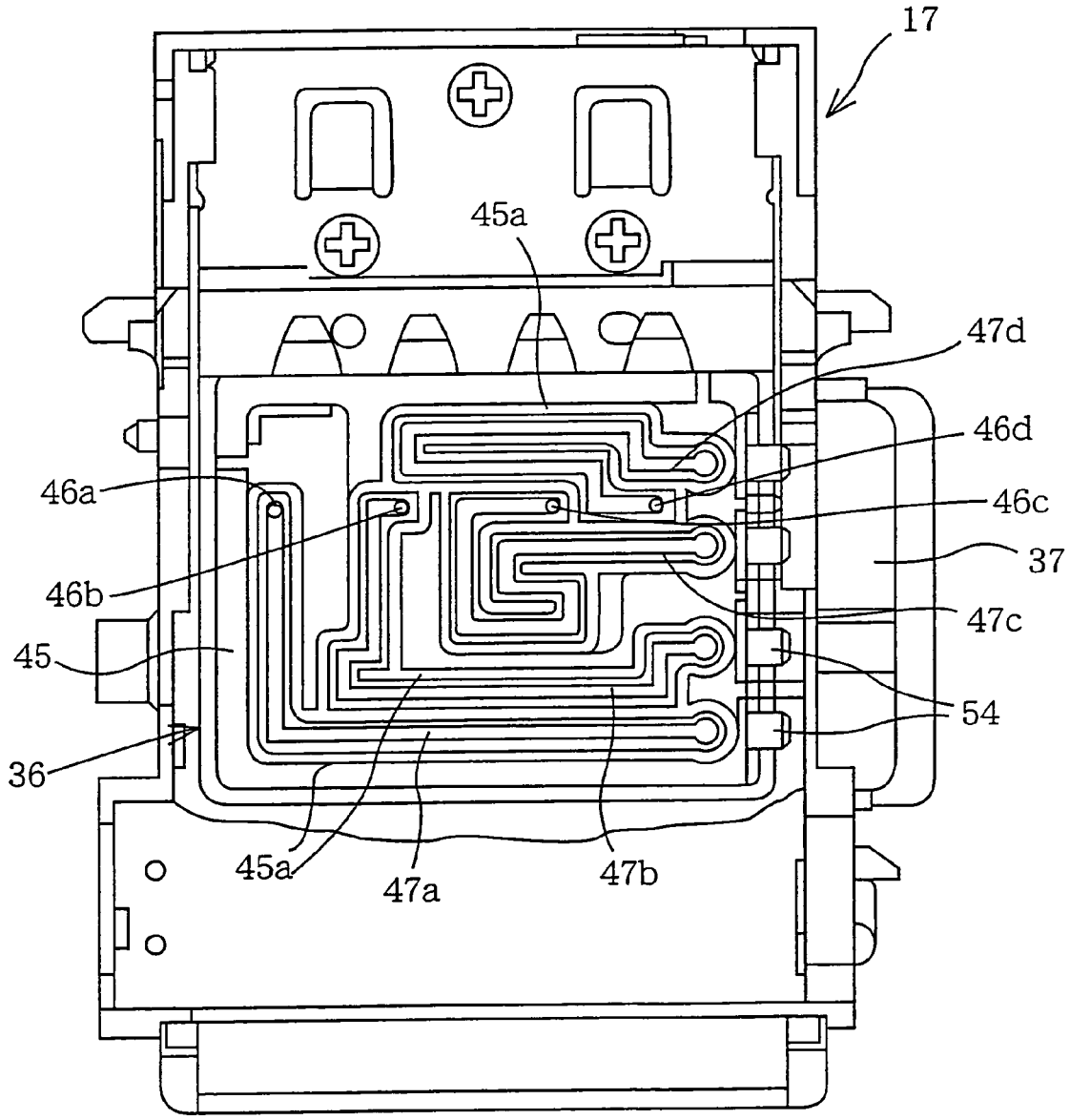
FIG. 7 is a plan view of air-discharge passages formed in an upper surface of the buffer tank.

As shown in FIGS. 6A, 6B, and 7, the four bubble collecting chambers 40 (40*a* to 40*d*) have, in respective ceiling or top walls 45 thereof, respective tubular air holes 46 (46*a*, 46*b*, 46*c*, 46*d*) as respective one ends of four air-discharge passages 47 (47*a*, 47*b*, 47*c*, 47*d*) that project downward from the top walls 45, for discharging air, and the air-discharge passages 47 are formed in respective upper surfaces of the top walls 45, such that four outlet portions 54 (54*a*, 54*b*, 54*c*, 54*d*) as the respective other ends of the passages 47 communicate with four inlet portions of the valve case 37, described later.

In a conventional ink jet printer, when a recovering or purging operation is performed, ink, and air bubbles collected in an air bubble collecting chamber are sucked through an ink ejection nozzle or nozzles. Therefore, a great suction force is needed to suck the air bubbles without clogging, with the bubbles, a narrow ink channel or channels of a printing head. In addition, the bubbles present above the ink stored in a buffer tank cannot be sucked before substantially all the ink stored in the buffer tank are sucked. This means that a great amount of ink is discarded uselessly, which leads to increasing the running cost of the conventional ink jet printer.

In contrast thereto, in the first embodiment, the air bubbles collected in the air bubble collecting chambers 40 located in the upper portion of the buffer tank 36, are removed from the upper portion of the buffer tank 36, in particular, from the air holes 46 of the top walls 45 of the collecting chambers 40. Therefore, the air bubbles do not flow into the printing head 34 located below the collecting chambers 40, and are effectively prevented from clogging the ink channels of the printing head 34. In addition, when the air bubbles are removed from the buffer tank 36, it is not needed to discharge so much ink stored in the buffer tank 36, which leads to decreasing the running cost of the ink jet printer 5 and thereby increasing an economical effect of the same 5.

In the first embodiment, the four air-discharge passages 47*a* to 47*d* corresponding to the four bubble collecting chambers 40*a* to 40*d*, respectively, are defined by respective grooves formed in the respective upper surfaces of the top walls 45 and a membrane member 48, such as a synthetic resin film, that is adhered to the upper surfaces of the top walls 45. In FIG. 7, reference numeral 45*a* designates ridges which are formed on the upper surfaces of the top walls 45 and separate the four air-discharge passages 47*a* to 47*d* from each other, and to which the membrane member 48 is adhered.

As shown in FIGS. 6A and 7, the four air-discharge passages 47*a* to 47*d* have a substantially same cross-section area, taken along a plane perpendicular to a lengthwise direction of each passage 47, and the cross-section area of each passage 47 is equal to, or smaller than, that of each of the four ink flow inlets 39 of the buffer tank 36 or that of each of the four ink passages 27*a* to 27*d* connected to the four ink flow inlets 39. Since respective lengths of the four air-discharge passages 47*a* to 47*d* are equal to each other, the four air-discharge passages 47*a* to 47*d* exhibit a substantially same flow resistance to air, i.e., the air bubbles when the bubbles are discharged from the bubble collecting chambers 40*a* to 40*d* via the case 37. Thus, the respective discharging of the air bubbles from the four bubble collecting chambers 40 can be completed at a substantially same time. In the present embodiment, each of the passages 47*a* to 47*d* has a cross-section area of 0.8 mm×0.8 mm, and an overall length of 31 mm.

A length, H2, of downward projection of each tubular air hole 46 from the lower surface of the top wall 45 is selected at an appropriate value which assures that an appropriate volume of air that cannot be discharged through the air hole 46 is always maintained in an upper portion of the bubble collecting chamber 40. This volume of air can absorb changes of pressure of the ink present in the chamber 40 that are caused when the carriage 17 is moved forward and backward. In the present embodiment, each of the air holes 46 projects downward over a length H2 of 3.3 mm from a corresponding one of the top walls 45.

Figure 26:
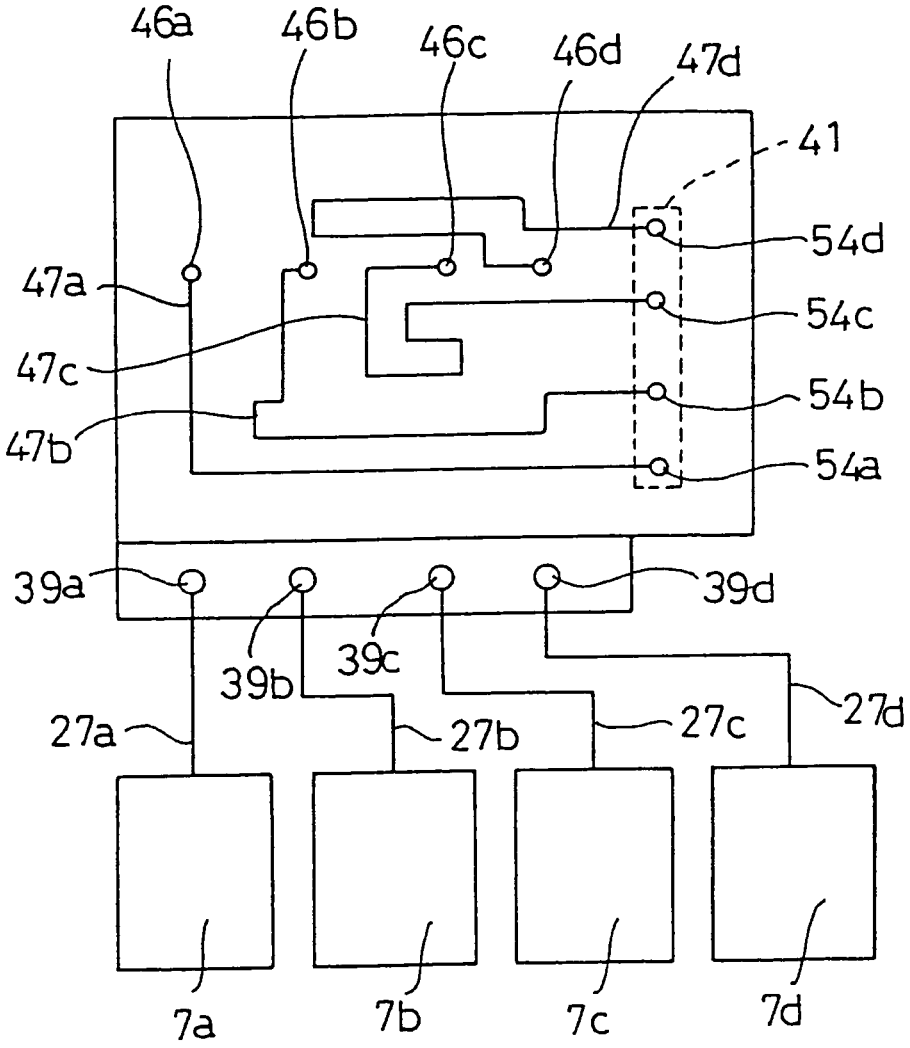
FIG. 26 is a diagrammatic view for explaining entire flow passages for discharging air bubbles that are employed in the first embodiment.

In the first embodiment, as shown in FIG. 26, the four air holes 46*a* to 46*d* as the respective one ends of the air-discharge passages 47*a* to 47*d* are arranged in the reciprocation direction in which the carriage 9 is reciprocated; and the four outlet portions 54*a*-54*d* as the respective other ends of the passages 47*a* to 47*d* are arranged in a direction perpendicular to the reciprocation direction. Consequently respective distances between the respective one ends, and the corresponding other ends, of the four passages 47*a* to 47*d*, i.e., respective lengths of respective straight lines connecting between the four air holes 46*a* to 46*d* and the corresponding outlet portions 54*a* to 54*d* differ from each other. However, respective shapes of the four passages 47 between the corresponding air holes 46 and the corresponding outlet portions 54 are so deformed, i.e., curved that the four passages 47 have a substantially same length. That is, the first length of the first passage 47*a* between the first air hole 46*a* and the first outlet portion 54*a*, the second length of the second passage 47*b* between the second air hole 46*b* and the second outlet portion 54*b*, the third length of the third passage 47*c* between the third air hole 46*c* and the third outlet portion 54*c*, and the fourth length of the fourth passage 47*d* between the fourth air hole 46*d* and the fourth outlet portion 54*d* are substantially equal to each other. Accordingly, the four passages 47*a* to 47*d* exhibit a substantially same resistance to flow of air, or air bubbles.

In addition, when the air-discharging device 41 is operated to discharge the air from each of the bubble collecting chambers 40*a* to 40*d*, the discharging of the air is influenced by respective fluid-flow resistance values of respective upstream side portions of four ink flow passages that are located on an upstream side of the respective air holes 46*a* to 46*d*. As shown in the diagrammatic view of FIG. 26, the respective upstream side portions of the four ink flow passages, located on the upstream side of the air holes 46*a* to 46*d*, include the ink tanks 7*a* to 7*d*, the ink passages 27*a* to 27*d*, the ink flow inlets 39*a* to 39*d*, and the bubble collecting chambers 40*a* to 40*d*, in the order of description, and then reach the air holes 46*a* to 46*d*. In the present embodiment, the respective fluid-flow resistance values (Ro) of those upstream side portions are made equal to each other, by, e.g., employing the four ink passages 27*a* to 27*d* whose lengths are all equal to each other.

Thus, the respective fluid-flow resistance values of the entire ink flow passages between the four ink tanks 7*a* to 7*d* corresponding to the four color inks and the air-discharging device 41 are made equal to each other. Consequently, when the air-discharging device 41 is opened, the air is discharged from the four bubble collecting chambers 40*a* to 40*d* at a substantially same flow rate. That is, if the respective operations of discharging, using the valve device 41, the air from the four bubble collecting chambers 40 are started at the same time, then those operations are finished at a substantially same time. Therefore, the ink jet printer 5 is free of a problem that a great amount of ink is discharged, following the air, from one of the chambers 40 from which the discharging of the air has been finished earlier than from the other chambers 40.

Owing to the respective cross section areas and lengths of the four air-discharge passages 47*a* to 47*d*, the four air-discharge passages 47*a* to 47*d* exhibit respective greater flow resistances to ink than respective flow resistances to air (i.e., air bubbles). Usually, respective amounts of air collected in the four bubble collecting chambers 40*a* to 40*d* of the buffer tank 36 differ from each other. However, when the air discharging operation, described later, is performed with respect to all the bubble collecting chambers 40, even if the level of upper surface of the ink present in one bubble collecting chamber 40 reaches the air hole 46, an appropriate amount of air is discharged from another bubble collecting chamber 40, before the ink present in the one chamber 40 is sucked into the air hole 46, because each air-discharge passage 47 exhibits the greater flow resistance to ink than the flow resistance to air. Thus, even if the respective amounts of air present in the four bubble collecting chambers 40 may differ from each other, appropriate amounts of air can be discharged from the four chambers 40, without causing a problem that an excessively large amount of ink is sucked from a particular one of the four chambers 40 that is now holding a smaller amount of air, i.e., a larger amount of ink.

Figure 11A:
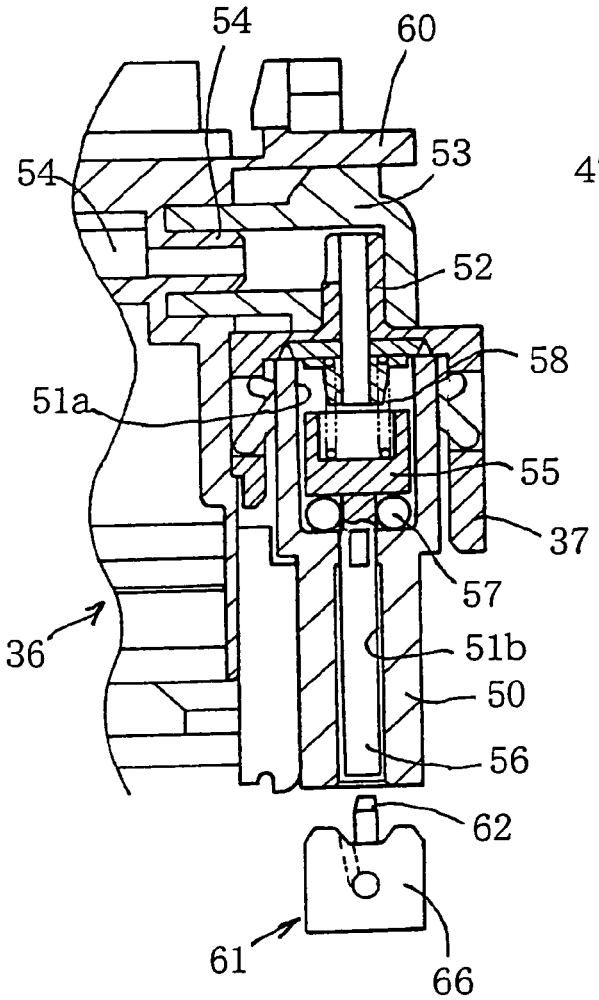
FIG. 11A is an enlarged cross-section view of a portion of an air-discharging device being placed in its closed state.
Figure 11B:
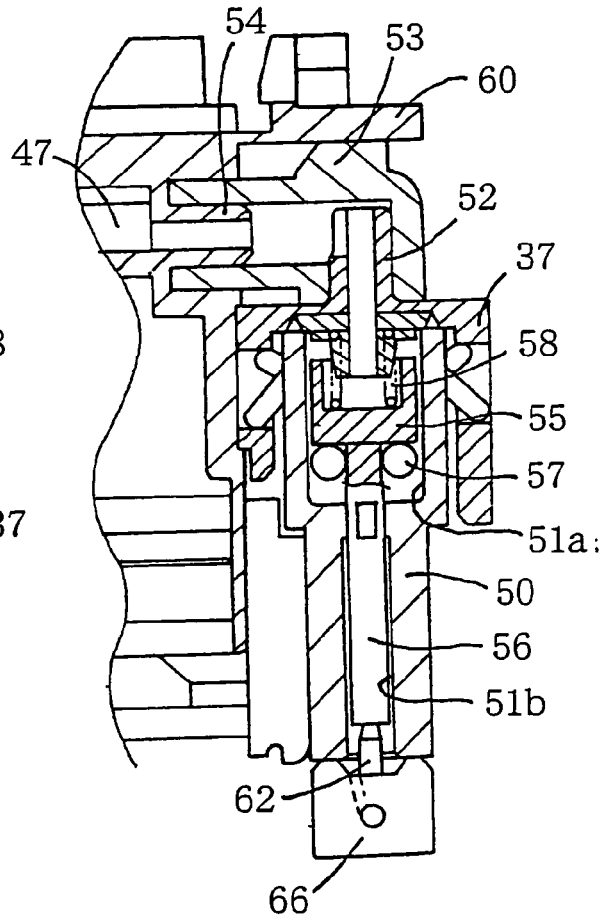
FIG. 11B is an enlarged cross-section view of the portion of the air-discharging device being placed in its open state.

The valve case 37 that incorporates or supports the air-discharging device 41 is provided adjacent one side wall of the buffer tank 36, i.e., on the right-hand side of the buffer tank 36 as seen in FIGS. 6A, 7, and 10. As shown in FIGS. 10, 11A, and 11B, the valve case 37, formed of a synthetic resin, air-tightly receives a cylinder block 50, also formed of a synthetic resin, that has four valve holes, i.e., vertically elongate communication holes 51 each of which has upper and lower open ends and which correspond to the four air-discharge passages 47*a* to 47*d*, respectively. Four communication tubes 52 that communicate with the respective upper open ends of the four communication holes 51 project upward from an upper end of the valve case 37, and four cap members 53 each formed of, e.g., a soft rubber connect between the four communication tubes 52 and the respective horizontal outlet portions 54 of the four air-discharge passages 47*a* to 47*d*. A hold-down portion 60 that horizontally projects from the top portion of the buffer tank 36 prevents the cap members 53 from coming off the buffer tank 36 and the valve case 37.

Each of the four communication holes 51 consists of an upper large-diameter portion 51*a* and a lower small-diameter portion 51*b*. A large-diameter valve member 55 is integral with a small-diameter valve rod 56 located under the valve member 55. A packing member 57 (e.g., an O-ring) as a sealing member is fitted on the valve rod 56 and is located under the valve member 55. The packing member 57 and the valve member 55 are inserted in the large diameter portion 51*a*, such that the two members 57, 57 are movable up and down; and the valve rod 56 is inserted in the small diameter portion 51*b*. A lower end of the valve rod 56 extends to a position in the vicinity of the lower open end of the small diameter portion 51*b*. The valve member 55 is normally biased in a downward direction by a spring member 58, such as a coil spring, that is provided in the large diameter portion 51*a*. In this state, the packing member 57 is pressed against a bottom wall defining a lower end of the large diameter portion 51*a* of the communication hole 51. This state is a closed state of the valve member 55, shown in FIG. 11A. Meanwhile, when a release rod 62 as a valve operating member of an air bubble removing device 61, described later, is moved upward to push the valve rod 56 upward against the biasing force of the spring member 58, the packing member 57 is moved upward away from the bottom wall of the large diameter portion 51*a*. This is an open state of the valve member 55, shown in FIG. 11B, in which the communication hole 51 communicates with the atmosphere.

Figure 47:
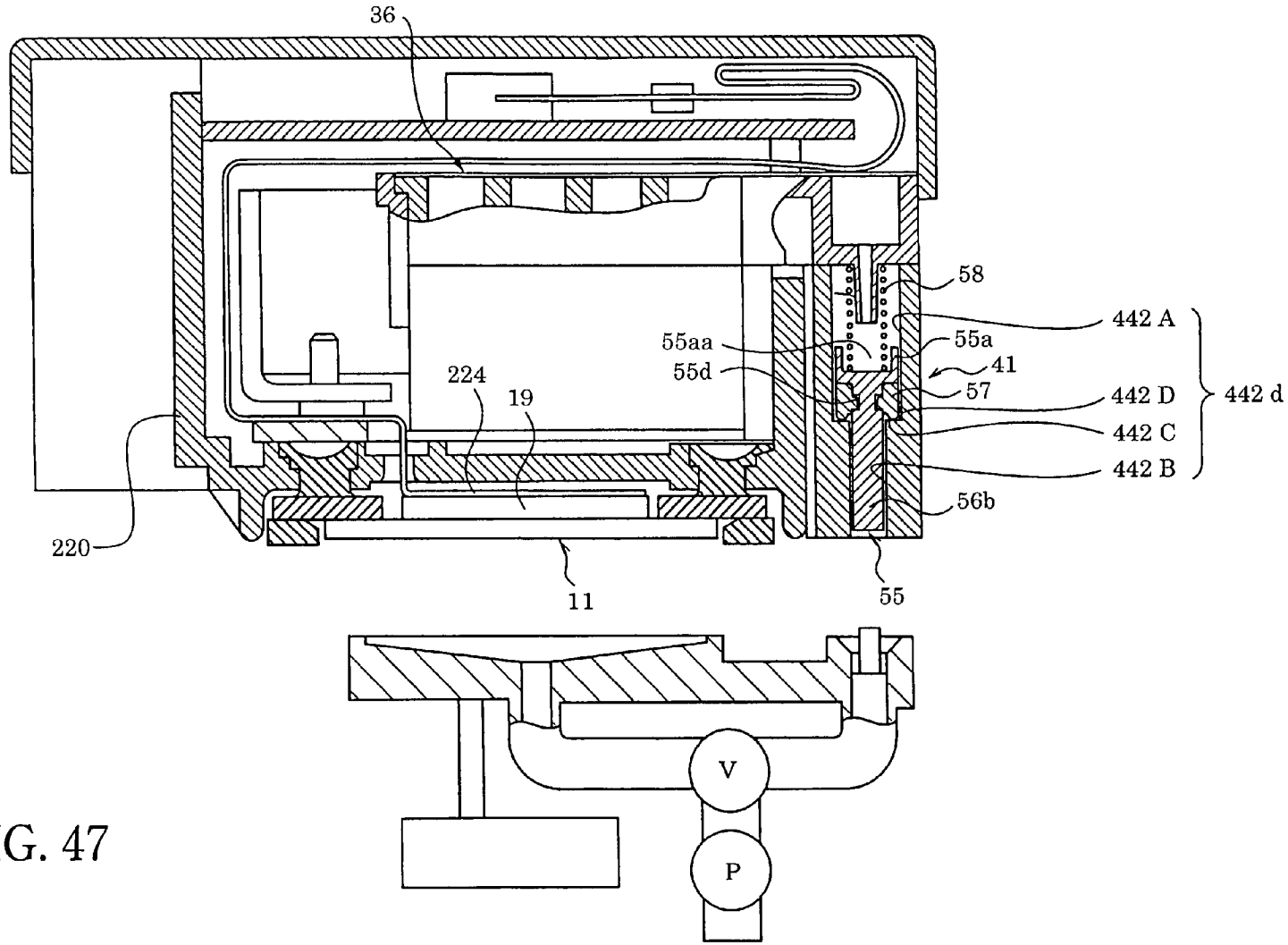
FIG. 47 is a cross sectional view of an alternate embodiment of the first embodiment.
Figure 48A:
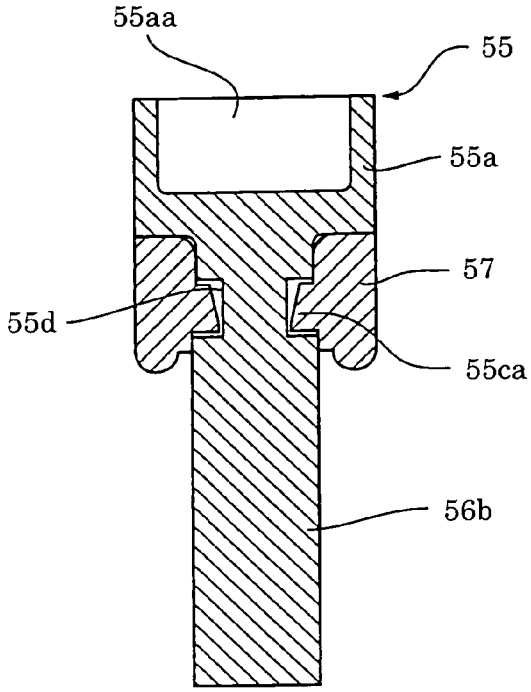
FIGS. 48A and 48B are views for explaining a valve member according to an alternate embodiment to the first embodiment.
Figure 48B:
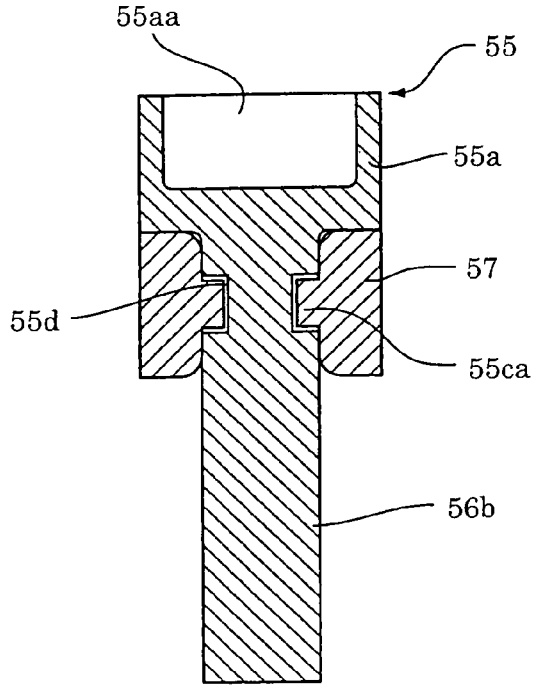

In an alternate illustrated embodiment, shown in FIGS. 47 and 48, the valve member 55 is slidable within the air-discharge passage constituted by including the air-discharge hole 442*d*, and the sealing member 57 is held in abutting contact with the valve seat surface 442D to close the communication opening 442C while the rod portion 56*b* is moved together with the sealing member 57 in the direction in which the sealing member 57 is separated away from the valve seat surface 442D to open the communication opening 442D. In this arrangement, the valve member 55 (the rod portion 56*b*) slides within the air-discharge passage, and the communication opening 442C is closed by the sealing member 57 which is held in abutting contact with the valve seat surface 442D while the communication opening 442C is opened when the rod portion is moved together with the sealing member so as to be separated away from the valve seat surface 442D.

In the alternate illustrated embodiment, shown in FIGS. 47 and 48, the retaining means is constituted by the recessed retaining portion 55*d* as the concave portion provided on the rod portion 55*d* for retaining the sealing member 55*c* thereon. In this arrangement, the sealing member 55*c* is retained on the rod portion 55*b* such that the sealing member is movable together with the rod portion in the direction to open and close the communication opening 442C, with a simple structure in which the rod portion is formed with the recessed retaining portion 55*d* as the retaining means for retaining the sealing member. Therefore, it is possible to permit the sealing member to follow the movement of the rod portion with high reliability. The retaining means may be constituted by the concave portion such as a groove or a recess formed in the rod portion as described in the illustrated embodiments or may be constituted by a convex portion such as a protrusion formed on the rod portion on which the sealing member is retained.

In the alternate illustrated embodiment, shown in FIGS. 47 and 48, the valve portion of the valve member 55 includes the valve head 55*a* having a diameter larger than that of the rod portion 55*b* and the sealing member 55*c* is in contact with the valve head while being retained on the rod portion at its recessed retaining portion 55*d*. Further, the valve head 55*a* is opposed to the valve seat surface 442D with the sealing member 55*c* interposed therebetween. In this arrangement, the sealing member 55*c* is in contact with the valve head 55*a* while being retained on the recessed retaining portion 55*d* and the valve head 55*a* is opposed to the valve seat surface 442D via the sealing member 55*c*, so that the sealing member exhibits its sealing function with high reliability.

Where the sealing member is configured to be symmetrical in the direction of thickness or height thereof, the sealing member is assembled onto the rod portion irrespective of the orientation in its thickness direction, so as to avoid inappropriate or erroneous assembling of the sealing member onto the rod portion.

In the alternate illustrated embodiment, shown in FIGS. 47 and 48, the air-discharging device 41 includes the coil spring 58 as the spring member which biases the valve head 55*a* in the direction in which the sealing member 55*c* is held in abutting contact with the valve seat surface 442D. In this arrangement, the valve head is biased by the coil spring in the direction in which the sealing member is held in abutting contact with the valve seat surface 442D, so that it is possible to assure increased sealing tightness given by the sealing member.

Figure 12:
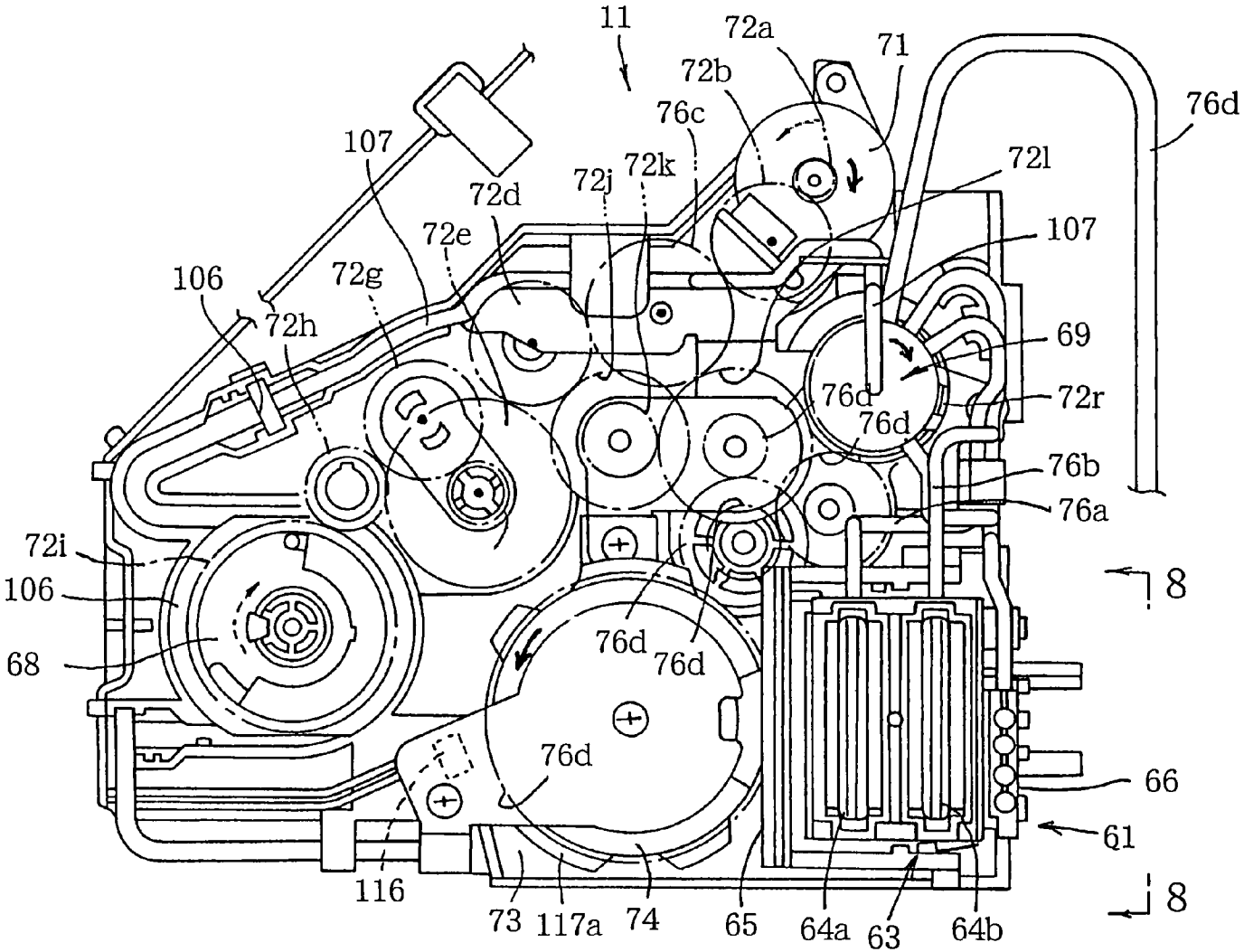
FIG. 12 is a plan view of the maintenance unit.
Figure 13:
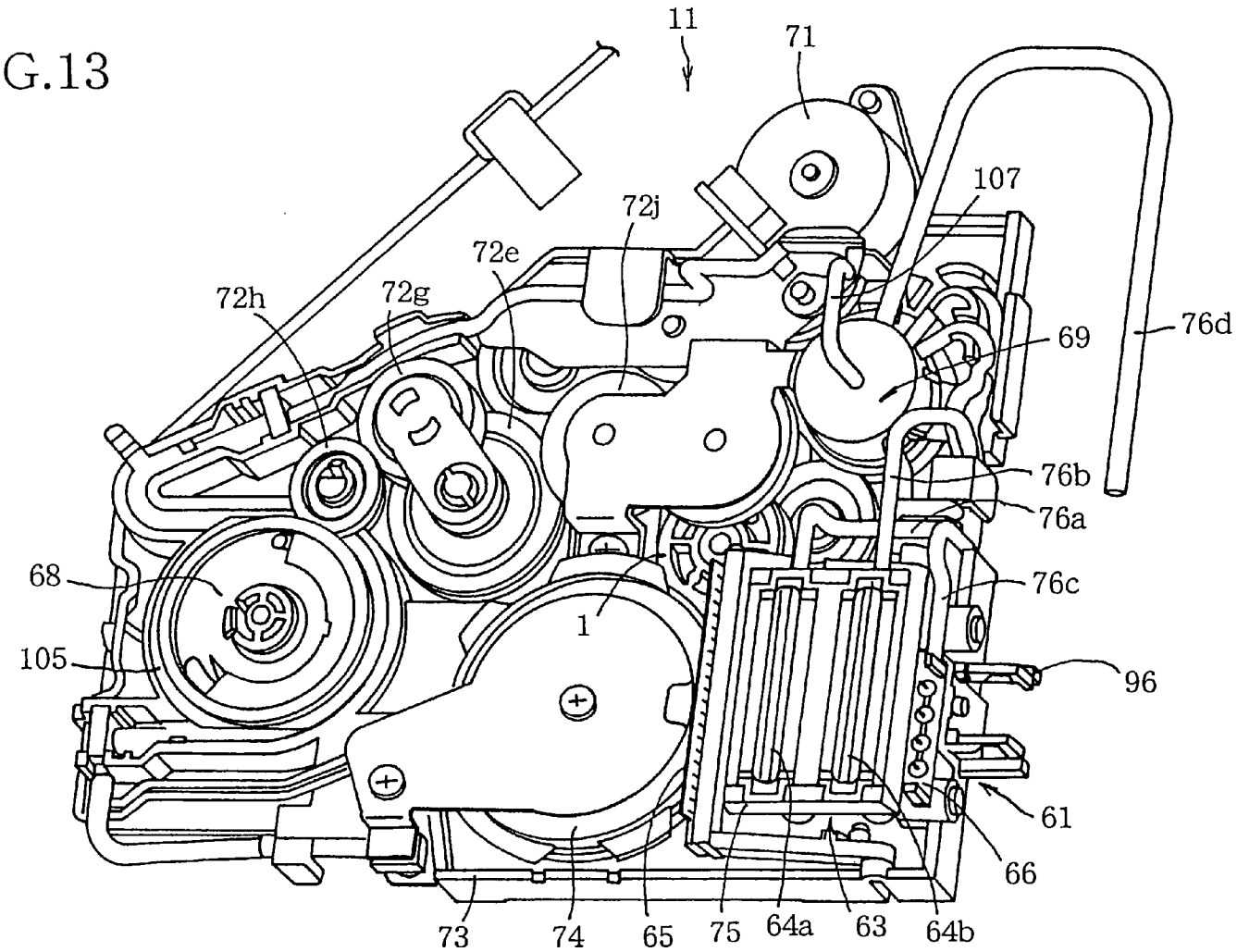
FIG. 13 is a perspective view of the maintenance unit.

Next, the construction of the maintenance unit 11 will be described by reference to FIGS. 8 to 10, 11A, 11B, 12 to 15, 16A, 16B, 16C, 17A, 17B, 18 to 20, 21A, and 21B. The maintenance unit 11 is provided in the vicinity of the head waiting position located at the right-hand end in FIGS. 2 and 3. The maintenance unit 11 includes a recovering device 63 and the bubble removing device 61. The recovering device 63 includes cap members 64 (64*a*, 64*b*) which cover the nozzle supporting surface 29 of the printing head unit 10 mounted on the carriage 17, when the carriage 17 rests at the head waiting position. In the state in which the cap members 64 cover the nozzle supporting surface 29, the recovering device 63 sucks the nozzles 33, thereby sucking out clogs of solidified inks, fine dusts, and air bubbles from the printing head 34. The bubble removing device 61 discharges and removes the air bubbles collected in the bubble collecting chambers 40, by utilizing the air-discharge passages 47 and the air-discharging device 41, and sucks and removes inks discharged with the bubbles. The recovering device 63 and the bubble removing device 61 are located adjacent each other, such that the bubble removing device 61 is located outside the recovering device 63, in the direction of movement of the carriage 17. As shown in FIGS. 12 and 13, a wiper 65 that wipes and cleans the nozzle supporting surface 29 is located, in its plan view, at a position opposite to an elevator member 66 supporting the four release rods 66 of the bubble removing device 61, with respect to the cap members 64 of the recovering device 63.

Figure 8:
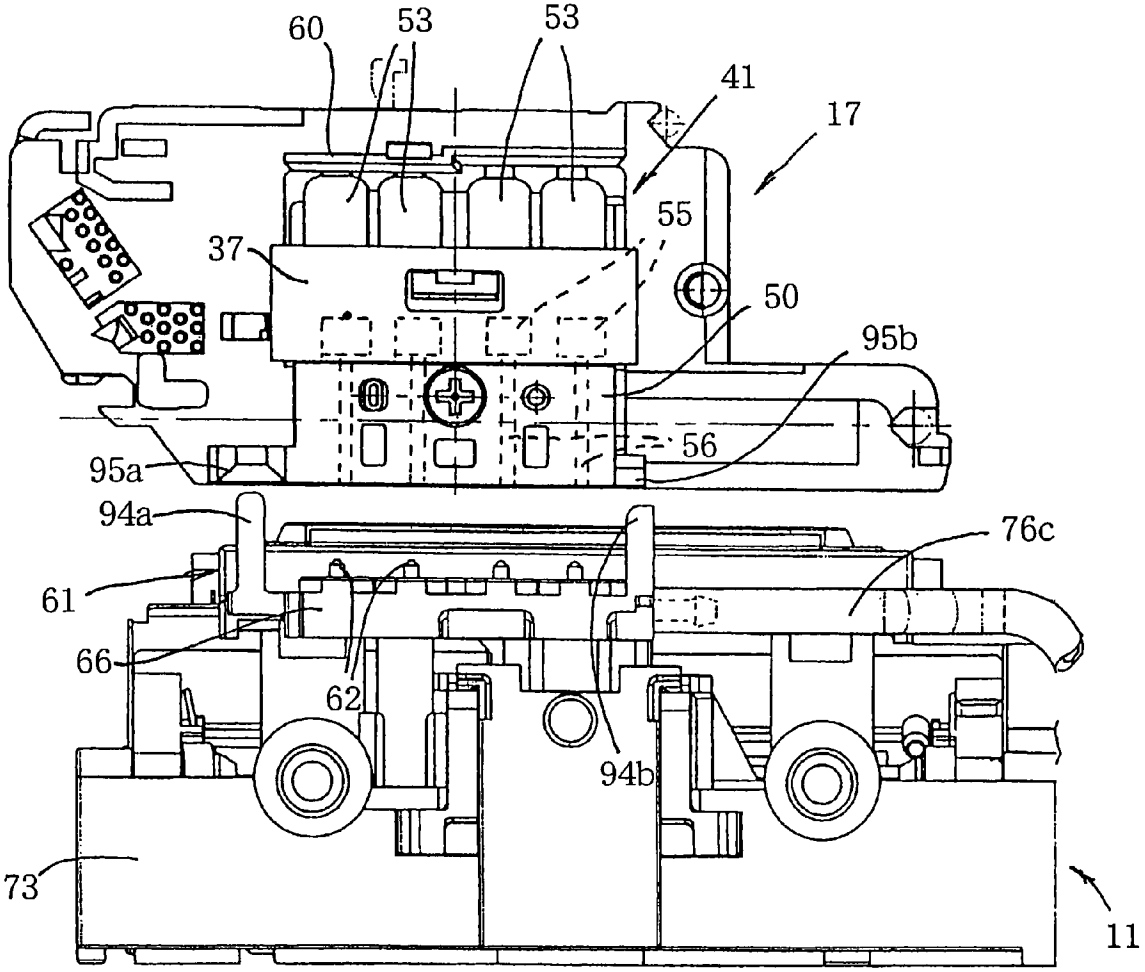
FIG. 8 is a side elevation view of the carriage and a maintenance unit, taken along arrows indicated at 8, 8 in FIG. 12.
Figure 14:
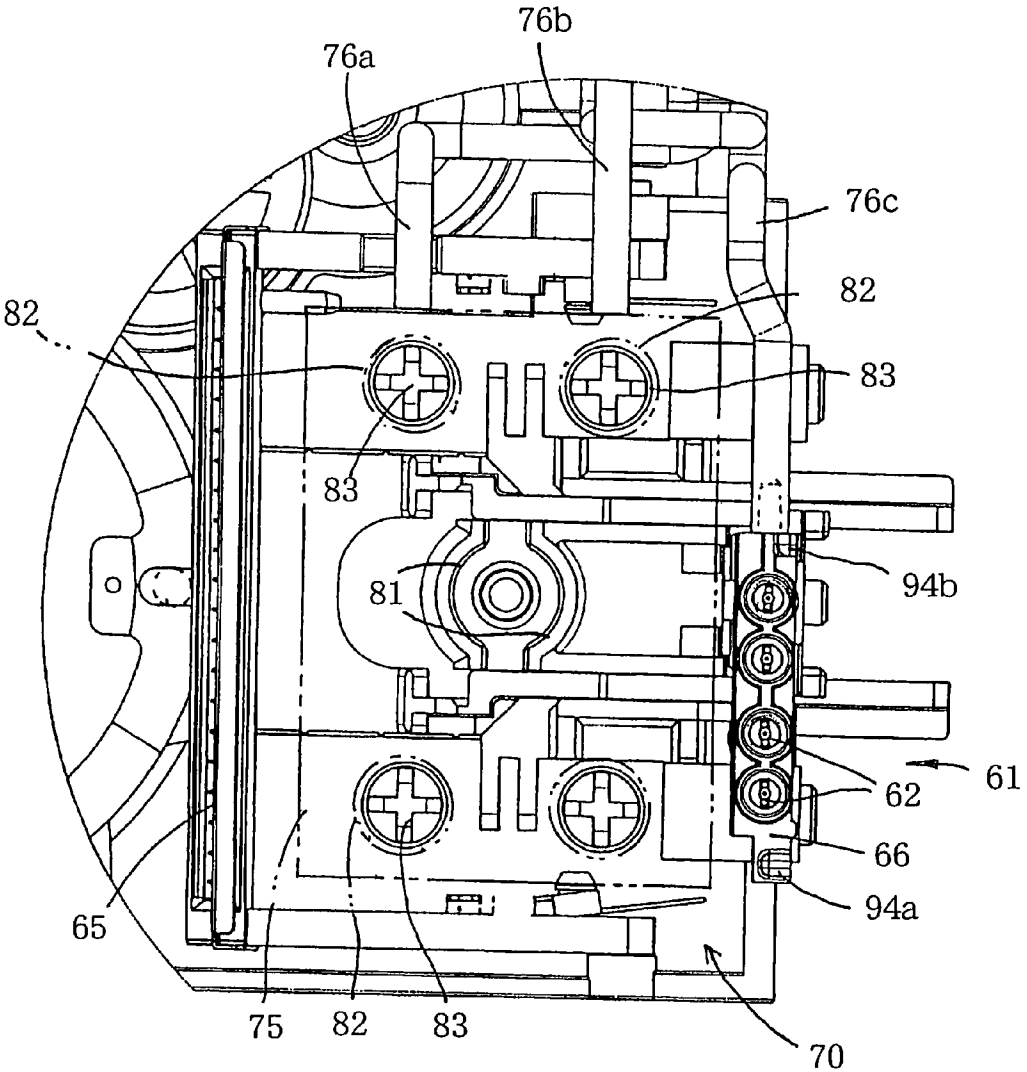
FIG. 14 is an enlarged plan view of a portion of the maintenance unit where the translational cam is provided.

The maintenance unit 11 is shown in detail in FIGS. 12 and 13; an elevating and lowering device 70 of the unit 11 is shown in FIG. 14; and the carriage 17 and the unit 11 are shown in FIG. 8.

The maintenance unit 11 includes a single motion converting device 67 that can operate the elevating and lowering device 70 to elevate and lower selectively the recovering device 63 or the bubble removing device 61, can selectively operate the suction pump 68 as a suction device to suck ink, and can switch a switch valve unit 69 to supply the suction (i.e., a negative pressure) of the suction pump 68 selectively to the recovering device 63 or the bubble removing device 61. In the first embodiment, the suction pump 68 is used as a discharging device, and the motion converting device 67 can disconnectably connect the suction pump 68 to the air-discharging device 41 connected to the other ends of the bubble discharging passages 47.

The motion converting device 67 includes a train of gears 72 each of which is rotatably supported by a unit table 73, and an electric motor 71 which is located on one end of the unit table 73 and can be rotated in forward and backward directions to transmit power to the train of gears 72. When the electric motor 71 is rotated in the backward direction, i.e., counterclockwise in FIG. 12, the driving force of the motor 71 is transmitted via a plurality of gears 72*a*, 72*b*, 72*c*, 72*d*, 72*e*, 72*f*, 72*g*, 72*h*, 72*i* out of the train of gears 72 to the suction pump 68, so that the suction pump 68 is rotated clockwise and a negative pressure is supplied from the pump 68 to the switch valve unit 69, for sucking ink, as will be described later. Out of the gears 72*a* to 72*i*, the gear 72*e* and the sun gear 72*f* are rotated counterclockwise. Concurrently, the planetary gear 72*g* in mesh with the sun gear 72*f* rotates clockwise while revolving counterclockwise about the axis of the sun gear 72*f*, and thereby meshing and rotating the intermediate gear 72*h*, so that the power is transmitted to the gear 72*i* of the tube-type suction pump 68.

On the other hand, when the electric motor 71 is rotated in the forward direction, i.e., clockwise in FIG. 12, the driving force of the motor 71 is transmitted via the gears 72*a* to 72*d* to the gear 72*e* and the sun gear 72*f*, so that the gears 72*e*, 72*f* are rotated clockwise. Consequently the planetary gear 72*g* in mesh with the sun gear 72*f* rotates counterclockwise while revolving clockwise about the axis of the sun gear 72*f*, and thereby meshing and rotating the following gear 72*j*, so that the power is partly transmitted via gears 72*k*, 72*l*, 72*m*, 72*n*, 72*o* to a rotary cam member 74 to rotate the same 7 counterclockwise, and is partly transmitted via gears 72*p*, 72*q* to a gear 72*r* to change a rotation angle of a switch member 110 of the switch valve unit 69.

Next, there will be described the restoring device 63, the bubble removing device 61, the elevating and lowering device 70 that selectively elevates and lowers one of those devices 63, 61, and the rotary cam member 74 that drives the elevating and lowering device 70, by reference to FIGS. 10, 12, 13, 14, 15, 16A, 16B, 16C, 17A, 17B, 18, 19, and 20.

The recovering device 63 includes the two cap members 64*a*, 64*b* that can contact the nozzle supporting surface 27 exposed in the lower surface of the carriage 17, each for covering corresponding two arrays of nozzles 33 out of the four arrays of nozzles 33*a* to 33*d*; and a support block 75 that is formed of, e.g., a synthetic resin, has a generally rectangular shape in its plan view, and supports, on an upper surface thereof, the two cap members 64*a*, 64*b* such that the two members 64*a*, 64*b* extend parallel to each other. The reason why the two cap members 64*a*, 64*b* are employed is to prevent two or more different color inks from being mixed with each other. The two cap members 64*a*, 64*b* have respective ink suction holes, not shown, that communicate with respective tubes 76*a*, 76*b* via respective internal passages, not shown, of the support block 75 and respective outlets, not shown, formed in a side surface of the same 75. Thus, the cap member 64*a* corresponding to the black ink and the cyan ink is connected via the tube 76*a* to a port, A, of the switch valve unit 69 (FIGS. 21A, 21B, and 22); and the cap member 64*b* corresponding to the magenta ink and the yellow ink is connected via the tube 76*b* to a port, B, of the same 69.

Figure 15:
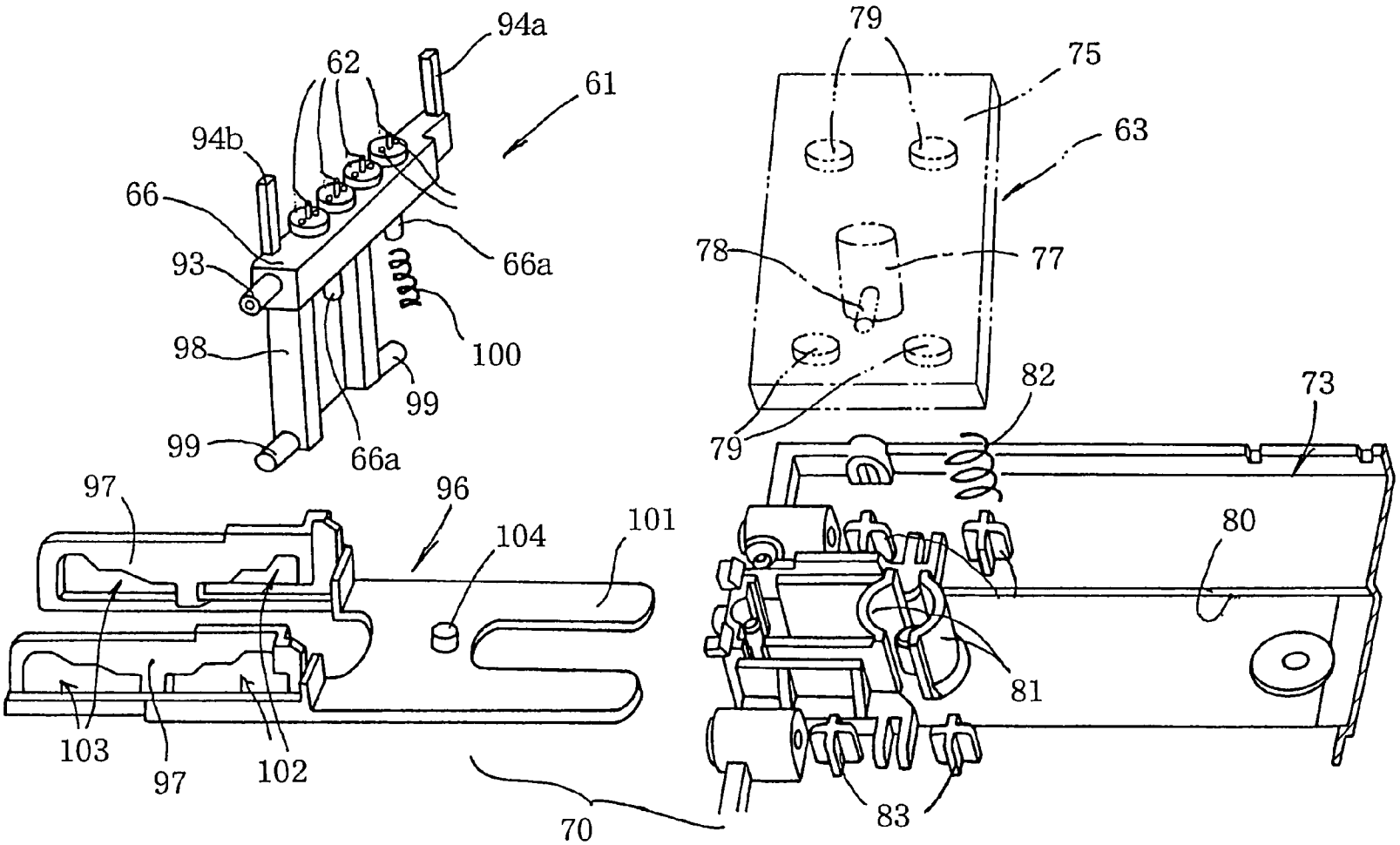
FIG. 15 is a perspective view of a unit table, a support block, and an elevator member of the maintenance unit.
Figure 16B:
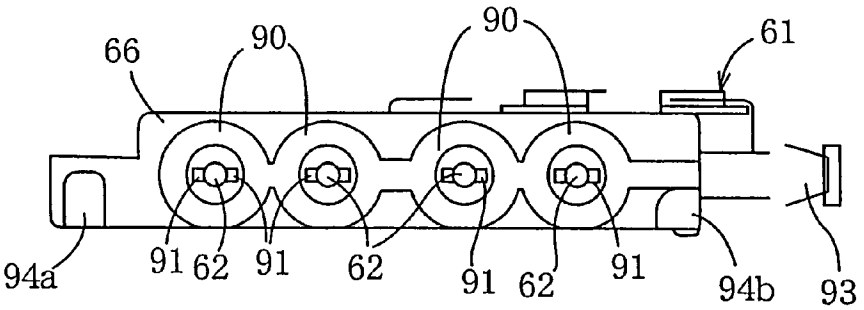
FIG. 16B is a plan view of the elevator member.
Figure 16A:
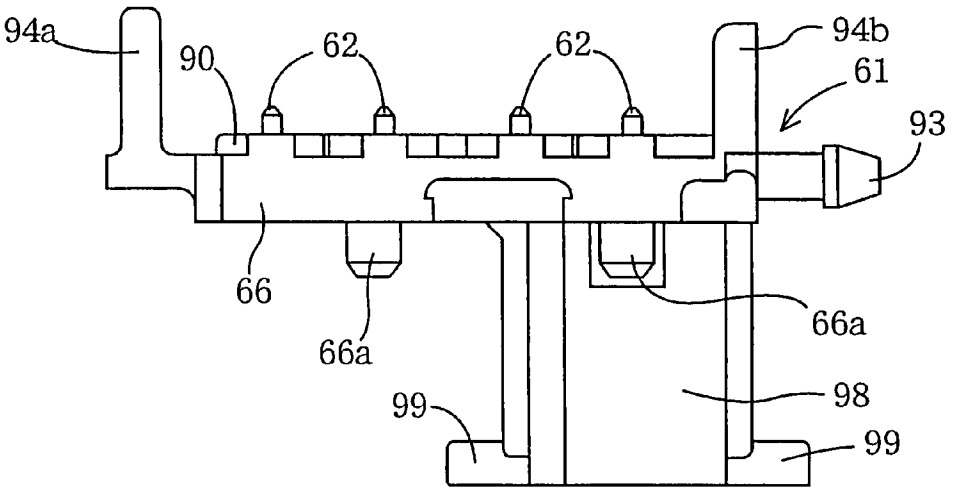
FIG. 16A is a front elevation view of the elevator member.
Figure 16C:
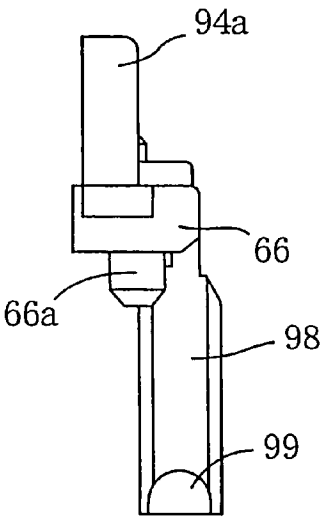
FIG. 16C is a left-hand side elevation view of the elevator member.

As shown in FIGS. 10 and 15, the support block 75 has, in a central portion of a lower surface thereof, a guide cylinder 77 from an outer side surface of which two contact pins 78, 78 (only one 78 is shown in the figures) each as a cam follower project horizontally. In addition, the support block 75 has four spring seats 79 that project downward from the lower surface of the block 75 such that the four spring seats 79 surround the guide cylinder 77. The unit table 73, formed of, e.g., a synthetic resin, has, in an upper surface thereof, a guide groove 80. From a substantially central portion of the guide groove 80, two guide members 81, 81 each having an arcuate cross section project upward. The two guide members 81 cooperate with each other to guide upward and downward movement of the guide cylinder 77 having the contact pins 78, and prevent those elements 77, 78 from rotating in a plane perpendicular to the direction of upward and downward movement of the support block 75 (see FIGS. 14 and 15). Moreover, outside the guide groove 80, there are provided four projections 83 that define respective positions of respective lower ends of four biasing springs 82 that are seated on the four spring seats 79, respectively, and cooperate with each other to bias the support block 75 upward.

Figure 17A:
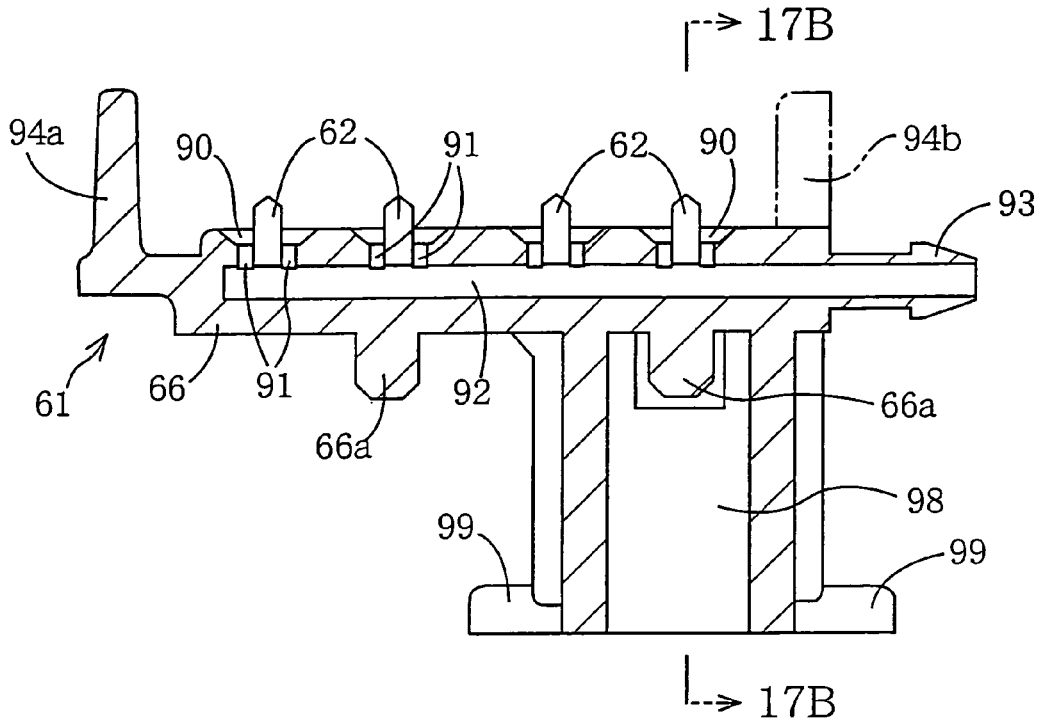
FIG. 17A is a cross-section view of the elevator member.
Figure 17B:
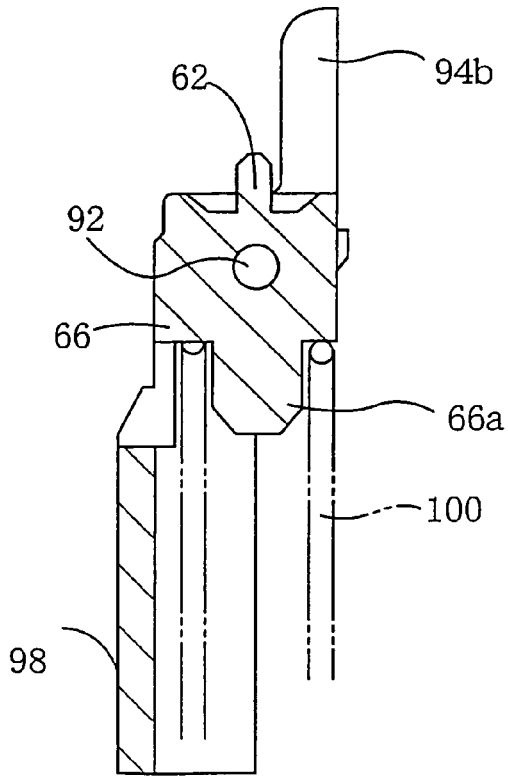
FIG. 17B is a cross-section view of the elevator member, taken along arrows indicated at 17B, 17B in FIG. 17A.

As shown in FIGS. 14, 15, 16A, 16B, 16C, 17A, and 17B, the elevator member 66 of the bubble removing device 61 has, in an upper surface thereof, four dish-like suction portions 90 that can closely contact the four communication holes 51 of the cylinder block 50, respectively. Each of the suction portions 90 includes a suction hole 91 which can communicate with a corresponding one of the small diameter holes 51*b* opening in the lower surface of the cylinder block 50; and the release rod 62 that projects upward and can fit in the corresponding small diameter hole 51*b* and push a corresponding one of the valve rods 56. The suction hole 91 opens around a base portion of the corresponding release rod 62. As shown in FIG. 17A, all the suction holes 91 communicate with an outlet tube 93 projecting from a side surface of the elevator member 66 via an internal passage 92 of the same 66. As shown in FIGS. 15, 16A, 16B, 16C, 17A, and 17B, the elevator member 66 has two generally rectangular members 94*a*, 94*b* each as a positioning member that project upward from an upper surface of the elevator member 66. As shown in FIG. 8, when the elevator member 66 moves upward toward the cylinder block 50, the two rectangular members 94*a*, 94*b* engage two positioning guide grooves 95*a*, 95*b*, respectively, so that the elevator member 66 is positioned in two horizontal directions perpendicular to each other and accordingly each of the four release rods 62 can smoothly fit in a corresponding one of the four small diameter holes 51*b*.

The elevator member 66 has a leg portion 98 that projects downward and fits in a space present between two vertical guide portions 97, 97 of a translational cam member 96, described later. The leg portion 98 has, in a lower end portion thereof, two contact pins 99, 99 each as a cam follower that horizontally project from the leg portion 98 in opposite outward directions parallel to a lengthwise direction of the elevator member 66. In addition, as shown in FIGS. 15, 16A to 16C, 17A, and 17B, the elevator member 66 has, on the lower surface thereof, two spring seats 66*a*, 66*a* that support respective upper ends of two biasing springs 100 (only one spring 100 is shown in FIG. 15) that are provided on the unit table 73. The biasing springs 100 cooperate with each other to bias the elevator member 66 upward.

The translational cam member 96 and the rotary cam member 74 cooperate with each other to provide the single, motion converting device 67 that selectively performs either one of the action of moving the two cap members 64*a*, 64*b* of the recovering device 63, up and down, so as to contact, and move away from, the nozzle supporting surface 29, and the action of moving the release rods 62 of the bubble removing device 61, up and down, to open and close the valve members 155.

As shown in FIGS. 10, 14, 15, 19, and 20, the translational cam member 96 includes a bifurcated, horizontal guided portion 101 that is guided horizontally by the guide groove 80 of the unit table 73; and additionally includes the two vertical guide portions 97, 97 that project upward from the horizontal guided portion 101. A pin 104 projecting upward from the horizontal guided portion 101 fits in an endless cam groove 74*a* (FIG. 18) of the rotary cam member 74. As the rotary cam member 74 is rotated in a certain direction, the translational cam member 96 is reciprocated in directions, indicated at X1-X2 in FIGS. 10, 15, 19, and 20, that are perpendicular to the directions in which the elevator member 66 is moved up and down to contact, and move away from, the lower surface of the cylinder block 50.

The two vertical guide portions 97 include respective cam portions having respective first cam surfaces 102 with which the two contact pins (cam followers) 78 of the recovering device 63 are engaged in the biasing direction (i.e., the upward direction) in which the pins 78 are biased by the biasing springs 82, and additionally having respective second cam surfaces 103 with which the two contact pins (cam followers) 99 of the bubble removing device 61 are engaged in the biasing direction (i.e., the upward direction) in which the pins 99 are biased by the biasing springs 100. The first cam surfaces 102 and the second cam surfaces 103 define the respective upward and downward movements of the recovering device 63 and the bubble removing device 61 that are caused when the translational cam member 96 is reciprocated.

More specifically described, the first and second cam surfaces 102, 103 are so formed as to move the recovering device 63 and the bubble removing device 61 in opposite directions, respectively, i.e., in such a manner that when the recovering device 63 moves upward, the bubble removing device 61 moves downward, and vice versa. The first cam surfaces 102 include respective lowermost cam surfaces 102*a*, respective intermediate cam surfaces 102*b*, and respective uppermost cam surfaces 102*c* all of which are horizontal; respective first inclined surfaces connecting between the lowermost and intermediate cam surfaces 102*a*, 102*b*; and respective second inclined surfaces connecting between the intermediate and uppermost cam surfaces 102*b*, 102*c*; and the second cam surfaces 103 include respective lowermost cam surfaces 103*a*, respective intermediate cam surfaces 103*b*, and respective uppermost cam surfaces 103*c* all of which are horizontal; respective first inclined surfaces connecting between the lowermost and intermediate cam surfaces 103*a*, 103*b*; and respective second inclined surfaces connecting between the intermediate and uppermost cam surfaces 103*b*, 103*c*. As shown in FIGS. 10 and 15, the lowermost cam surfaces 102*a* of the first cam surfaces 102 and the lowermost cam surfaces 103*a* of the second cam surfaces 103 are near to each other; and the uppermost cam surfaces 102*c* of the first cam surfaces 102 and the uppermost cam surfaces 103*c* of the second cam surfaces 103 are remote from each other. As shown in FIG. 10, when the printing head 34 performs recording on the recording sheet P, respective upper surfaces of the two contact pins 78 contact the respective intermediate cam surfaces 102*b* of the first cam surfaces 102, and respective upper surfaces of the two contact pins 99 contact the respective intermediate cam surfaces 103*b* of the second cam surfaces 103.

Figure 19:
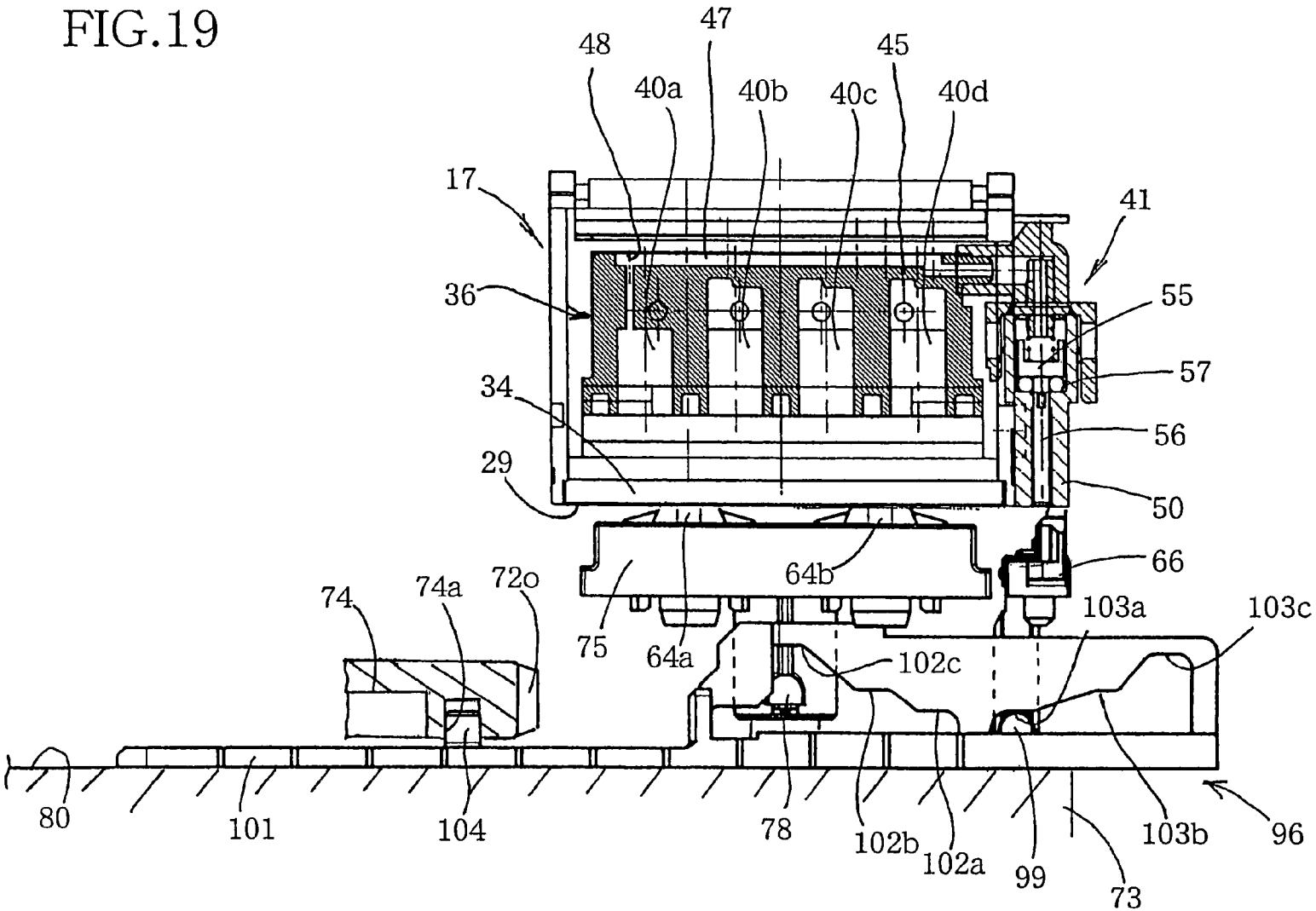
FIG. 19 is a side elevation view showing respective positions of the carriage, the translational cam, the recovering device, and the air-bubble removing device in a maintenance state.

In the recovering operation and a head keeping state shown in FIG. 19, the translational cam member 96 is moved in the direction "X2", owing to the cam groove 74*a* of the rotary cam member 74. As a result, the contact pins 78 are disengaged from the intermediate cam surfaces 102*b* and are engaged with the uppermost cam surfaces 102*c*, so that the support block 75 is moved upward owing to the biasing forces of the biasing springs 82. Thus, the respective upper surfaces of the two cap members 64*a*, 64*b* are held in pressed contact with the nozzle supporting surface 29 of the printing head 34. Concurrently, the respective upper surfaces of the contact pins 99 are brought into contact with the lowermost cam surfaces 103*a*, so that the elevator member 66 is moved downward to a lower end position thereof where the elevator member 66 is kept at such a height position that assures that an appropriate space is left between the respective upper ends of the release rods 62 and the lower surface of the cylinder block 50 of the bubble removing device 61.

Figure 20:
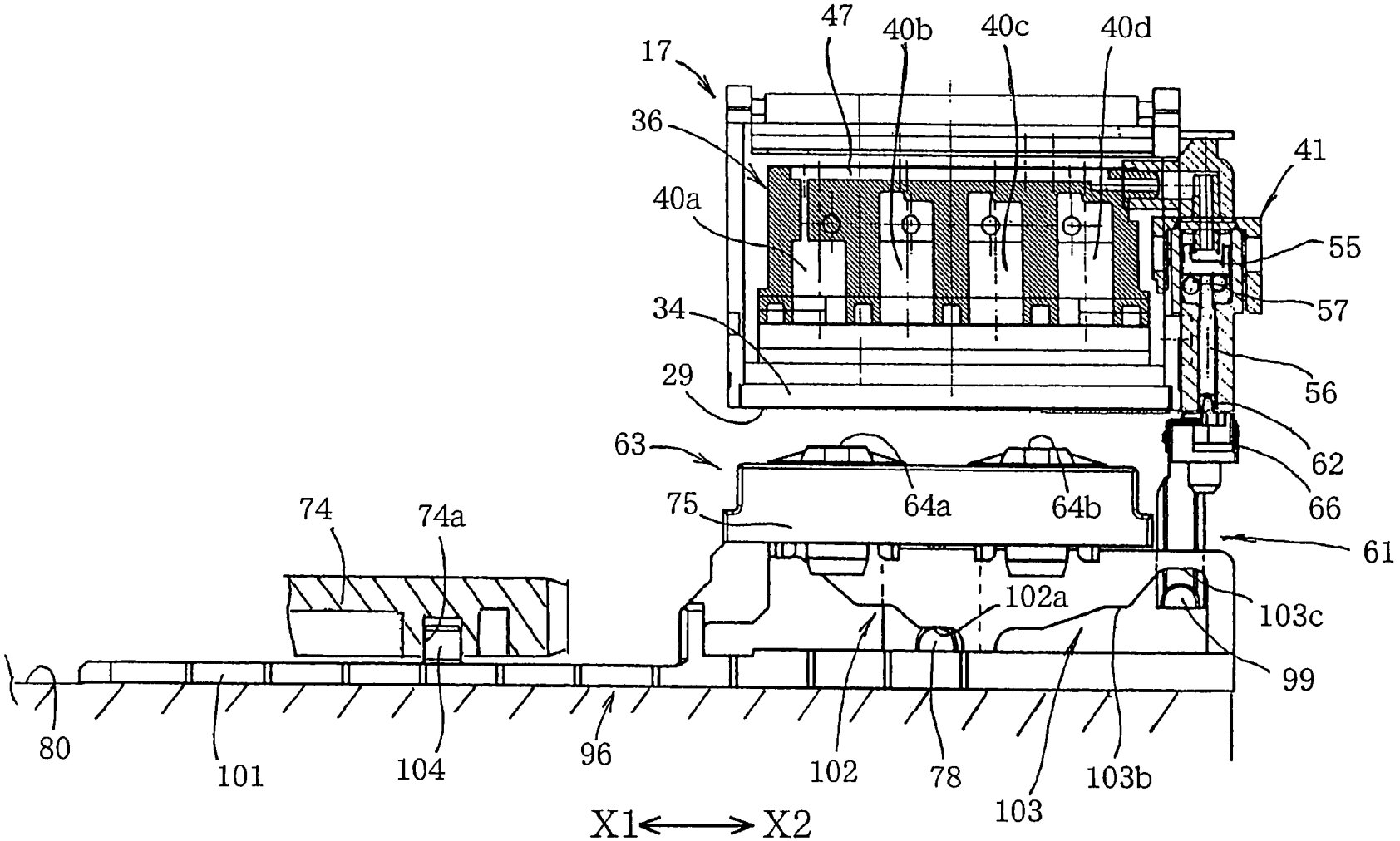
FIG. 20 is a side elevation view showing respective positions of the carriage, the translational cam, the recovering device, and the air-bubble removing device in an air removing state in which air is removed from the buffer tank.

Meanwhile, in the bubble removing (i.e., air discharging) operation shown in FIG. 20 in which air bubbles are removed from all the bubble collecting chambers 40*a* to 40*d*, the translational cam member 96 is moved in the direction "X1", owing to the cam groove 74*a* of the rotary cam member 74. As a result, the respective upper surfaces of the contact pins 78 are engaged with the lowermost cam surfaces 102*a*, so that the support block 75 is kept at a lower end position thereof where the respective upper surfaces of the two cam members 64*a*, 64*b* are the most distant from the nozzle supporting surface 29 of the printing head 34. Concurrently, the respective upper surfaces of the contact pins 99 are disengaged from the intermediate cam surfaces 103*b* and are engaged with the uppermost cam surfaces 103*c*, so that the elevator member 66 is moved upward owing to the biasing forces of the biasing springs 100. Consequently, the suction portions 90 of the elevator member 66 are held in close contact with the lower open ends of the small diameter holes 51*b*, respectively, and the release rods 62 push up the valve rods 56, respectively.

Thus, when the support block 75 is positioned, by the first cam surfaces 102, at its lower end position where the support block 75 receives the greatest biasing force of the biasing springs 82, the elevator member 66 is positioned, by the second cam surfaces 103, at its upper end position where the elevator member 66 receives the smallest biasing force of the biasing springs 100, and vice versa. Thus, the first and second cam surfaces 102, 103 are so formed as to move vertically the recovering device 63 and the bubble removing device 61 in opposite directions, respectively. Therefore, the first and second cam surfaces 102, 103 do not simultaneously receive the respective greatest forces of the springs 82 and the springs 100, and accordingly the cam portions 97 of the translational cam member 96 are not required to have an excessively high mechanical strength. Thus, the translational cam member 96 can be formed in a reduced size.

Next, there will be described a suction device 68, 69 that is connected, in parallel, to the bubble removing device 61 and the recovering device 63 and sucks ink from each of the two devices 61, 63. The suction device includes the suction pump 68, and the switch valve unit 69 as a suction switching valve. The suction device 68, 69 selectively performs either one of the action of sucking ink that is discharged with air bubbles from the bubble collecting chambers 40*a* to 40*d*, and the action of sucking ink from the nozzles 33 via the recovering device 63.

The suction pump 68 is a tube-type pump in which a negative pressure is produced by utilizing the change of volume of a flexible tube 105. One end (i.e., a discharge outlet) of the flexible tube 105 is connected to a waste ink collecting portion in which a waste liquid foam 111, described later, is provided; and the other end (i.e., a suction inlet) of the flexible tube 105 is connected to a discharge outlet 108 of the switch valve unit 69 via a connector 106 and a tube 107.

Figure 21A:
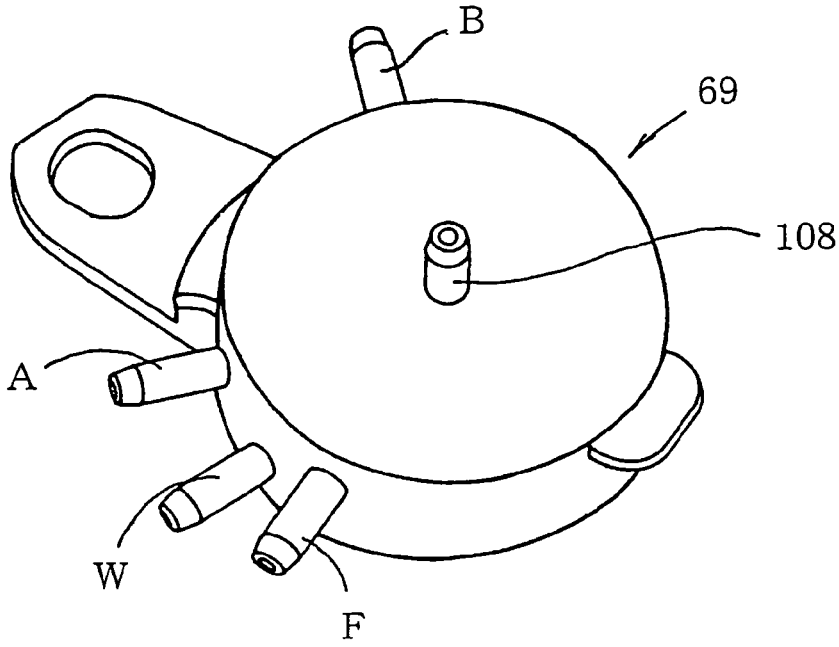
FIG. 21A is a perspective view of a switch valve unit of the ink jet printer.
Figure 21B:
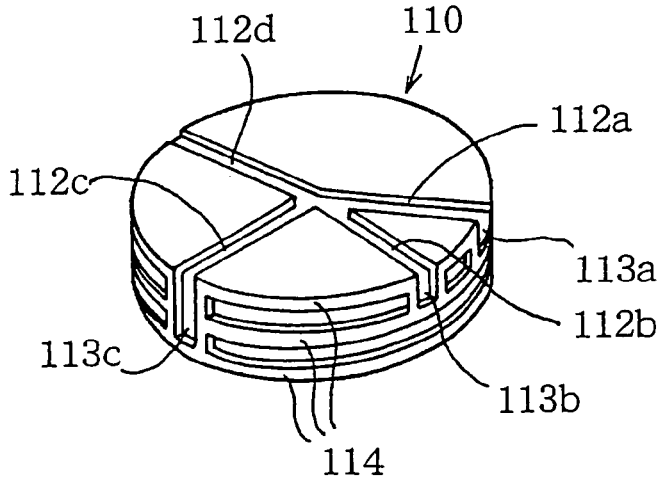
FIG. 21B is a perspective view of a switch member of the switch valve unit.
Figure 22:
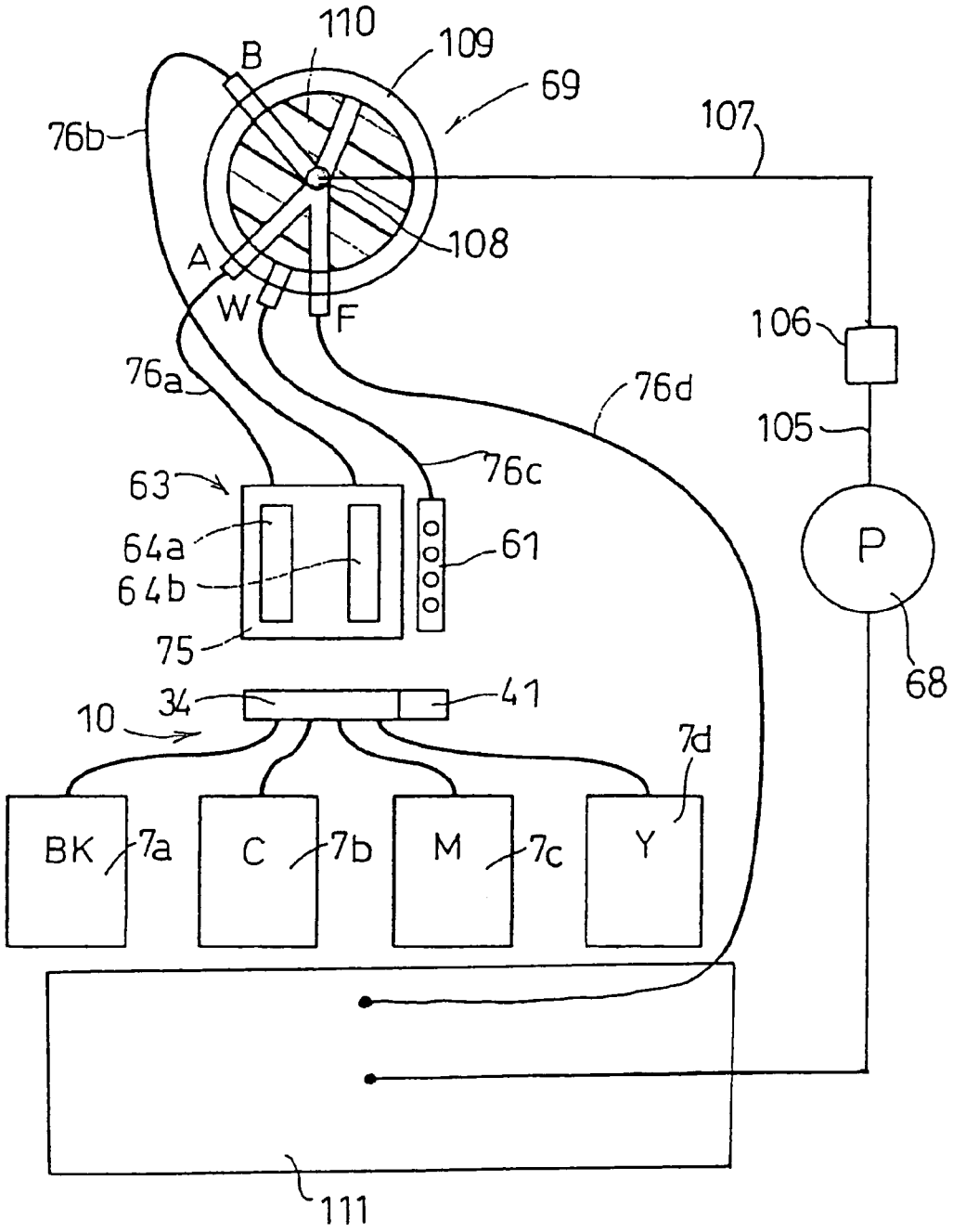
FIG. 22 is a diagrammatic view showing connections via tubes between the switch valve unit, the recovering device, and the air-bubble removing device.

As shown in FIGS. 21A, 21B, and 22, the switch valve unit 69 includes a cylindrical housing 109 that is formed of a synthetic resin; the switch member 110 that fits in the housing 109 such that the switch member 110 is rotatable relative to the housing 109; and a gear 72*r* that is rotatable about an axis member vertically projecting from the unit table 73 and rotates the switch member 110 relative to the housing 109. The housing 109 has, on an upper surface thereof, the above-described discharge outlet 108, and additionally has, on a side surface thereof, four ports A, B, W, F at respective predetermined angular phases. As previously described, the port A is connected via the tube 76*a* to the cap member 64*a*; and the port B is connected via the tube 76*b* to the cam member 64*b*. The port W is connected via a tube 76*c* to the outlet tube 93 of the bubble removing device 61. The port F is connected to a tube 76*d* that opens in the atmosphere. More specifically described, as shown in FIGS. 12 and 13, the tube 76*d* is long enough to hold some ink therein, and an intermediate portion of the tube 76*d* is bent by more than 180 degrees. An open end portion of the tube 76*d* is stuck into the thick, waste liquid foam 111 provided in the housing 2. Thus, when the MFC 1 as a whole is tilted or caused to fall and accordingly the inks present in the ink cartridges 7 are subjected to impacts, some inks may leak from the open end of the tube 76*d* because of the pressures produced in the inks. In this case, however, those inks are captured by the waste liquid foam 111. As shown in FIGS. 4 and 5, the waste liquid foam 111 is provided on a bottom wall 2*c* of the housing 2, such that the foam 111 is elongate in the direction in which the four ink cartridges 7*a* to 7*d* of the ink supplying portion 12 are arranged, i.e., in the widthwise direction of the housing 2. The open end of the tube 76*d* is stuck in a substantially lengthwise middle portion of the waste liquid foam 111, so that the water head difference of the open end of the tube 76*d* is minimized irrespective of whether the user tilts the housing 2 clockwise or counterclockwise. Thus, the amount of leakage of inks is minimized.

The cylindrical switch member 110 is provided by an elastic member formed of, e.g., rubber and has, in a circular top surface thereof, four top grooves 112*a*, 112*b*, 112*c*, 112*d* that extend in different radially outward directions. The discharge outlet 108 communicates with respective radially inner ends of the four top grooves 112*a* to 112*d*. Respective radially outer ends of the four top grooves 112*a* to 112*d* communicate with four side grooves 113*a*, 113*b*, 113*c*, 113*d*, respectively, that are formed in a side, cylindrical surface of the switch member 110. The side groove 113*c* is elongate downward and corresponds to the port W; and the side grooves 113*a*, 113*b*, 113*d* are short downward and correspond to the ports A, B, F, respectively. However, the side groove 113*c* additionally corresponds to the ports A, B, F. The switch member 110 has three ribs 114 that extend, on the side cylindrical surface of the member 110, in a circumferential direction of the same 110, such that the three ribs 114 define the side grooves 113*a* to 113*d*. When the switch member 110 is rotated to accumulate a negative pressure or supply the negative pressure, the ribs 114 can prevent the negative pressure from leaking through gaps that would otherwise be produced between the switch member 110 and the housing 109 because of deformation of those members 110, 109.

Figure 18:
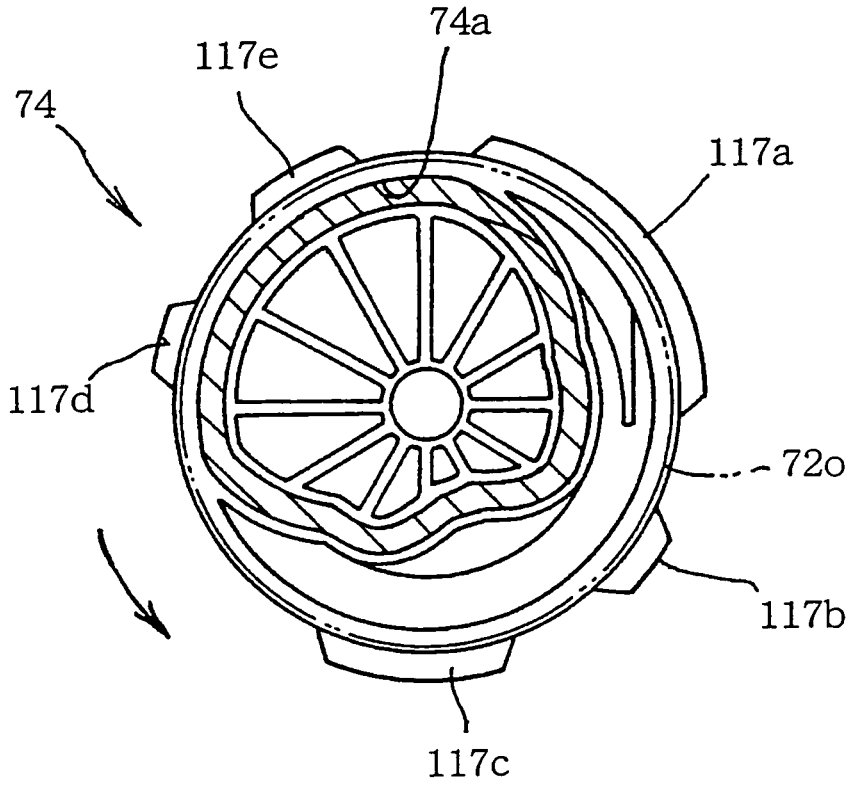
FIG. 18 is a view showing respective shapes of a cam groove and rib cams of a rotary cam as seen from above the cam.

As shown in FIGS. 10, 19, and 20, the rotary cam member 74 has, in the lower surface thereof, the endless cam groove 74*a* in which the pin 104 of the translational cam member 96 fits, as previously described. FIG. 18 shows an upper surface of the rotary cam member 74. The rotary cam member 74 has, on a side, cylindrical surface thereof, a cam, not shown, to move the wiper 65 upward and downward, and additionally has rib cams 117*a*, 117*b*, 117*c*, 117*d*, 117*e* each to contact a leaf switch 116 so that the leaf switch 116 detects a rotation position (i.e., phase) of the rotary cam member 74. The maintenance motor 71, the air pump 28, the carriage 17, the drive motor 18, etc. are controlled by a control device, not shown, that includes a CPU (central processing unit), a RAM (random access memory), and a ROM (read only memory) that stores various control programs used for controlling various operations, described later.

Next, there will be described the operation of the maintenance unit 11 by reference to FIGS. 23, 24, and 25. In FIG. 12, when the maintenance motor 71 is rotated backward, i.e., counterclockwise, the suction pump 68 is rotated clockwise in the figure, so as to apply a negative pressure to the discharge outlet 108 provided at the center of the top surface of the switch valve unit 69 and thereby make it possible to suck ink. In this state, the switch member 110 of the switch valve unit 69, and the rotary cam member 74 are not being rotated, i.e., still.

When the maintenance motor 71 is rotated forward, i.e., clockwise, the suction pump 68 is not rotated. However, in place of the suction pump 68, the switch member 110 of the switch valve unit 69 is rotated forward, i.e., clockwise, and the rotary cam member 74 is rotated counterclockwise. In the following explanation, all operations that can be performed as the rotary cam member 74 is rotated, are explained in an order corresponding to the rotation of the same 74. However, it is not required that all those operations be performed continuously as the rotary cam member 74 is rotated, but only a desired one or ones of the operations may be selected and performed as needed for the maintenance of the printing head unit 10.

Figure 23:
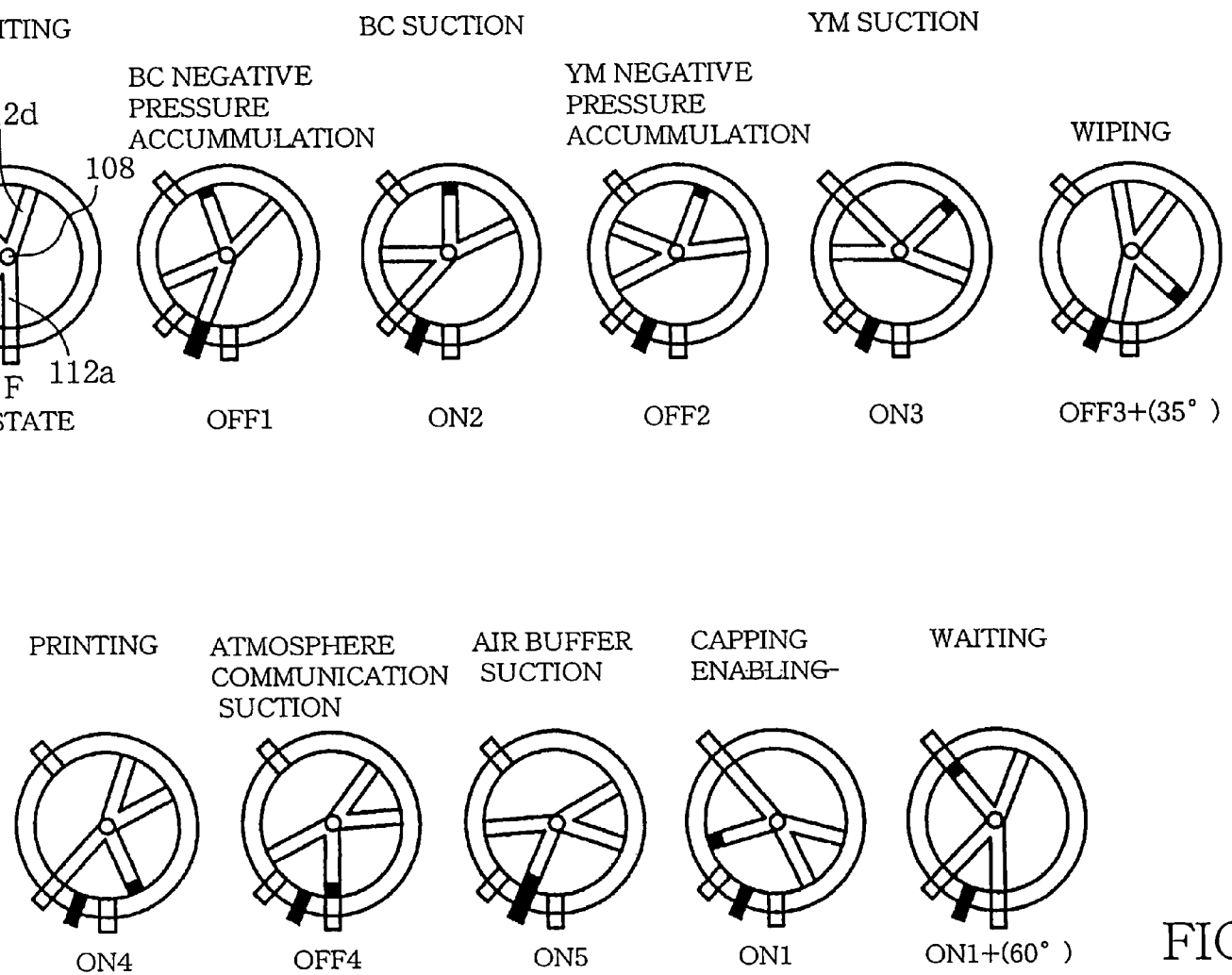
FIG. 23 is a view for explaining respective rotation phases of the switch member of the switch valve unit that correspond to respective operations of the maintenance unit.
Figure 24:
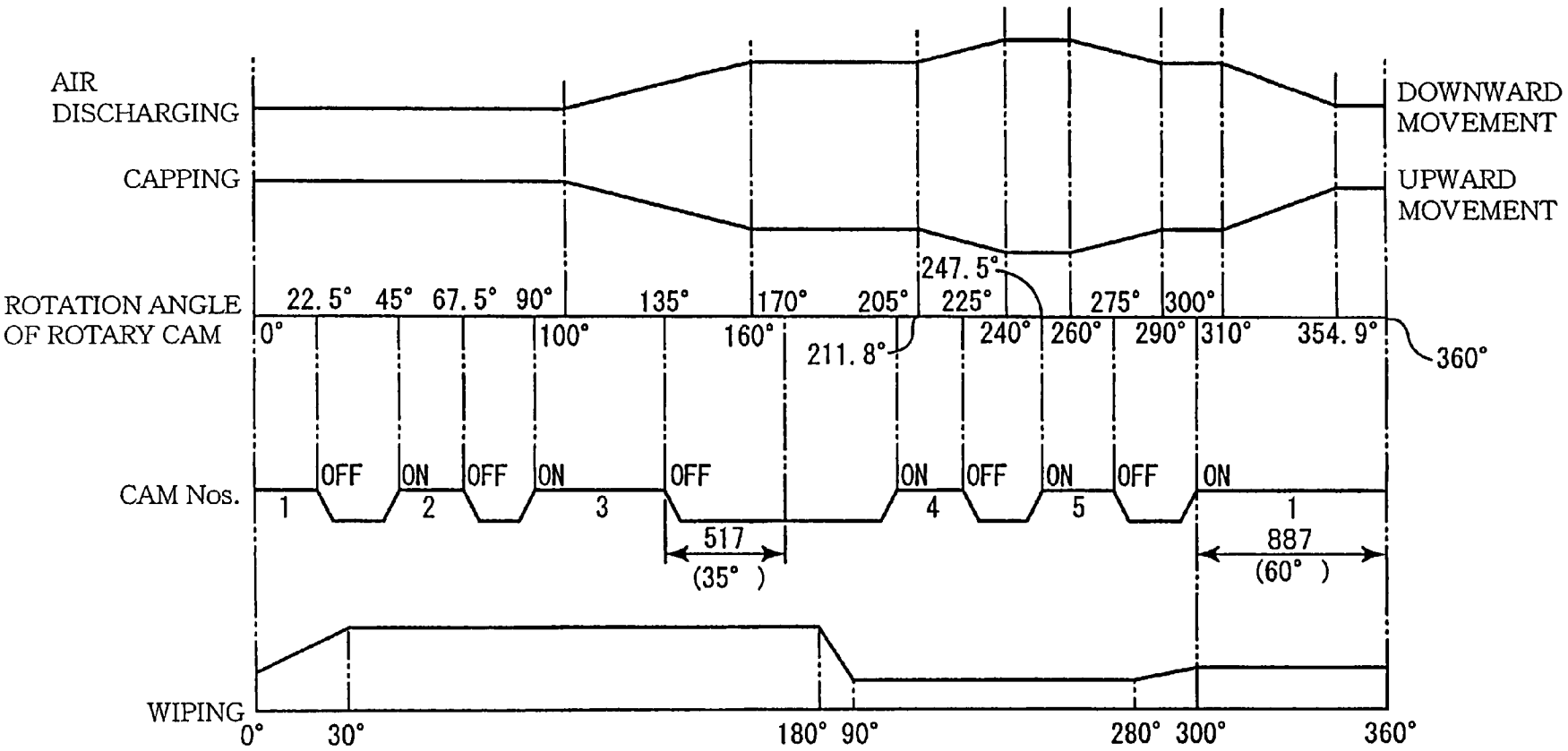
FIG. 24 is a time chart showing a relationship between respective angles of rotation of the rotary cam and the corresponding operations of the maintenance unit.
Figure 25:
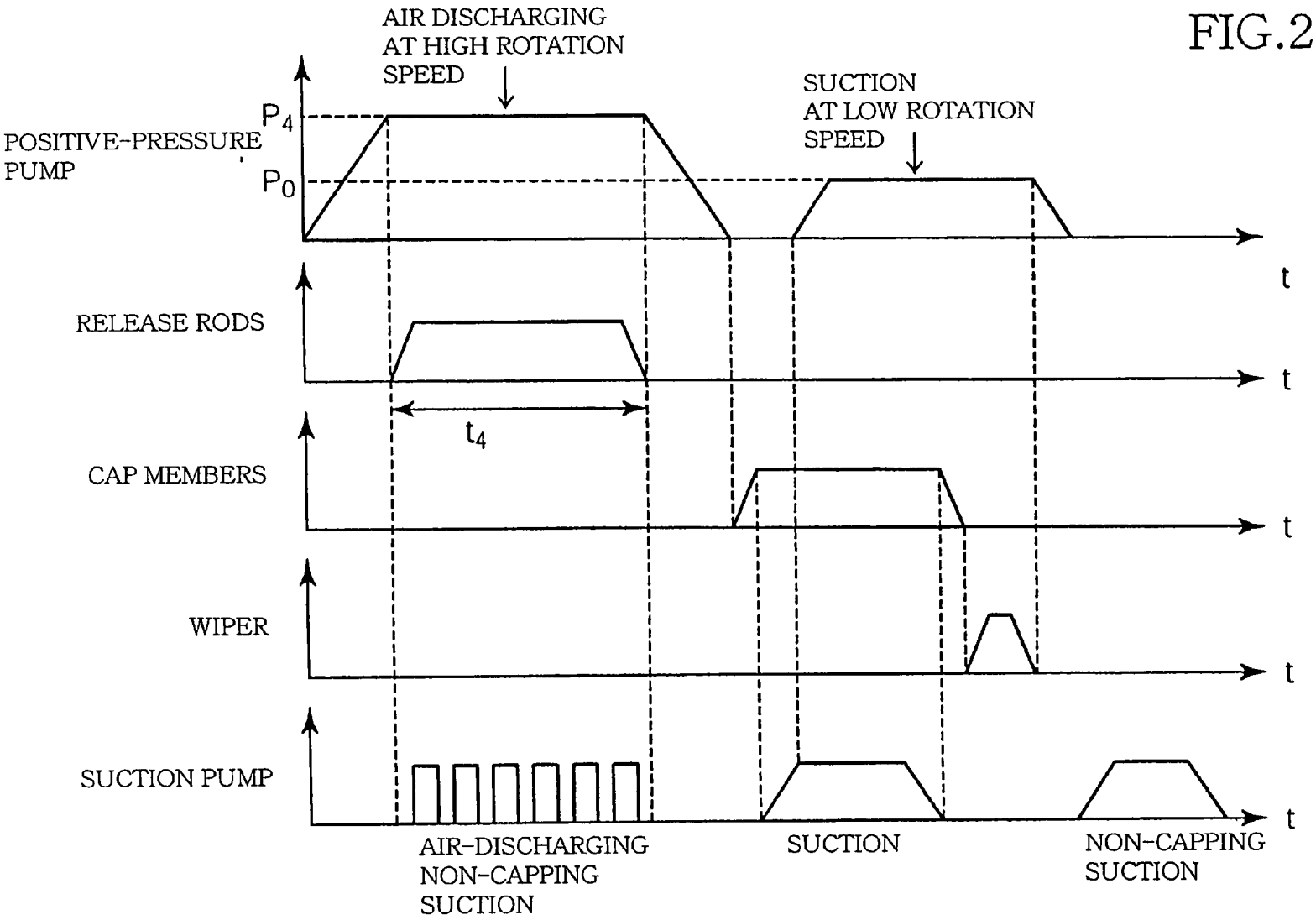
FIG. 25 is a time chart representing a relationship between respective operations of an air pump, a suction pump, release rods, and cap members, and time.

FIG. 23 shows, for each of the operations of the maintenance unit 11, a rotation position or phase of the switch member 110 in which the switch member 110 is in communication, or is not in communication, with each of the ports A, B, W, F; and FIG. 24 shows a timing chart representing a relationship between an air discharging operation (i.e., upward and downward movement of the elevator member 66 as a valve operating member or device), a capping operation (i.e., upward and downward movement of the support block 75 supporting the cap members 64*a*, 64*b* of the recovering device 63), and upward and downward movement of the wiper 65. In FIG. 24, a "high" position of Cam No. 1 of the rotary cam member 74 is indicated by "ON 1"; a "low" position of Cam No. 1 that follows the position "ON 1" is indicated by "OFF 1"; and "high" and "low" positions of other cam numbers, i.e., Nos. 2 to 5, are indicated in the same way.

When the control device is receiving no printing command in connection with the printing head 34, and when the control device is receiving no operating command in connection with the maintenance unit 11, the control device operates for moving the carriage 17 to the waiting position, i.e., the right-hand end position shown in FIG. 2. Before this, the rotary cam member 74 is so rotated that the leaf switch 116 steps down from the rib cam 117*e* (Cam No. 5) and steps up onto the rib cam 117*a* (Cam No. 1), as indicated at "ON 1" in FIG. 24, whereby the translational cam member 96 is moved to the position shown in FIG. 10 where the respective upper surfaces of the contact pins 78 are in contact with the intermediate cam surfaces 102*b* and the respective upper surfaces of the contact pins 99 are in contact with the intermediate cam surfaces 103*b*. In this state, the carriage 17 is moved to the waiting position at the right-hand end shown in FIG. 2 where the nozzle supporting surface 29 of the printing head 34 is opposed to the cap members 64*a*, 64*b*. Thus, an appropriate space is kept between the respective upper surfaces of the cap members 64*a*, 64*b* and the nozzle supporting surface 29 of the printing head 34. In addition, an appropriate small space is kept between the release rods 62 and the suction portions 90 of the elevator member 66 and the lower surface of the cylinder block 51 of the bubble removing device 61. In this state, the rotation position or phase of the switch member 110 of the switch valve unit 69 is a capping enabling position, shown in FIG. 23, in which the port B is in communication with the discharge outlet 108.

In the above-described state, the cap members 64*a*, 64*b* are brought into close contact with the nozzle supporting surface 29 of the printing head 34, so that the printing head 34 is placed in a head keeping state. To this end, the rotary cam member 74 is rotated forward so as to rotate the switch member 110 of the switch valve unit 69, by 60 degrees further from the position "ON 1" where the leaf switch 116 has just stepped up onto the rib cam 117*a* (Cam No. 1). In this state, the translational cam member 96 is moved in the direction X2 to the position thereof, shown in FIG. 19, where the contact pins 78 are disengaged from the intermediate cam surfaces 102*b* and are engaged with the uppermost cam surfaces 102*c*, so that the support block 75 is moved upward by the biasing springs 82. Consequently the respective upper surfaces of the cap members 64*a*, 64*b* are brought into close contact with the nozzle supporting surface 29 of the printing head 34. Concurrently the respective upper surfaces of the contact pins 99 are engaged with the lowermost cam surfaces 103*a*, so that the elevator member 66 is moved to the lower end position thereof, shown in FIG. 19.

In this head keeping state, the printing head 34 is in communication via the ports A, B with the discharge outlet 108, since the rotation position of the switch member 110 is a waiting position ("ON 1 STATE"), shown in FIG. 23. Although more or less ink always remains in the tube 76*d* connected to the port F of the switch valve unit 69, and the flexible tube 105 of the suction pump 68, the cap members 64*a*, 64*b* covering the nozzle supporting surface 29 prevent the nozzles 33 from drying up. In addition, since the port F is in communication with the atmosphere, the respective inner spaces of the cap members 64*a*, 64*b* are under substantially atmospheric pressure.

The position "ON 1+60°" distant by 60 degrees from the position "ON 1" can be reached by rotating the maintenance motor 71 in the form of, e.g., a stepper motor by a predetermined number of steps (e.g., 887 steps) from the position "ON 1".

When the control device is receiving a printing command in connection with the printing head 34, the control device operates for continuously rotating the maintenance motor 71 forward, so that the rotary cam member 74 is rotated to position "ON 4", shown in FIG. 4 (the description of a sucking operation, described later, is skipped), and the carriage 17 is moved from the waiting position where the spaces are left between the cap members 64*a*, 64*b* and the nozzle supporting surface 29 and between the elevator member 66 and the cylinder block 51, in the leftward direction shown in FIG. 2, toward a printing position.

When the control device is receiving a recovering command in a state in which the printing head 34 is not being positioned at the waiting position, the control device first operates for rotating the maintenance motor 71 forward to rotate the rotary cam member 74 to the position where the switch 116 has just stepped up onto the position "ON 1", and subsequently operates for moving the printing head 34 to the waiting position. In this state, the control device operates for rotating the maintenance motor 71 forward so that the cap members 64*a*, 64*b* are brought into close contact with the printing head 34 like in the head keeping state. Furthermore, the rotary cam member 74 is rotated so that the leaf switch 116 steps from the rib cam 117*a* down to a position, "OFF 1". Simultaneously, the switch member 110 of the switch valve unit 69 is rotated to a BC negative pressure accumulating position, shown in FIG. 23, where none of the ports A, B, W, F is in communication with the atmosphere or an outside space. In this state, the maintenance motor 71 is rotated backward to operate the suction pump 68 (see FIG. 25). Thus, a negative pressure to suck the black (B) and cyan (C) inks from the cap member 64*a* is temporarily accumulated in the tube 107. Subsequently, the maintenance motor 71 is rotated forward so that the leaf switch 116 steps up onto the rib cam 117*b* (Cam No. 2), i.e., a position, "ON 2", where the port A is brought into communication with the groove 112*a*. Thus, the black and cyan inks are sucked from the nozzles 33*a*, 33*b* through the cap member 64*a* by the accumulated negative pressure. This position is a BC sucking position shown in FIG. 23. A short time after the commencement of operation of the suction pump 68, the air pump (i.e., the positive pressure pump) 28 is operated so as to apply respective positive pressure to the inks present in the buffer tank 36 via the ink cartridges 7.

Next, when the rotary cam member 74 is rotated to a position "OFF 2" where the leaf switch 116 has just come down from the rib cam 117*b* (Cam No. 2), the switch member 110 of the switch valve unit 69 is rotated to a YM negative pressure accumulating position, shown in FIG. 23, where none of the ports A, B, W, F is in communication with the atmosphere or the outside space. In this state, the maintenance motor 71 is rotated backward as described above to operate the suction pump 68 and thereby accumulate a negative pressure to suck the magenta (M) and yellow (Y) inks. Subsequently, the maintenance motor 71 is rotated forward so that the leaf switch 116 steps up onto the rib cam 117*c* (Cam No. 3), i.e., a position "ON 3" shown in FIG. 24, whereby the port B is brought into communication with the groove 112*b*, and the magenta and yellow inks are sucked from the nozzles 33*c*, 33*d* through the cap member 64*b*. This position is a YM sucking position shown in FIG. 23. In this state, the air pump 28 is operated so as to apply respective positive pressure to the inks present in the buffer tank 36 via the ink cartridges 7.

In the case where a recovering operation is performed for only one combination out of the first combination of black and cyan inks and the second combination of magenta and yellow inks, the maintenance motor 71 is just rotated forward, at the cam number corresponding to the other combination, without being rotated backward, i.e., without operating the suction pump 68.

After these ink sucking operations are finished, the rotary cam member 74 is rotated counterclockwise so as to move the translational cam member 96 in the direction X1, back to the position thereof shown in FIG. 10. Thus, the support block 75 is moved downward so that the cap members 64*a*, 64*b* are moved away from the nozzle supporting surface 29.

The operation of the air pump 28 is continued till the cap members 64*a*, 64*b* moves away from the nozzle supporting surface 29. When the ink sucking operations are finished, the inks present in the cap members 64*a*, 64*b* are bubbling and those bubbles may enter the nozzles 33 because of the back pressure acting on the inks. To avoid this problem, the operation of the air pump 28 is continued to apply the positive pressure to the inks in the nozzles 33 and thereby prevent the bubbles from entering the nozzles 33. It is not essentially required that the respective operations of the air pump 28 and the suction pump 68 be concurrently performed. For example, the air pump 28 may be operated in only a time duration around the time when the cap members 64*a*, 64*b* move away from the nozzle supporting surface 29 after the stopping of operation of the suction pump 68. The positive pressure applied by the air pump 28 to the inks in the nozzles 33 is selected at a value which assures that the inks do not leak out of the nozzles 33.

When the carriage 17 starts moving for the next, wiping operation using the wiper 65, the rotary cam member 74 has been rotated to a position where the respective contact pins 78, 99 corresponding to the cap members 64*a*, 64*b* and the elevator member 66, respectively, contact the intermediate cam surfaces 102*b*, 103*b*, respectively, as shown in FIG. 10.

When the rotary cam member 74 is rotated by 35 degrees from a position where the leaf switch 116 steps down from the rib cam 117*b* (Cam No. 3), the switch member 110 of the switch valve unit 69 is rotated to a wiping position ("OFF 3+35°"), shown in FIG. 23, where none of the ports A, B, W, F, the switch member 110 is in communication with the atmosphere or the outside space. The wiper 65 has already been moved up at the position "OFF 1", and kept at an upper end position thereof where the wiper 65 projects into a locus of movement of the nozzle supporting surface 29. In this state, when the carriage 17 is moved in the leftward direction in FIG. 2, the wiper 65 is caused to contact the nozzle supporting surface 29 and thereby and wipe off the ink adhered to the surface 29.

Subsequently, the carriage 17 is moved to a position where the printing head 34 is not opposed to the cap member 64*a*, for example, a left-hand end position thereof where the head 34 is opposed to the ink collecting portion 8, while the maintenance motor 71 is continuously rotated to rotate continuously the rotary cam member 74 counterclockwise, so that the cam member 74 is stopped again at the position "ON 2". In this state, the motor 71 is rotated backward to operate the suction pump 68. This means a so-called non-capping sucking operation (see a time duration of NON-CAPPING SUCTION, shown in FIG. 25). Thus, the inks remaining in the cap member 64*a* can be removed. In addition, the rotary cam member 74 is stopped again at the position "ON 3", so that the inks remaining in the cap member 64*b* can also be removed.

After the non-capping sucking operation, the rotary cam member 74 is stopped at the position "OFF 4", and the switch member 110 of the switch valve unit 69 is rotated so that the groove 113*c* communicates with the port F. This is an atmosphere communication suction position, shown in FIG. 23. Thus, in the state in which the tube 76*d* open to the atmosphere is in communication with the suction pump 68, the maintenance motor 71 is rotated backward to operate the suction pump 68 and thereby suck the inks remaining in the switch valve unit 69, etc.

Then, the carriage 17 now at the left-hand end position in FIG. 2 is moved to carry out the printing operation.

Figure 9:
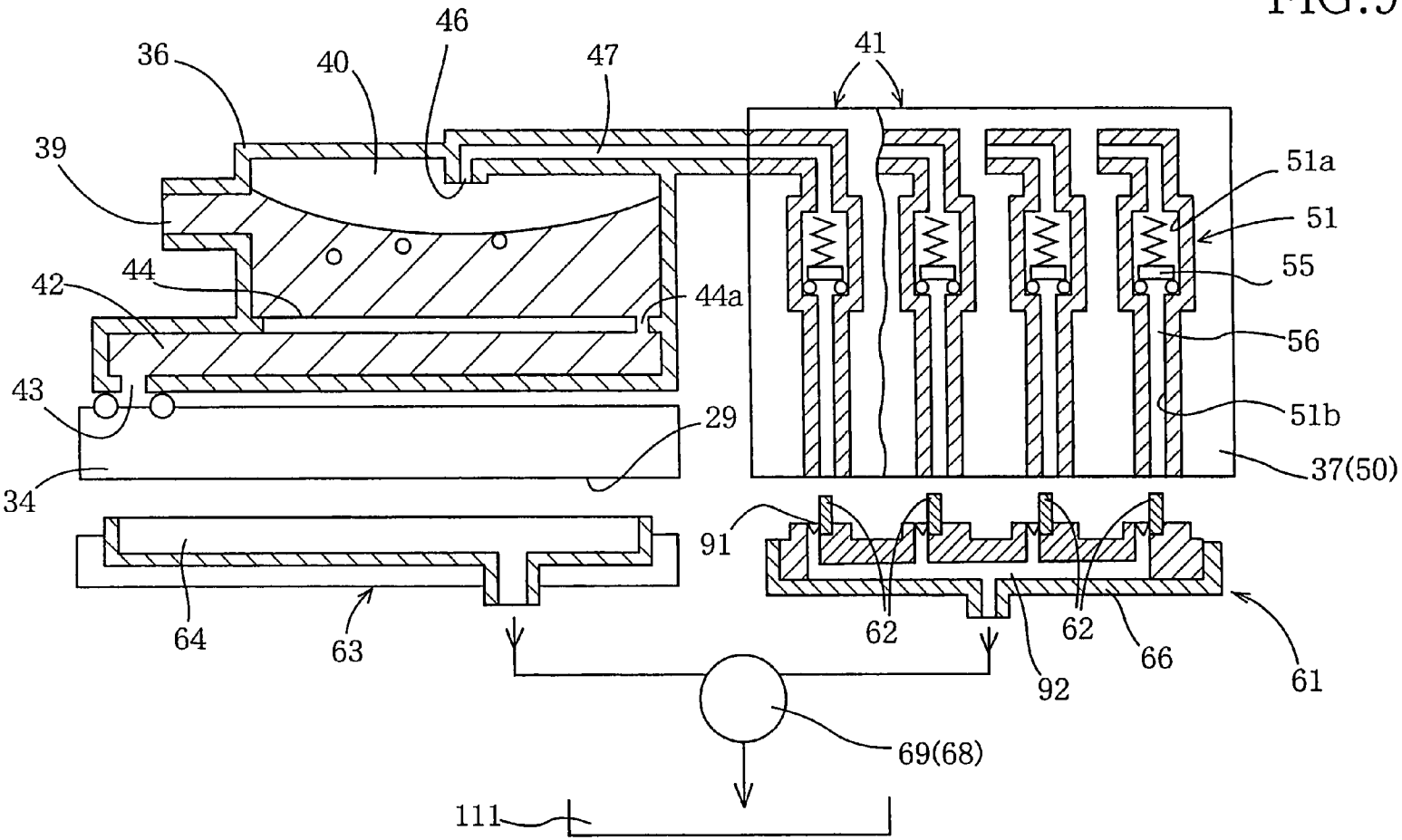
FIG. 9 is a diagrammatic, cross-section view of an air-bubble removing device which removes air bubbles from air-bubble collecting chambers, i.e., air buffer chambers.

When the control device is receiving a command to remove the bubbles (i.e., air) from the bubble collecting chambers 40*a* to 40*d*, in the state in which the carriage 17 is not being positioned at the right-hand end position, i.e., the waiting position, the control device first operates for rotating the maintenance motor 71 forward to rotate the rotary cam member 74 to the position where the switch 116 has just stepped up onto the position "ON 1", as described above, and subsequently operates for moving the carriage 17 to the waiting position. In this state, the control device operates for continuously rotating the maintenance motor 71 forward so that the rotary cam member 74 is continuously rotated to a position "ON 5". Before the cam member 74 reaches the position "ON 5", i.e., while the cam member 74 is rotated from the position "ON 4" to the position "OFF 4", the translational cam member 96 is moved in the direction X1. With this movement, the contact pins 78 are moved from the intermediate cam surfaces 102*b* to the lowermost cam surfaces 102*a*, so that the support block 75 is moved down to the lower end position thereof and the contact pins 99 are moved from the intermediate cam surfaces 103*b* to the uppermost cam surfaces 103*c*, so that the elevator member 66 is moved up by the biasing springs 100. Consequently all the release rods 62 of the elevator element 66 push all the valve rods 56, the valve members 55, and the packing members 57, upward, so as to open all the valves. In addition, the suction portions 90 are brought into close with the respective lower open ends of the small diameter passages 51*b*, so that all the bubble collecting chambers 40*a* to 40*d* communicate with the port W of the switch valve unit 69 via the air-discharge passages 47*a* to 47*d*, the outlet portions 54, the communication tubes 52, and the communication holes 51, the suction portions 90, the internal passage 92, the discharge cylinder 93, and the tube 76*c*, as shown in FIGS. 20 and 9. The air pump 28 starts its operation at the position "ON 4" where the elevator member 66 starts its upward movement, applies the positive pressure to the inks present in the ink cartridges 7*a* to 7*d*, and increases the respective pressures in the bubble connecting chambers 40*a* to 40*d* via the ink needles 26 and the ink passages 27*a* to 27*d*. Since, however, the port W of the switch valve unit 69 is closed at the position "OFF 4", no air bubbles are discharged.

In the state in which the rotary cam member 74 is positioned at the position "ON 5", the switch valve 110 of the switch valve unit 69 is positioned at a buffer sucking position, shown in FIG. 23, where the port W is in communication with the groove 112*c*. In this state, the positive pressure applied by the air pump 28 acts on the inks in the buffer tank 36 via the ink cartridges 7*a* to 7*d*, the ink needles 26, and the ink passages 27*a* to 27*d*, and accordingly raises the level of upper surface of the ink present in each of the bubble collecting chambers 40*a* to 40*d*. Therefore, the bubbles (i.e., air) collected in the respective upper portions of the bubble collecting chambers 40*a* to 40*d* are conveyed via the communication holes 51 (more specifically, the small diameter portions 51*b*) and are discharged from the lower surface of the cylinder block 50 into the atmosphere. To this end, the drive motor 30 is rotated at a higher speed than the speed at which the pump 28 is operated to perform the ink sucking operation, so as to increase the positive pressure produced by the air pump 28. However, the positive pressure applied by the air pump 28 is selected at such a value which assures that the inks do not leak from the nozzles 33.

When the air bubbles are discharged in this way, a small amounts of inks are discharged with those bubbles. To suck those inks, the maintenance motor 71 is rotated backward and intermittently for a predetermined time duration, so that the suction pump 68 is intermittently operated a plurality of times. This is a bubble-discharging-related non-capping suction, shown in FIG. 25. Thus, the small amounts of inks sucked with the air bubbles can be discharged into the waste liquid foam 111 via the dish-like suction portions 90, the suction inlets 91 around the base ends of the release rods 62, the internal passage 92, the discharge cylinder 93, the tube 76*c*, the port W, and the suction pump 68. The reason why the suction pump 68 is intermittently driven is that the amounts of inks discharged with the air bubbles are smaller than the amounts of inks sucked during the above described non-capping suction and thus, continuous suction of inks is not needed. In this case, the time duration, t4, (FIG. 25) in which the air pump 25 is operated may be changed depending upon an ambient temperature, and the frequency at which the suction pump 68 is intermittently rotated may be changed depending upon the time duration t4, or alternatively those duration and frequency may be pre-set at respective constant values.

Subsequently, the rotary cam member 74 is rotated from the position "OFF 1" to the position "ON 3" so as to perform another suction-using recovering operation, move the carriage 17, and perform the wiper-using wiping operation. Moreover, the cam member 74 is rotated to the position "ON 2" to perform a non-capping sucking operation and thereby suck the inks remaining in the switch valve unit 69. However, the suction-using recovering operation following the bubble removing operation may be omitted.

In the first embodiment, the air bubble removing device 61 is not provided on the carriage 17. Therefore, the carriage 17 can be reciprocated at a higher speed. However, the air bubble removing device 61 and the air-discharging device 41 may be replaced by a solenoid-operated valve and a solenoid which opens and closes the solenoid-operated valve and functions as the air bubble removing device. In this case, the air bubble removing device may be mounted on the carriage 17.

In the first embodiment, the air bubble removing device 61 is connected to the suction device 68, 69. Therefore, if the ink is discharged in mixture with the air bubbles, or even in case the ink leaks, the suction device 68, 69 can suck the ink and prevent the ink jet printer 5 from being polluted with the ink.

In the first embodiment, the air bubble removing device 61 and the recovering device 63 are connected in parallel to the suction device 68, 69, and the suction device 68, 69 selectively cooperates with one of the air bubble removing device 61 and the recovering device 63 to suck the ink. Therefore, the single suction device 68, 69 suffices and accordingly the present ink jet printer 5 can enjoy a compact structure.

In the first embodiment, in the recovering operation in which the great amount of ink needs to be sucked, the suction pump 68 is operated continuously to suck quickly the ink; and in the air bubble removing operation, the suction pump 68 is operated intermittently so as not to suck the great amount of ink with the air bubbles from the air bubble collecting chamber 40. Thus, the amount of loss of ink can be minimized.

In the first embodiment, the recovering device 63 is provided adjacent the air bubble removing device 61, the air-discharging device 41 can be provided, on the carriage 17, adjacent to the printing head 34, such that the valve device 41 and the printing head 34 correspond to the air bubble removing device 61 and the recovering device 63, respectively. In addition, since the recovering device 63 comprises the cap member 64 which is movable to contact, and separate from, the nozzle supporting surface 29 of the printing head 34, the recovering device 63 can reliably suck the ink from the nozzle 33.

In the first embodiment, the single motion converting device 67 can perform various operations and accordingly a maintenance portion including the air bubble removing device 61, the suction device 68, 69, and the recovering device 63 can enjoy a compact structure.

In the first embodiment, since the air bubble removing device 61 and the carriage 17 is positioned relative to each other by the positioning device 94, 95, the valve operating member 62 can reliably operate, i.e., open and close the air-discharging device 41.

In the first embodiment, the air-discharging device 41 includes the valve member 55 which is biased in the valve closing direction, and the valve rod 56 which linearly moves the valve member 55 in the valve opening direction, and the valve operating member includes the release rod 62 which pushes the valve rod 56 in the opening direction to open the valve member 55. Therefore, the release rod 62 of the air bubble removing device 61 can be linearly moved in the same direction as the direction in which the first and second portions 94, 95 of the positioning device are moved relative to each other. In addition, since the single motion converting device 67 can selectively perform one of (a) moving the cap member 64 of the recovering device 63 toward the nozzle supporting surface 29 of the printing head 34, and moving the release rod 62 of the air bubble removing device 61 to close the air-discharging device 41 and (b) moving the cap member 64 away from the nozzle supporting surface 29 and moving the release rod 62 to open the air-discharging device 41, the motion converting device 67 can be operated to produce a linear motion.

In the first embodiment, the translational cam 96 are linearly moved in directions which intersect the first movement directions in which the recovering device 63 is moved toward, and away from, the nozzle supporting surface 29 of the printing head 34, and additionally intersect the second movement directions in which the air bubble removing device 61 is moved toward, and away from, the air-discharging device 41, and which are parallel to, e.g., the first reciprocation directions in which the carriage 17 is reciprocated.

In the first embodiment, since the ink can be sucked in the gravitational direction by the suction device 68, 69, the ink that is discharged or leaks can easily be sucked.

In the first embodiment, respective linear movements of the air bubble removing device 61 and the recovering device 63 can easily be done by the cooperation of the cam surfaces 102, 103 and the cam followers 78, 99.

In the first embodiment, the operation of the air bubble removing device 61 or the operation of the recovering device 63 can easily be selected and done.

In the first embodiment, even if the posture of the ink jet printer 5 may be changed by, e.g., being tilted laterally, the amount of ink that is discharged from the ink discharging tube 76*d* into the housing 2 can be minimized.

In the first embodiment, the valve operating member 62 is provided in the vicinity of a predetermined position (e.g., the head waiting position) on the path of movement of the carriage 17, so that, only when the carriage 17 is kept still at the predetermined position, the valve operating member 62 can open the air-discharging device 41. Thus, the air bubbles (or air) present in the air bubble collecting chamber 40 can efficiently be discharged into an outside space via the air-discharge passage 47.

In the first embodiment, the appropriate amount of air which cannot be discharged via the air bubble collecting chamber 40 is always left in the upper portion of the collecting chamber 40. Therefore, even if the pressure of the ink in the collecting chamber 40 may be changed when the carriage 17 is reciprocated, the change of the pressure can be absorbed by the amount of air left in the upper portion of the collecting chamber 40.

In the first embodiment, the air-discharge passage 47 is defined by the groove formed in the upper wall 45 of the buffer tank 36 and the membrane member 48. Therefore, the air buffer discharging passage 47 can easily be formed to have the small cross section area.

In the first embodiment, the plurality of air-discharge passages 47 for discharging the air bubbles (or air) from the plurality of air bubble collecting chambers 40 corresponding to the plurality of color inks, respectively, exhibit the substantially same resistance to flow of air therethrough. Therefore, the respective operations of discharging the air bubbles from the plurality of air bubble collecting chambers 40 can be finished at the substantially same time.

In the first embodiment, the air-discharging device 41 may be provided in the vicinity of one side surface of the carriage 17. Thus, the respective other ends of the air-discharge passages 47 that are opposite to the respective one ends thereof communicating with the air bubble connecting chambers, respectively, can easily be connected to the air-discharging device 41.

In the first embodiment, the direction in which the ink is sucked from the nozzle 33 to remove the clogs of ink from the nozzle 33 is parallel to the direction in which the air bubbles are discharged from the valve hole 51 connected to the air bubble collecting chamber 40 via the air-discharge passage 47, that is, the gravitational direction. Therefore, the air discharging operation and the ink sucking operation can advantageously be done in the same direction.

In the first embodiment, if the lower end of the valve rod 56 is just pushed into the open end of the valve hole 51, the valve member 55 can be moved in the valve opening direction relative to the valve hole 51. Thus, the air-discharging device 41 can easily be operated, i.e., opened and closed.

In the first embodiment, at least the respective portions of the air buffer chambers 40 are arranged substantially in the first direction in which the carriage 17 is moved, and the respective other ends of the air-discharge passages 47 are arranged in the second direction perpendicular to the first direction. Therefore, respective distances between the respective one ends, and the respective other ends, of the air-discharge passages 47, i.e., respective lengths of respective straight lines connecting between the respective one ends, and the respective other ends, of the discharging passages 47 differ from each other. Therefore, one or more of the discharging passages 47 that has or have a shorter distance between the one end or ends thereof and the other end or ends thereof than those of the other discharging passages 47 is or are elongated, and spread out, so that all the discharging passages 47 have a substantially same length between the respective one ends thereof and the respective other ends thereof and accordingly have the substantially same air-flow resistance. Therefore, the air bubbles can be discharged from all the air buffer chambers 40 at the substantially same amount of flow of air. Thus, the respective operations of discharging the air bubbles from the air buffer chambers 40 can concurrently be done with high efficiency.

In the first embodiment, since at least the respective portions of the air-discharge passages 47 are formed along one wall of the buffer tank 36, the discharging passages 47 can be provided in a reduced space. In addition, since at least the respective portions of the air-discharge passages 47 are formed by being curved, the respective lengths of the discharging passages 47 can easily be adjusted.

Next, there will be described a second embodiment of the present invention by reference to FIGS. 27 to 32, 33A, 33B, 34A, 34B, 34C, 35, and 36. The second embodiment relates to an ink jet printer 200.

In the above-described first embodiment, the air-bubble discharging passages 47 (47*a*-47*d*) which discharge the air (i.e., the air bubbles) from the air-bubble collecting chambers or air buffer chambers 40 (40*a*-40*d*), respectively, are so formed as to have a substantially same length and a substantially same cross-section area, so that those passages 47*a*-47*d* have a substantially same resistance to flow of air therethrough. On the other hand, in the second embodiment, for the same purpose, air-bubble discharging passages 251 (251*a*-251*d*, FIG. 36) are so formed as to have respective different cross-section areas corresponding to respective different lengths thereof.

Figure 27:
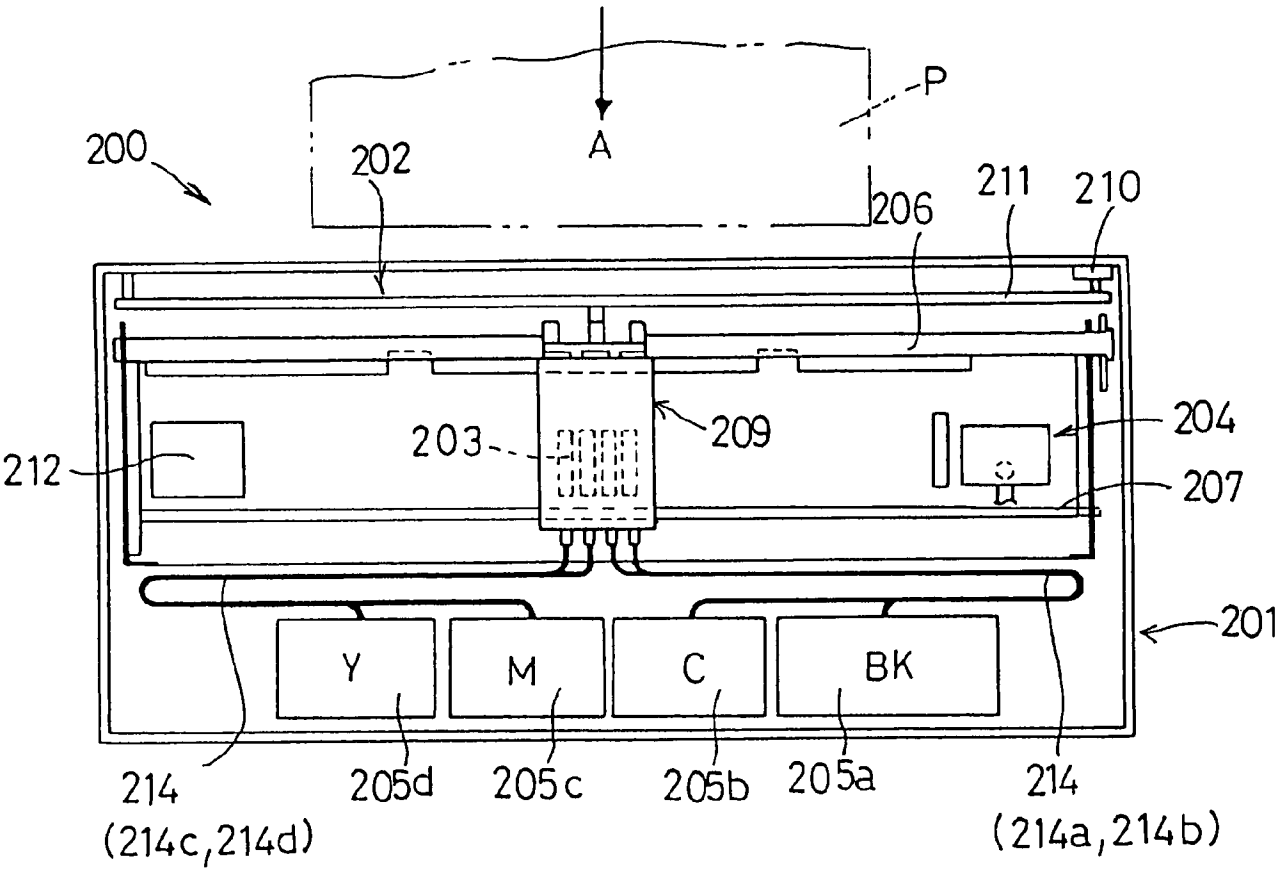
FIG. 27 is a plan view of a recording portion of another ink jet printer as a second embodiment of the present invention.

As shown in FIG. 27, the ink jet printer 200 includes a recording portion 202, a maintenance unit 204, four ink tanks 205 (205*a*-205*d*), etc. The recording portion 202 is incorporated in a frame member 201, and includes a printing head unit 203 that ejects a droplet of ink toward a recording paper P as a recording medium to record an image (e.g., a character, a symbol, etc.) thereon. The maintenance unit 204 performs maintenance of the printing head unit 203 of the recording portion 202. The four ink tanks 205 are fixed to the frame member 201, and store respective different color inks to be supplied to the printing head unit 203.

The four ink tanks 205*a*, 205*b*, 205*c*, 205*d* store, for recording a full-color image on the sheet P, a black ink (BK), a cyan ink (C), a magenta (M) ink, and a yellow ink (Y), respectively. When the ink stored in each of the ink tanks 205 is used out, a user can replace the each ink tank 205 with a new one.

In the recording portion 202, a rear guide bar 206 and a front guide bar 207 are provided in the frame member 201, such that the two guide bars 206, 207 are parallel to each other and each elongate in a lengthwise direction of the frame member 201; and a carriage 209 is placed on the two guide bars 206, 207, such that the carriage 209 is freely movable relative the same 206, 207. The printing head unit 203 is integrally attached to the carriage 209 and is thus mounted on the same 209.

A carriage drive motor 210, provided in a rear and right corner of the frame member 201, and an endless, timing belt 211 cooperate with each other to reciprocate the carriage 209 on the front and rear guide bars 207, 206, in the lengthwise direction of the frame member 201. A well-known sheet feeding device, not shown, feeds the sheet P such that the paper P passes in a horizontal posture under a lower surface of the printing head unit 203, in a direction, indicated at A in FIG. 27, that is perpendicular to the directions in which the carriage 209 is reciprocated.

At an ink flushing position in one of opposite side areas outside the width of the sheet P being fed (i.e., the left-hand side area in FIG. 27), an ink collecting portion 212 is provided; and, at a head waiting position in the other side area, the maintenance unit 204 is provided. Thus, during a recording operation of the ink jet printer 200, the printing head unit 203 is periodically moved to the ink flushing position where the head unit 203 ejects ink to prevent clogging of nozzles 222 (222*a*-222*d*, FIG. 28), and the ink collecting portion 8 collects the thus ejected ink. At the head waiting position, the maintenance unit 204 performs a cleaning operation to clean a nozzle supporting surface of the head unit 203 that supports the nozzles 222. In addition, the maintenance unit 204 performs a recovering operation to suck the color inks, and a removing operation to remove air bubbles (i.e., air) from a buffer tank 213, described later.

As shown in FIG. 27, at a height position lower than the nozzle supporting surface (i.e., the lower surface) of the printing head unit 203, each of the four ink tanks 205*a*-25*d* can be inserted, in a direction from the front side to the rear side, in a corresponding one of four tank accommodating portions. In FIG. 27, the black ink (BK) tank 205*a*, the cyan ink (C) tank 205*b*, the magenta ink (M) tank 205*c*, and the yellow ink (Y) tank 205*d* are provided such that those ink tanks 205 extend parallel to each other, each take a horizontal posture, and are arranged in an array in the order of description in a direction from the left-hand side, to the right-hand side.

Each of the four tank accommodating portions has an ink supply hollow needle, not shown, that projects horizontally from a rear wall thereof, in a frontward direction opposite to the direction in which a corresponding one of the four ink tanks 205*a*-205*d* is inserted. Respective base end portions of the four hollow needles are connected to the printing head unit 203 via respective flexible ink passages 214 (214*a*, 214*b*, 214*c*, 214*d*). Respective intermediate portions of the black ink passage 214*a* and the cyan ink passage 214*b* are superposed on each other and are bound together; and respective intermediate portions of the magenta ink passage 214*c* and the yellow ink passage 214*d* are superposed on each other and are bound together.

Next, the printing head unit 203 mounted on the carriage 209 will be described by reference to FIGS. 28 and 29. In the second embodiment, the full color image printing head unit 203 includes a head holder 220, an ink-jet printing head 221, the buffer tank 213, and an air discharging valve device 226. The head holder 220 has a box-like configuration. The printing head 221 is fixed to a lower surface of a bottom wall 220*a* of the head holder 220; and the buffer tank 213 is fixed to an upper surface of the bottom wall 220*a*.

Figure 28:
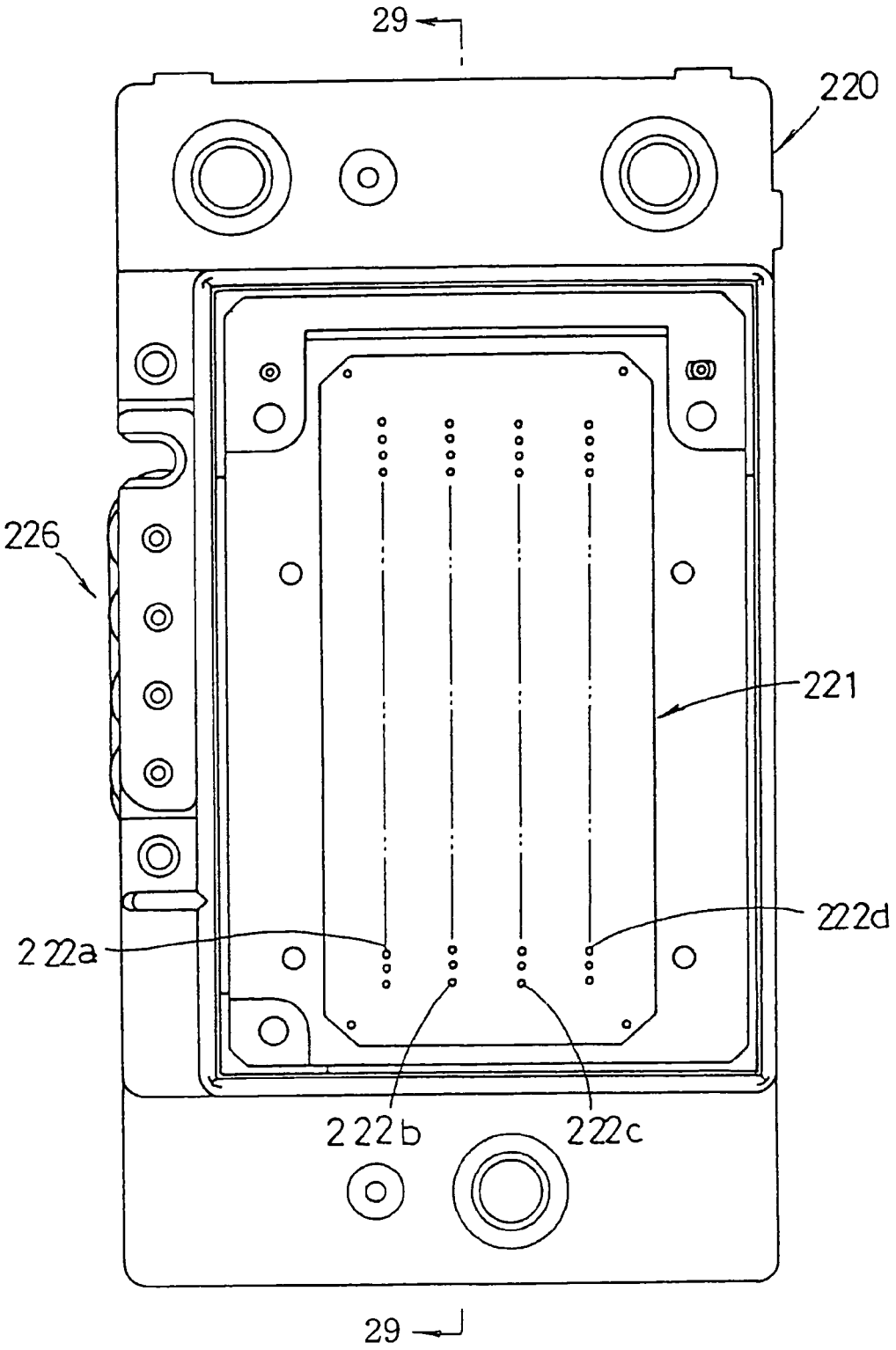
FIG. 28 is a bottom view of a head holder of the ink jet printer of FIG. 27.
Figure 29:
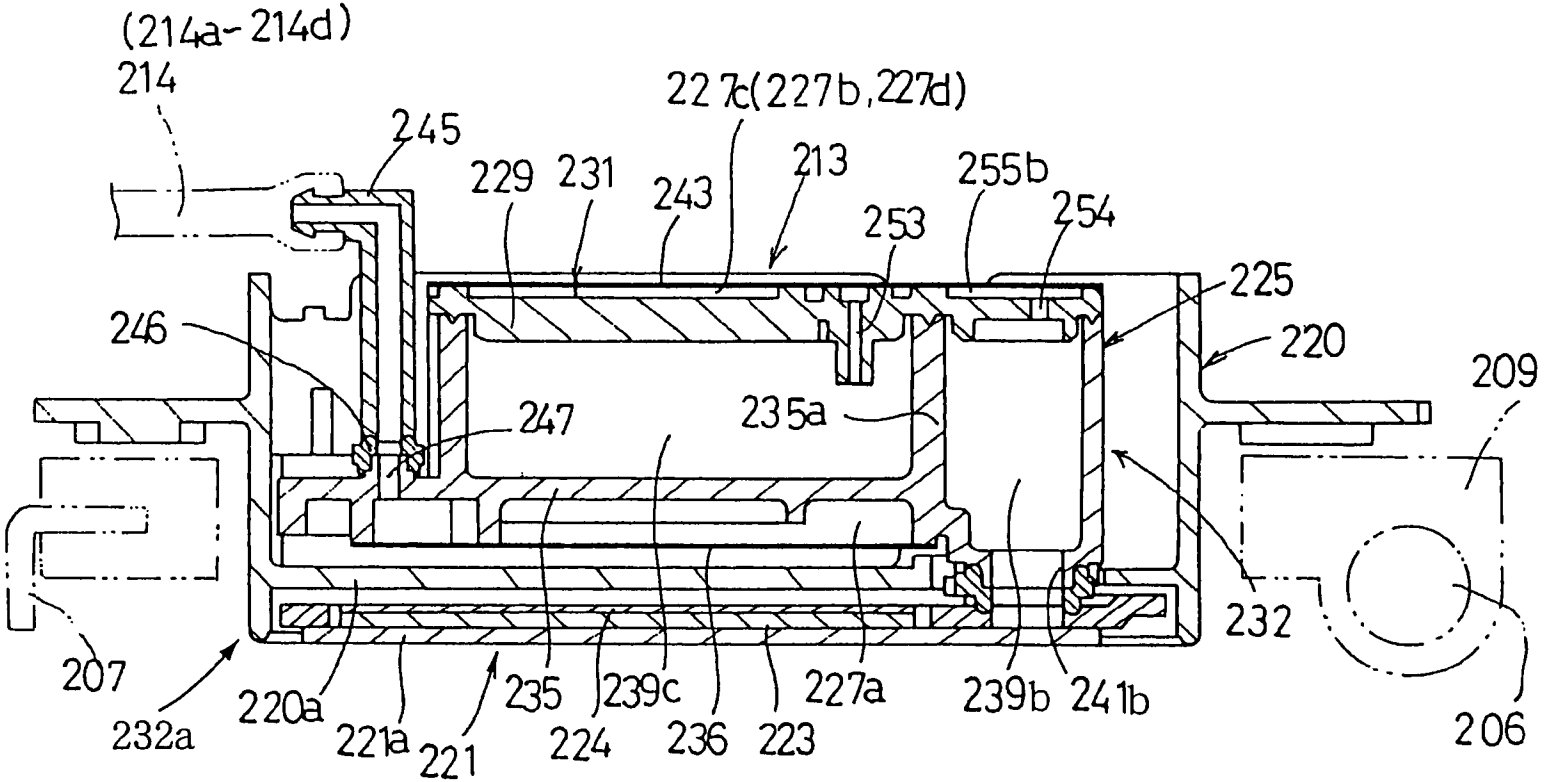
FIG. 29 is a cross-section view taken along arrows indicated at 29, 29 in FIG. 28.

FIG. 28 is a bottom view of the printing head 221. As shown in this figure, a lower surface of the printing head 221 supports four arrays of nozzles 222*a*, 222*b*, 222*c*, 222*d* corresponding to the black ink (BK), the cyan ink (C), the magenta ink (M), and the yellow ink (Y), respectively, in the order of description, in the direction from the left-hand side to the right-hand side, such that each of the four arrays of nozzles 222*a* to 222*d* extends in a direction perpendicular to the directions (i.e., a recording direction) in which the carriage 209 is reciprocated. Each of the nozzles 222 is exposed to face an upper surface of the sheet P.

Like a known printing head disclosed by Japanese Patent Publication No. 2002-67312 or No. 2001-219560, the printing head 221 has, in a portion of an upper surface thereof, four ink supply inlets which correspond to the four color inks, respectively, and which communicate with four ink supply channels, respectively. Each of the four color inks is supplied to a number of pressure chambers via a corresponding one of the four ink supply channels. Thus, the printing head 221 has four arrays of pressure chambers corresponding to the four arrays of nozzles 222*a*-222*d*, respectively, and four arrays of actuators, such as piezoelectric elements, corresponding to the four arrays of pressure chambers, respectively. The printing head 221 ejects a droplet of ink from an arbitrary one of the nozzles 222 when a corresponding one of the pressure chambers is actuated by a corresponding one of the actuators 223. A nozzle unit 221*a* includes the four arrays of nozzles 222*a*-222*d*, and an actuator unit 223 includes the four arrays of actuators. A flexible flat cable 224 for applying an electric voltage to the actuators is fixed to an upper surface of the actuator unit 223. The four color inks are supplied from the four ink tanks 205*a*-205*d* to the four ink supply inlets of the printing head 221 via the buffer tank 213.

Next, respective constructions of the buffer tank 213 and the air discharging valve device 226 will be described in detail by reference to FIGS. 29 to 32, 33A, 33B, 34A, 34B, and 34C. The buffer tank 213 has four air buffer chambers 227 (227*a* to 227*d*) which correspond to the four color inks, respectively, and which are independent of each other. The buffer tank 213 has a main partition wall 235 and two secondary partition walls 230 which cooperate with each other to separate the four air buffer chambers 227*a*-227*d* (more specifically, respective portions 227*a*-1, 227*b*-1, 227*c*-1, 227*d*-1 of the four air buffer chambers 227*a*-227*d*), from each other. In the present embodiment, the portion 227*a*-1 of the black ink (BK) air buffer chamber 227*a* is located under the main partition wall 235; and the respective portions 227*b*-1, 227*c*-1, 227*d*-1 of the cyan ink (C), magenta ink (M), and yellow ink (Y) air buffer chambers 227*b*-227*d* are located above the main partition wall 235, more specifically, a bottom wall 229 of an upper case 231 of a case member 225 of the buffer tank 213. That is, the respective portions 227*a*-1, 227*b*-1, 227*c*-1, 227*d*-1 of the four air buffer chambers 227*a*-227*d* are provided in two layers, i.e., upper and lower layers.

More specifically described, the case member 225 of the buffer tank 123 has a generally box-like outer wall, and includes the upper case 231 and a lower case 232 each of which is formed, by injection, of a synthetic resin. The lower case 232 opens upward and downward; and the upper case 231 is fixed to the lower case 232 to close an upper open end thereof. The upper case 231 is liquid-tightly bonded, by, e.g., ultrasonic welding, to the lower case 232.

Figure 31:
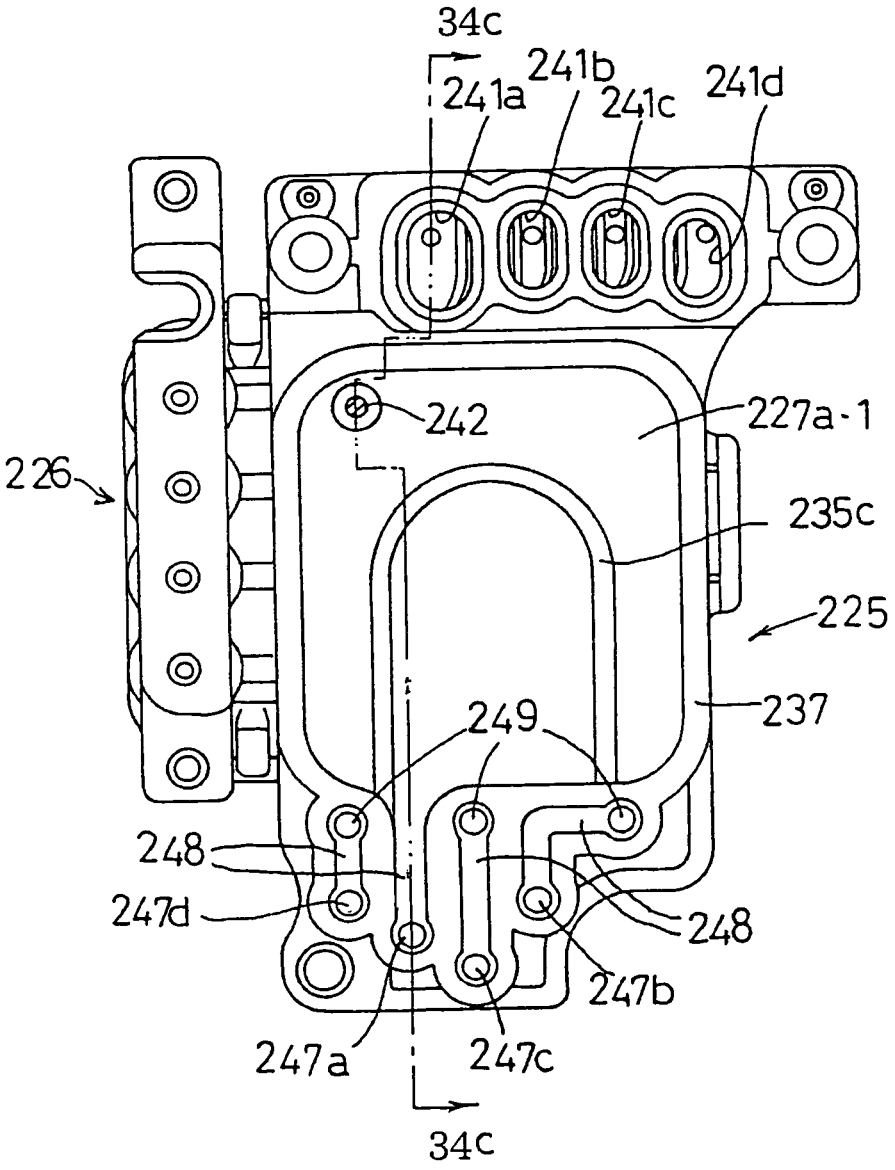
FIG. 31 is a bottom view of the buffer tank of the ink jet printer of FIG. 27, with a flexible membrane 236 being removed.

The lower case 232 has a lower opening which occupies a major portion of a lower surface thereof, and the main partition wall 235 of the lower case 232 is distant inward from, and parallel to, each of the upper and lower open ends thereof. The lower open end of the lower case 232 is closed by a flexible membrane 236 which is provided by a film which is formed of a synthetic resin and does not allow permeation of air or liquid therethrough. The flexible membrane 236 functions as a damper, as described later. More specifically described, an outer periphery of the flexible membrane 236 is bonded, by, e.g., adhesion or ultrasonic welding, to a lower end of an outer wall 237 of the lower case 232 that defines the lower opening of the case 232. The flexible membrane 236 and the main partition wall 235 cooperate with each other to define the portion (i.e., a first chamber) 227*a*-1 of the black ink (BK) air buffer chamber 227*a*, as shown in FIG. 31. The buffer tank 213 is fixed to the head holder 220, such that between the flexible membrane 236 and the bottom wall 220*a* of the head holder 220, there is left a clearance which allows deformation of the flexible membrane 236.

Figure 32:
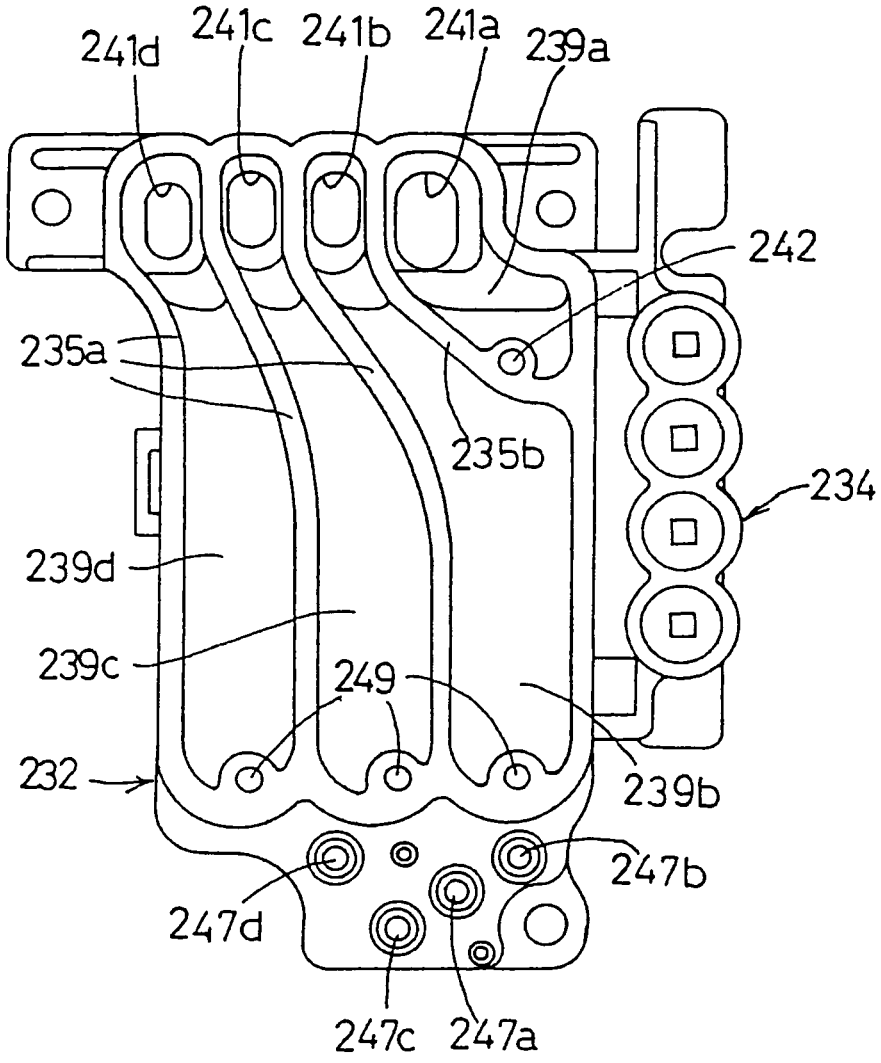
FIG. 32 is a top view of a lower case of the ink jet printer of FIG. 27.
Figure 35:
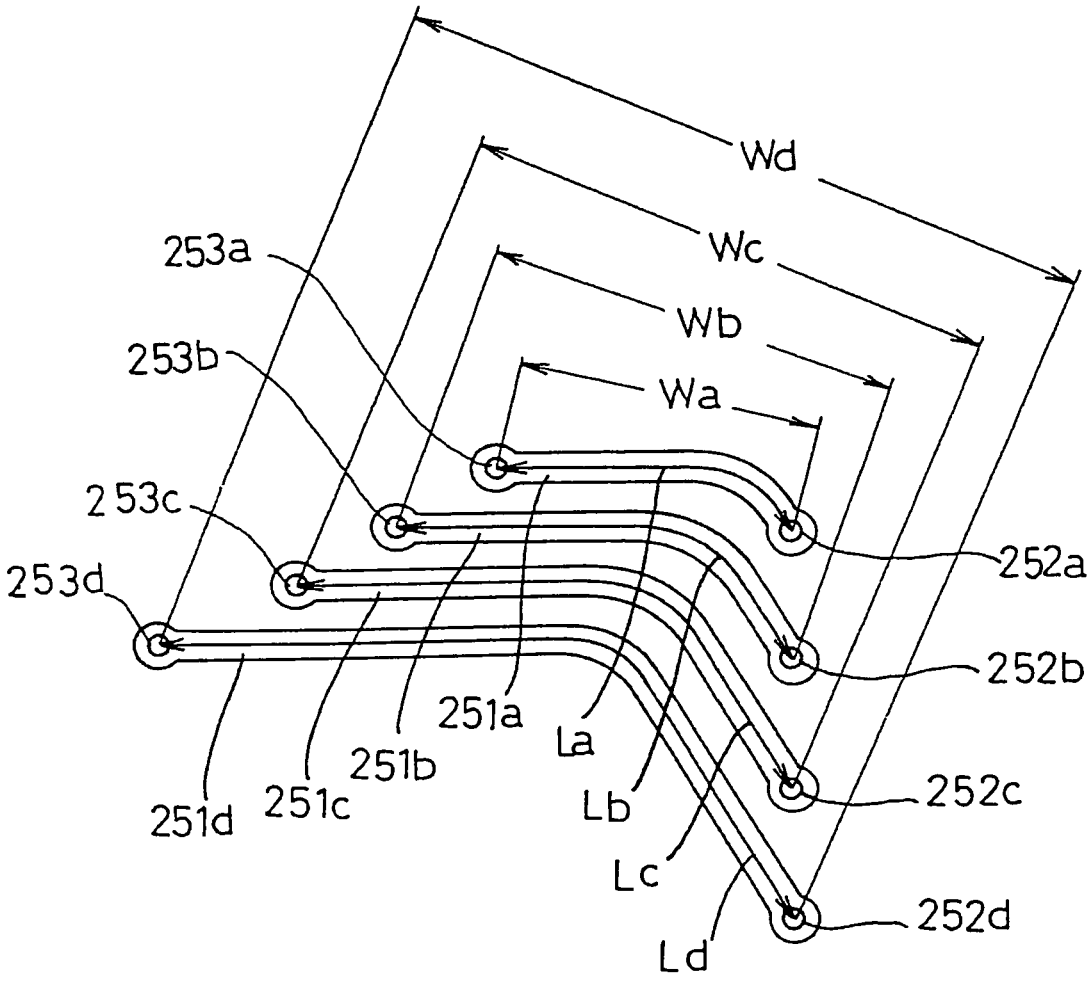
FIG. 35 is a view for explaining respective dimensions of air-discharge passages which are employed in the second embodiment.

Two secondary partition walls 235*a* and one secondary partition wall 235*b* extend upward from the upper surface of the main partition wall 235, as shown in FIG. 32. Thus, an upper portion of the lower case 232 that is located above the main partition wall 235, and the upper case 231 cooperate with each other to define respective additional portions (i.e., respective second chambers 239*a*, 239*b*, 239*c*, 239*d*) of the four air buffer chambers 227*a*-227*d*. In the present embodiment, the two secondary partition walls 235*a* which are spaced from each other cooperates with a side wall of the lower case 232 to define the respective second chambers 239*a*-239*d* of the cyan ink (C), magenta ink (M), and yellow ink (Y) air buffers 227*b*-227*d*. As shown in FIG. 32, the secondary partition walls 235*a* extend horizontally over a substantially entire length of the lower case 232. The respective second chambers 239*a*-239*d* of the three air buffers 227*b*-

227*d* communicate, at respective positions offset from the upper surface of the main partition wall 235, with respective ink flow outlets 241*b*, 241*c*, 241*d* corresponding to the cyan ink (C), magenta ink (M), and yellow ink (Y), respectively.

The secondary partition wall 235*b* cooperates with the side wall of the lower case 232 to define the second chamber 239*a* of the black ink (BK) air buffer chamber 227*a*. As shown in FIGS. 29 and 32, the secondary partition wall 235*b* extends horizontally to a position which is offset from the upper surface of the main partition wall 235 and near to the ink flow outlets 241*b*-241*d*, and the second chamber 239*a* communicates with an ink flow outlet 241*a* corresponding to the black ink (BK).

The first chamber 227*a*-1 of the black ink (BK) air buffer chamber 227*a* communicates with the second chamber 239*a* thereof, via an orifice 242 which is vertically formed through a cylindrical wall formed along the secondary partition wall 235*b*, as shown in FIGS. 31 and 32. The orifice 242 functions as a flow restrictor. The orifice 242 has a cross-section area smaller than that of the first chamber 227*a*-1, and accordingly has a greater resistance to flow of fluid (gas or liquid) therethrough than that of the same 227*a*-1.

Figure 30:
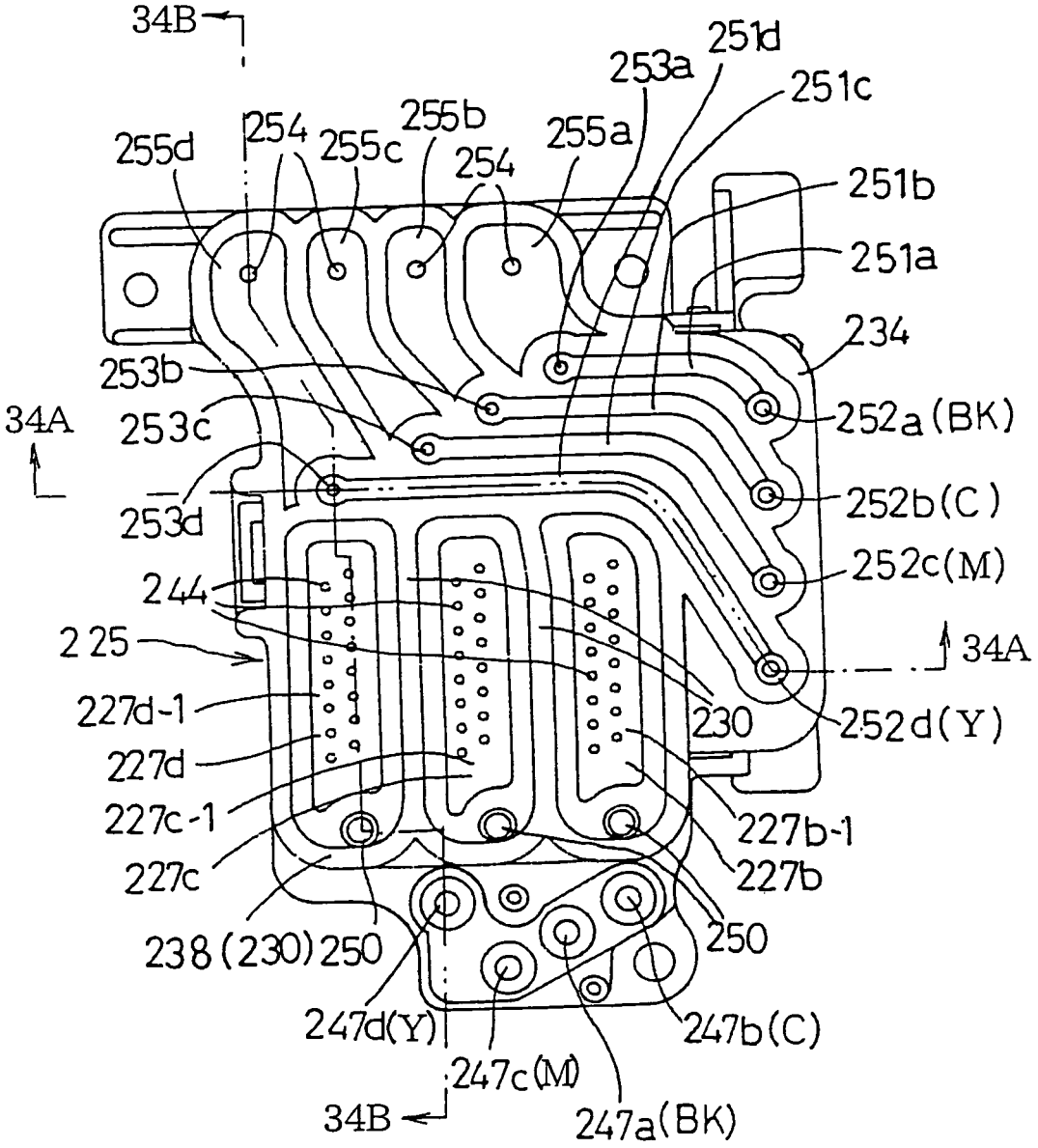
FIG. 30 is a plan view of a buffer tank of the ink jet printer of FIG. 27, with a flexible membrane 243 being removed.

The upper case 231 has a generally flat configuration, and a plurality of recesses are formed in an upper surface of the case 231. The upper case 231 has the two secondary partition walls 230 which separate the respective portions (i.e., respective first chambers) 227*b*-1, 227*c*-1, 227*d*-1 of the cyan ink (C), magenta ink (M), and yellow ink (Y) air buffer chambers 227*b*-227*d*, from each other. The three first chambers 227*b*-1, 227*c*-1, 227*d*-1 are substantially aligned with, and located above, the first chamber 227*a*-1 of the black ink (BK) air buffer chamber 227*a*, and all open upward, as shown in FIG. 30. The two secondary partition walls 30 of the upper case 231 are partly located on respective planes vertically extended from the two secondary partition walls 235 of the lower case 232. The bottom wall 229 of the three first chambers 227*b*-1, 227*c*-1, 227*d*-1 are has a number of communication holes 244 vertically formed through a thickness of the wall 229. The holes 244 function as a flow restrictor. Thus, each of the three first chambers 227*b*-1, 227*c*-1, 227*d*-1 communicates, via corresponding ones of the holes 244, with a corresponding one of the three second chambers 239*b*, 239*c*, 239*d* which is located below the each first chamber and is defined by the secondary partition walls 235*a* in the lower case 232.

Each of the communication holes 244 has a cross-section area smaller than that of each of the three first chambers 227*b*-1, 227*c*-1, 227*d*-1, and accordingly has a greater resistance to flow of fluid therethrough than that of the same 227*b*-1, 227*c*-1, 227*d*-1.

Respective upper open end surfaces of the three first chambers 227*b*-1, 227*c*-1, 227*d*-1 are commonly closed by a single flexible membrane 243 which is provided by a film which is formed of a synthetic resin and does not allow permeation of air or liquid. The flexible membrane 243 functions as a damper, as described later. More specifically described, an outer periphery of the flexible membrane 243 is bonded, by, e.g., adhesion or ultrasonic welding, to an upper end of an outer wall 238 of the upper case 231 that defines respective outer peripheries of the first chambers 227*b*-1, 227*c*-1, 227*d*-1, and respective upper ends of the secondary partition walls 230.

As shown in FIG. 31, the four ink flow outlets 241*a*-241*d* are arranged in the lower surface of the lower case 232, and open downward at a height position extended downward from a height position where the flexible membrane 236 is provided. Meanwhile, the printing head 221 has, in the upper surface thereof, the four ink supply inlets, not shown, which communicate with respective ends of the four ink supply channels (i.e., four manifolds) corresponding to the four color inks, respectively, and which are opposed to the four ink flow outlets 241*a*-241*d*, respectively. The bottom wall 220*a* of the head holder 220 has four through-holes which allow respective communications between the four ink flow outlets 241*a*-241*d* and the four ink supply inlets of the printing head 221 via respective sealing members such as rubber packing members.

The lower case 232 includes a flange-like projecting portion 232*a* which laterally projects from one side of the case 232 that is opposite to the ink flow outlets 241*a*-241*d*. As shown in FIGS. 29 and 30, the projecting portion 232*a* has four ink flow inlets 247, i.e., 247*a*, 247*b*, 247*c*, 247*d* which correspond to the black ink (BK), cyan ink (C), magenta ink (M), and yellow ink (Y), respectively, and which open upward.

Four joint members 245 which define respective downstream-side ends of four ink flow passages corresponding to the four color inks, respectively, are connected to the four ink flow inlets 247, respectively, via respective sealing members such as rubber packing members. Respective upstream-side ends of the four joint members 245 are connected to respective downstream-side ends of the four ink passages 241*a*-241*d* corresponding to the four color inks, respectively. The four ink passages 241*a*-241*d* define the four ink supply passages, respectively.

As shown in FIGS. 30, 31, 33A, 33B, and 34B, the ink flow inlet 247*a* corresponding to the black ink (BK) communicates with the first chamber 227*a*-1 of the air buffer chamber 227*a* via a connection passage 248 in the form of a horizontal groove which is formed in a lower surface of the lower case 232 and opens downward; and the other, three ink flow inlets 247*b*, 247*c*, 247*d* corresponding to the other, three color inks communicate with the respective first chambers 227*b*-1, 227*c*-1, 227*d*-1 of the other, three air buffer chambers 227*b*-227*d* via respective connection passages or horizontal grooves 248 which are formed in the lower surface of the lower case 232 and open downward, respective communication passages 249 vertically extending in a side wall of the lower case 232 (in a direction substantially perpendicular to the main partition wall 235), and respective communication passages 250 vertically extending in the upper case 231. Since respective upper open ends of the three communication passages 250 of the upper case 231 are located at respective height positions that are near to a lower surface of the flexible membrane 243, the inks flowing into the first chambers 227*b*-1, 227*c*-1, 227*d*-1 can directly collide with the flexible membrane 243 near, and opposed, to the respective open ends of the communication passages 250, so that respective dynamic changes of pressure of the inks in the ink passages 214*b*-214*d* can be efficiently absorbed and attenuated, i.e., damped by the membrane or damper 243.

Respective lower open ends of the ink flow inlets 247*a*-247*d* and the connection passages 248 are closed by an extension portion of the flexible membrane 236.

The main partition wall 235 has, on the lower surface thereof defining a ceiling surface of the first chamber 227*a*-1 of the black ink air buffer chamber 227*a*, a rib 235*c* having, in its plan view, a generally U-shaped configuration whose opposite ends are connected to a side wall of the lower case 232 that is near to the connection passages 248. However, the rib 235*c* does not reach the flexible membrane 236. Therefore, the rib 235*c* defines a space into which the black ink does not enter, and this space and the flexible membrane 236 cooperate with each other to absorb change of pressure of the ink, described later.

The upper case 231 has, in the upper surface thereof, four recesses defining respective third chambers 255*a*, 255*b*, 255*c*, 255*d* of the four air buffer chambers 227*a*-227*d*, at respective positions that are near to the four ink flow outlets 241*a*-241*d* and are vertically aligned with the respective second chambers 239*a*-239*d*, such that the four third chambers 255*a*, 255*b*, 255*c*, 255*d* are independent of each other. The four third chambers 255*a*-255*d* communicate with the corresponding second chambers 239*a*-239*d* via respective air holes 254 formed through the thickness of the upper case 231. That is, each of the four air buffer chambers 227*a*-227*d* corresponding to the four color inks, respectively, includes three chambers, i.e., the first, second, and third chambers.

In addition, the upper case 231 has, in the upper surface thereof, four air-discharge passages 251 (251*a*, 251*b*, 251*c*, 251*d*) in the form of grooves and independent of each other, such that the air-discharge passages 251 extend generally in a direction perpendicular to a lengthwise direction of the case 255 in which the ink flow inlets 247*a*-247*d* and the ink flow outlets 241*a*-241*d* are distant from each other. Moreover, the upper case 231 has four air holes 253 (253*a*, 253*b*, 253*c*, 253*d*) which are provided between the three first chambers 227*b*-1, 227*c*-1, 227*d*-1 and the four third chambers 255*a*-255*d* and communicate with the four second chambers 239*a*-239*d*, respectively. The four air holes 253*a*-253*d* define respective one ends of the four air-discharge passages 251*a*-251*d*. Respective other ends of the four air-discharge passages 251*a*-251*d* are connected to the air discharging valve device 226, described later.

The four air holes 253*a*-253*d* are formed in respective tubular walls which project downward from the upper case 231 into the respective second chambers 239*a*-239*d*, and those air holes 253*a*-253*d* open in the second chambers 239*a*-239*d* at respective height positions distant from the upper case 231 by a predetermined distance. Thus, even after the air bubbles have been discharged from the second chambers 239*a*-239*d* via the air holes 253*a*-253*d*, respective amounts of air each corresponding to the predetermined distance, i.e., a length of projection of the tubular walls from the upper case 231 are left in respective upper portions of the second chambers 239*a*-239*d*.

Respective upper open ends of the respective third chambers 255*a*-255*d* of the four air buffer chambers 227*a*-227*d* and the four air-discharge passages 251*a*-251*d* are closed by an extension portion of the flexible membrane 243, so that the third chambers 255*a*-255*d* and the air-discharge passages 251*a*-251*d* are defined.

The buffer tank 213 is fixed to the carriage 209, such that the main partition wall 235 and the flexible membranes 236, 243 extend parallel to the directions in which the carriage 209 is reciprocated and to the nozzle supporting surface of the printing head 221 that supports the nozzles 222.

Next, the air discharging valve device 226 will be described by reference to FIGS. 30, 32, 33B, and 34C. The lower case 232 includes, as an integral portion thereof, an accommodating portion 234 that is located in one side portion thereof (i.e., a right-hand side portion thereof shown in FIGS. 30 and 34C). The accommodating portion 234 has four valve holes 256 which correspond to the four color inks, respectively, and which are vertically elongate and open at respective upper and lower ends thereof. Each of the four valve holes 256 consists of an upper large-diameter portion 256*a* and a lower small-diameter portion 256*b*. A large-diameter valve member 257 is integral with a small-diameter valve rod 258 located under the valve member 257. A packing member 259 (e.g., an O-ring) as a sealing member is fitted on the valve rod 258 and is located under the valve member 257. The packing member 259 and the valve member 257 are inserted in the large diameter portion 256*a*, such that the two members 259, 257 are movable up and down; and the valve rod 258 is inserted in the small diameter portion 256*b*. A lower end of the valve rod 258 extends to a position in the vicinity of the lower open end of the small diameter portion 256*b*. The valve member 257 is normally biased in a downward direction by a spring member 260, such as a coil spring, that is provided in the large diameter portion 256*a*. In this state, the packing member 259 is pressed against a bottom wall defining a lower end of the large diameter portion 256*a* of the valve hole 256. This state is a closed state of the valve member 257, shown in FIG. 34A.

One side portion of the upper case 231 is extended to a position where the one side portion covers an upper end of the accommodating portion 234, as shown in FIG. 34A. As shown in FIG. 33B, the respective other ends of the four air-discharge passages 251 (251*a*, 251*b*, 251*c*, 251*d*) communicate with respective connection ports 252 (252*a*, 252*b*, 252*c*, 252*d*) as the respective upper open ends of the four valve holes 256. More specifically described, the air discharging valve device 226 communicates with the respective second chambers 239 (239*a*, 239*b*, 239*c*, 239*d*) of the four air buffer chambers 227 (227*a*, 227*b*, 227*c*, 227*d*) via the four air-discharge passages 251 (251*a*-251*d*), respectively, that correspond to the four color inks. As described above, the air-discharge passages 251 (251*a*-251*d*) communicate, at the air holes 253 (253*a*, 253*b*, 253*c*, 253*d*) thereof as the respective one ends thereof, with the air buffer chambers 227 (227*a*-227*d*) and, at the connection ports 252 (252*a*-252*d*) thereof as the respective other ends thereof, with the air discharging valve device 226.

In the first embodiment shown in FIG. 26, the air holes 46 (46*a*-46*d*) are arranged in the reciprocation directions in which the carriage 17 is reciprocated, and the outlet portions 54 (54*a*-54*d*) are arranged in a direction perpendicular to the reciprocation directions. Likewise, in the second embodiment shown in FIG. 35, the air holes 253 (253*a*-253*d*) are arranged generally in the reciprocation directions in which the carriage 209 is reciprocated, and the connection ports 252 (252*a*-252*d*) are arranged in a direction perpendicular to the reciprocation directions. Thus, with respect to the four air-discharge passages 251 (251*a*-251*d*) respectively corresponding to the black, cyan, magenta, and yellow inks, respective distances, W (Wa, Wb, Wc, Wd), of respective straight lines connecting between the four air holes 253 (253*a*, 253*b*, 253*c*, 253*d*) and the four connection ports 252 (252*a*, 252*b*, 252*c*, 252*d*) satisfy the following relationship: Wa<Wb<Wc<Wd.

In addition, in the first embodiment shown in FIG. 26, the respective lengths of the air-discharge passages 47 (47*a*-47*d*) between the respective air holes 46 (46*a*46*d*) and the respective outlet portions 54 (54*a*-54*d*) are substantially equal to each other. In contrast, in the second embodiment, respective lengths, L (La, Lb, Lc, Ld), of the air-discharge passages 251 (251*a*-251*d*) between the respective air holes 253 (253*a*-253*d*) and the respective connection ports 252 (252*a*-252*d*) are made different from each other so as to compensate for the differences of respective distances W (Wa, Wb, Wc, Wd) of the same 251, i.e., satisfy the following relationship: La<Lb<Lc<Ld.

Figure 36:
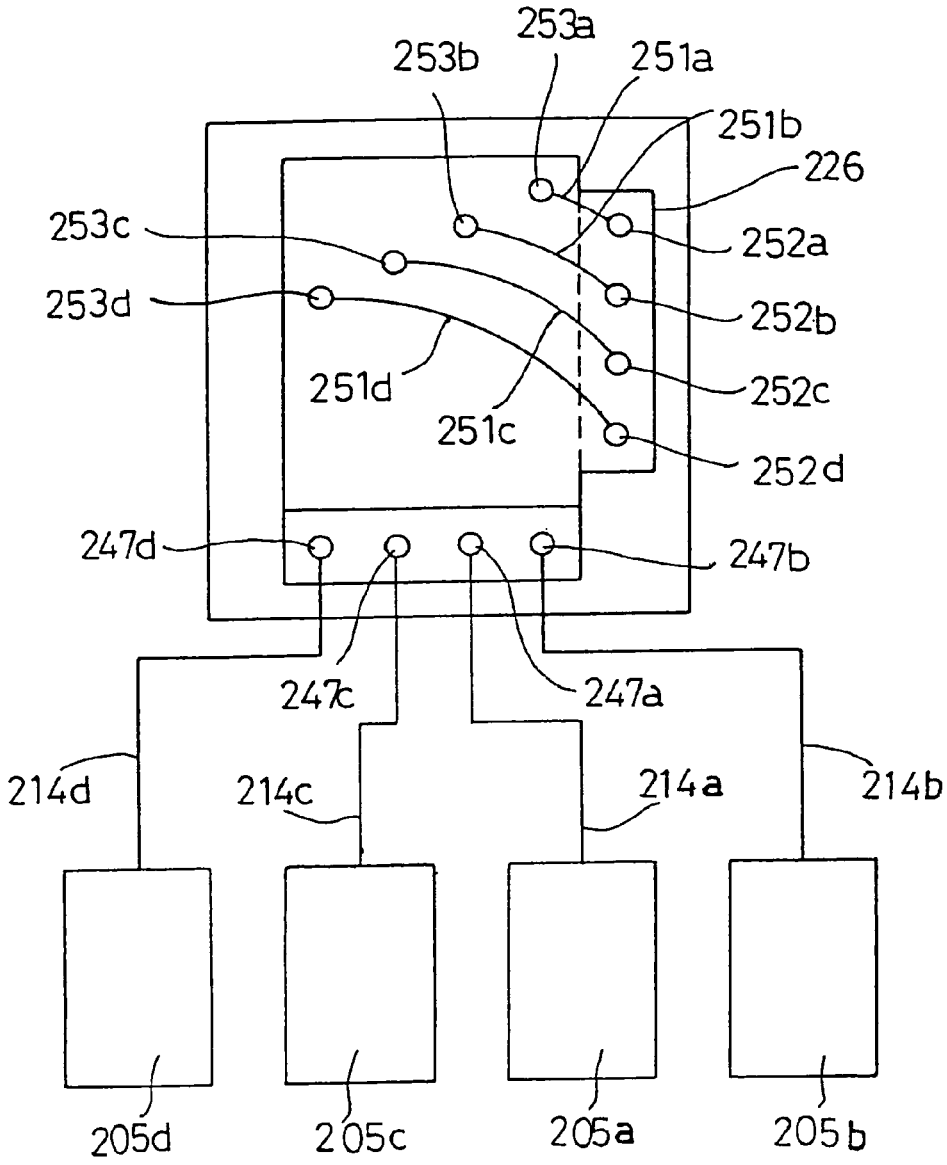
FIG. 36 is a diagrammatic view for explaining entire flow passages for discharging air bubbles that are employed in the second embodiment.

As shown in the diagrammatic view of FIG. 36, the air-discharge passages 251 (251*a*-251*d*) are part of respective flow passages between the ink tanks 205 (205*a*-205*d*) and the connection ports 252 (252*a*-252*d*). Respective amounts of air bubbles discharged from the air buffer chambers 227 (227*a*-227*d*) by the air discharging valve device 226 are influenced by respective fluid-flow resistance values of the flow passages between the ink tanks 205 (205*a*-205*d*) and the connection ports 252 (252*a*-252*d*).

According to Hagen-Poiseulle's law, a fluid-flow resistance value, R, of a flow passage between an ink tank 205 and a connection port 252 can be expressed by the following Expression 1:

$$R=8\ \mu L/\pi r^4+Ro \qquad \text{(Expression 1)}$$

In Expression 1, μ is a viscosity of a fluid (air or ink); L is a length of an air-discharge passage 251; r is an equivalent radius of the passage 251 (i.e., a radius of a circle having an area equal to that of a cross-section area of the passage 251); and Ro is a flow resistance of a flow passage between the ink tank 205 and an air hole 253.

In the second embodiment, respective flow resistance values Ro of respective flow passages located on respective upstream sides of the four air holes 253 (253*a*-253*d*) corresponding to the four ink colors, i.e., the respective flow passages between the ink tanks 205 (205*a*-205*d*) and the air holes 253 (253*a*-253*d*) via the ink passages 214 (214*a*-214*d*), the ink flow inlets 247 (247*a*-247*d*), and the air buffer chambers 227 (227*a*-227*d*) are made equal to each other by, e.g., employing the ink passages 214 whose lengths are equal to each other.

According to the principle of the present invention, it is required that the respective flow resistance values R of the entire flow passages between the ink tanks 205 (205*a*-205*d*) and the connection ports 252 (252*a*-252*d*), including the air-discharge passage 251 (251*a*-251*d*), be made equal to each other. To this end, the following Expression 2 must be satisfied according to Expression 1:

$$8\ \mu La/\pi r_a^4+Ro=8\ \mu Lb/\pi r_b^4+Ro=8\ \mu Lc/\pi r_c^4+Ro=8\ \mu Ld/\pi r_d^4+Ro \qquad \text{(Expression 2)}$$

In Expression 2, $r_a$, $r_b$, $r_c$, $r_d$ are respective equivalent radii of the air-discharge passages 251*a*, 251*b*, 251*c*, 251*d*.

The respective equivalent radii $r_a$, $r_b$, $r_c$, $r_d$ of the air-discharge passages 251*a*, 251*b*, 251*c*, 251*d* can be obtained by solving Expression 2.

Since the respective lengths La-Ld of the air-discharge passages 251*a*-251*d* differ from each other, as described above, the respective equivalent radii $r_a$-$r_d$ of the same 251*a*-251*b* are made different from each other so as to make the respective flow resistance values R of the entire flow passages equal to each other. Based on the respective equivalent radii $r_a$-$r_d$ of the air-discharge passages 251*a*-251*d*, respective cross-section areas of the same 251*a*-251*d* can be determined.

Thus, in the second embodiment, in order to make the respective flow resistance values of the air-discharge passages 251*a*-251*d* equal to each other, a passage 251 having a longer length L than those of the other passages 251 is formed to have a greater cross-section area, taken along a plane perpendicular to a lengthwise direction of the passage 251, than those of the other passages 251, that is, a passage 251 having a shorter length L than those of the other passages 251 is formed to have a smaller cross-section area than those of the other passages 251. More specifically described, in the second embodiment, respective widths of the air-discharge passages 251*a*-251*d* are made equal to each other, as shown in FIG. 33B, but respective depths of the passages 251*a*-251*d* are made different from each other, although not shown, so as to make the respective cross section areas of the passages 251*a*-251*d* different from each other.

Next, there will be described the maintenance unit 204 which performs an air discharging operation by operating the air discharging valve device 226.

The maintenance unit 204 includes a large cap member 271 which can cover the nozzle supporting surface of the printing head 221 that supports the nozzles 222; and four small cap members 272 which can cover the respective lower open ends of the four small diameter portions 256*b* of the air discharging valve device 226. The unit 204 additionally includes an elevating and lowering device 273 as employed in a known maintenance unit. When the carriage 209 is moved to the head waiting position as the right-hand end position as seen in FIG. 27, the elevating and lowering device 273 elevates the large and small cap members 271, 272 so as to contact closely the nozzle supporting surface where the nozzles 222 open, and the lower end surface of the valve device 226; and, when the carriage 209 is moved to other positions, the elevating and lowering device 273 lowers the cap members 271, 272 away from those surfaces. The large cap member 271 is detachably connected to a suction pump 274 as a discharging device, like in the maintenance unit 11 employed in the first embodiment. When the suction pump 274 is driven or operated, the large cap member 271 sucks, and thereby, removes thickened ink and foreign matters from the nozzles 222.

The four small cap members 272 have respective projecting portions 272*a* which project from respective remaining portions thereof and which correspond to the release rods 62 employed in the first embodiment. When the small cap members 272 closely contact the lower surface of the air discharging valve device 226, the projecting portions 272 push the corresponding valve rods 258 upward against the respective biasing forces of the spring members 260, so that the packing members 259 are moved away from the respective bottom surfaces of the large diameter portions 256*a* and the valve members 257 are opened. In addition, the small cap members 272 are connected via a common flow passage to the suction pump 274. Therefore, when the suction pump 274 is driven, the air bubbles collected in the respective second chambers 239 (239*a*-239*d*) of the air buffer chambers 227 are concurrently sucked and discharged. More specifically described, when the color inks supplied from the ink tanks 205 via the ink passages 214 are temporarily stored in the second chambers 239, air bubbles are separated, and floated, from the inks, so that those air bubbles are collected in the respective upper portions of the second chambers 239. The suction pump 274 sucks and discharges those air bubbles.

A switch valve 275 selectively connects one of the large cap member 271 and the small cap members 272 to the suction pump 274. Although the elevating and lowering device 273 concurrently elevates the large cap member 271 and the small cap members 272 to contact closely the nozzle supporting surface of the printing head 221 and the lower surface of the air discharging valve device 226, it is preferred that first the air bubbles accumulated in the respective upper portions of the second chambers 239 (239*a*-239*d*) be discharged via the small cap members 272 and subsequently the inks are discharged from the nozzles 222 via the large cap member 271. In a conventional manner in which the air bubbles present in the second chambers 239 are discharged through the large cap member 271 only, too large amounts of inks are discharged. In contrast, in the second embodiment, the air bubbles can be discharged and the printing head 221 can be recovered while only small amounts of inks are discharged.

It is possible to perform the operation of sucking the inks from the nozzles 222 and the operation of discharging the air bubbles from the second chambers 239 (239*a*-239*d*), independent of each other.

In a modified mode of the second embodiment, the suction pump 274 may be replaced with a positive pressure applying pump like the air pump 28 employed in the first embodiment. In the modified mode, when the positive pressure applying pump applies a positive pressure (i.e., a pressurized air) to the inks stored in the ink tanks 205 (205*a*-205*d*), thickened inks and foreign matters are removed from the nozzles 222 and air bubbles are discharged from the second chambers 239 (239*a*-239*d*). In another modified form of the second embodiment, it is possible to employ both the suction pump 274 and the positive pressure applying pump, like in the first embodiment.

In the second embodiment, at least the respective portions of the air buffer chambers 227 are arranged substantially in the first direction in which the carriage 209 is moved, and the respective other ends of the air-discharge passages 251 are arranged in the second direction perpendicular to the first direction. Therefore, there are some limitations to how to layout the discharging passages 251 such that those passages 251 have the substantially same length between the respective one ends thereof communicating with the air buffer chambers 227, and the respective other ends thereof located on the side of the discharging device 274. Hence, one or more of the discharging passages 251 that has or have a longer distance between the one end or ends thereof and the other end or ends thereof than those of the other discharging passages 251 is or are formed to have a larger cross section area, that is, one or more of the discharging passages 251 that has or have a shorter distance than those of the other discharging passages 251 is or are formed to have a smaller cross section area, so that all the discharging passages 251 have the substantially same air-flow resistance. Therefore, the air bubbles can be discharged from all the air buffer chambers 227 at the substantially same amount of flow of air. Thus, the respective operations of discharging the air bubbles from the air buffer chambers 227 can concurrently be done with high efficiency.

In the second embodiment, the respective lengths of the air-discharge passages 251 are adjusted according to the respective distances between the one ends, and the other ends, of the same. Thus, one or more of the discharging passages 251 that has or have a shorter distance between the one end or ends thereof and the other end or ends thereof than those of the other discharging passages 251 need not be intentionally elongated or spread out. Accordingly, the air-discharge passages 251 can be laid out with a high degree of freedom and in a reduced space. This leads to decreasing the overall size of the present ink jet printer 200.

In the second embodiment, since the air-discharge passages 251 are formed along one wall of the buffer tank 213, the discharging passages 251 can be laid out in a reduced space.

In the second embodiment, in each of the air buffer chambers 227 separated from each other by the partition wall 230 in the buffer tank 213, the air bubbles collected or accumulated therein are located above the ink accommodated therein. In addition, at least the respective portions of the air-discharge passages 251 are formed in the upper wall of the buffer tank 213, so that the air bubbles are directly discharged from the upper portion of the each air buffer chamber 227. Therefore, the amount of ink that is discharged when the air bubbles are discharged from each air buffer chamber 227 can be minimized, and accordingly wasteful use of the ink can be prevented.

In the second embodiment, the discharging device 274 operates for discharging the air bubbles from the air buffer chambers 227 via the air-discharge passages 251, and this operation is easily allowed, or inhibited, by the air discharging valve device 226 which can open and close the other ends of the discharging passages 251.

In the second embodiment, the suction pump 274 as the discharging device can easily discharge the air bubbles from the air buffer chambers 227 via the air-discharge passages 251. In addition, since the suction pump 274 can be connected to, and disconnected from, the respective other ends of the air-discharge passages 251, the operation of the suction pump 274 of discharging the air bubbles can be easily started or stopped.

Next, a third embodiment of the present invention will be described by reference to FIGS. 37, 38, 39, 40A, 40B, 41A, 41B, 42A, 42B, 43, 44A, 44B, 45A, 45B, and 46. The third embodiment resembles the second embodiment, in that in order to make respective flow resistance values of a plurality of air-discharge passages for discharging air bubbles from respective air buffer chambers, substantially equal to each other, respective cross-section areas of those passages are made different from each other so as to compensate for differences of respective lengths of those passages.

In the third embodiment, four color inks, i.e., black, cyan, magenta, and yellow inks are supplied to two printing heads 221 which have ten arrays of nozzles 222 (222*a*, 222*b*, 222*c*, 222*d*, 222*e*, 222*f*, 222*g*, 222*h*, 222*i*, 222*j*), in total, each array of which ejects a corresponding one of the four color inks. The two printing heads 221 are arranged in a recording direction in which the printing heads 221 are moved, and the two heads 221 are fixed to a head holder 220.

Figure 38:
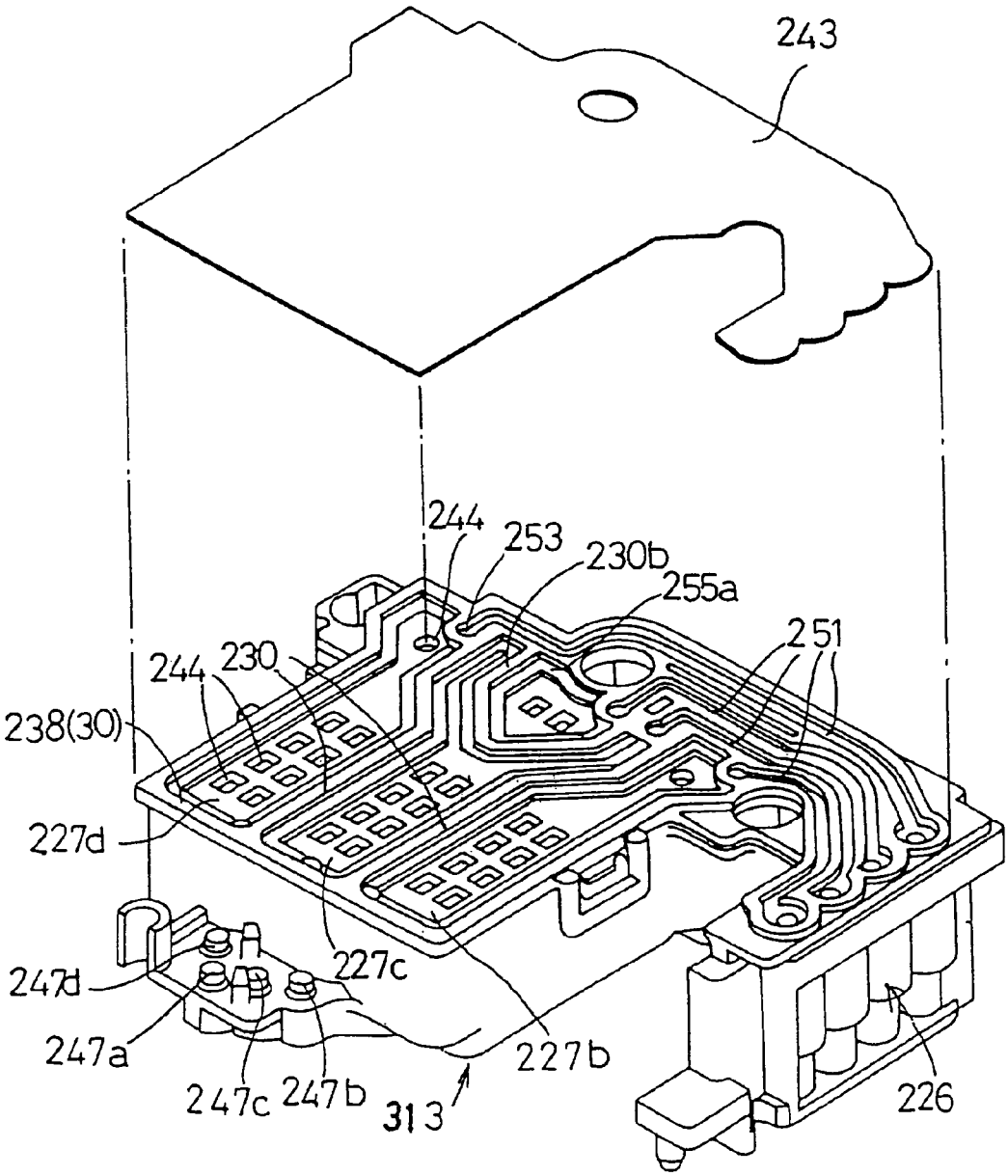
FIG. 38 is a perspective top view of a buffer tank and a flexible membrane 243 of the ink jet printer of FIG. 37.

In the third embodiment, a buffer tank 313 supplies, to each of the two printing heads 221, corresponding three color inks. More specifically described, although four ink flow inlets 247 (247*a*, 247*b*, 247*c*, 247*d*) are provided for the four color inks, respectively, that is, one inlet 247 is provided for each color ink, as shown in FIG. 38, two flow outlets 241 (241*a*, 241*b*, 241*c*, 241*d*) are provided for each color ink. Since the third embodiment is a modified form of the second embodiment, the same reference numerals as used in the second embodiment are used to designate the corresponding elements and parts of the third embodiment. However, the respective corresponding elements or parts of the second and third embodiments, designated by the same reference numeral, may differ from each other with respect to its construction and/or function, and those differences will be described below.

Figure 37:
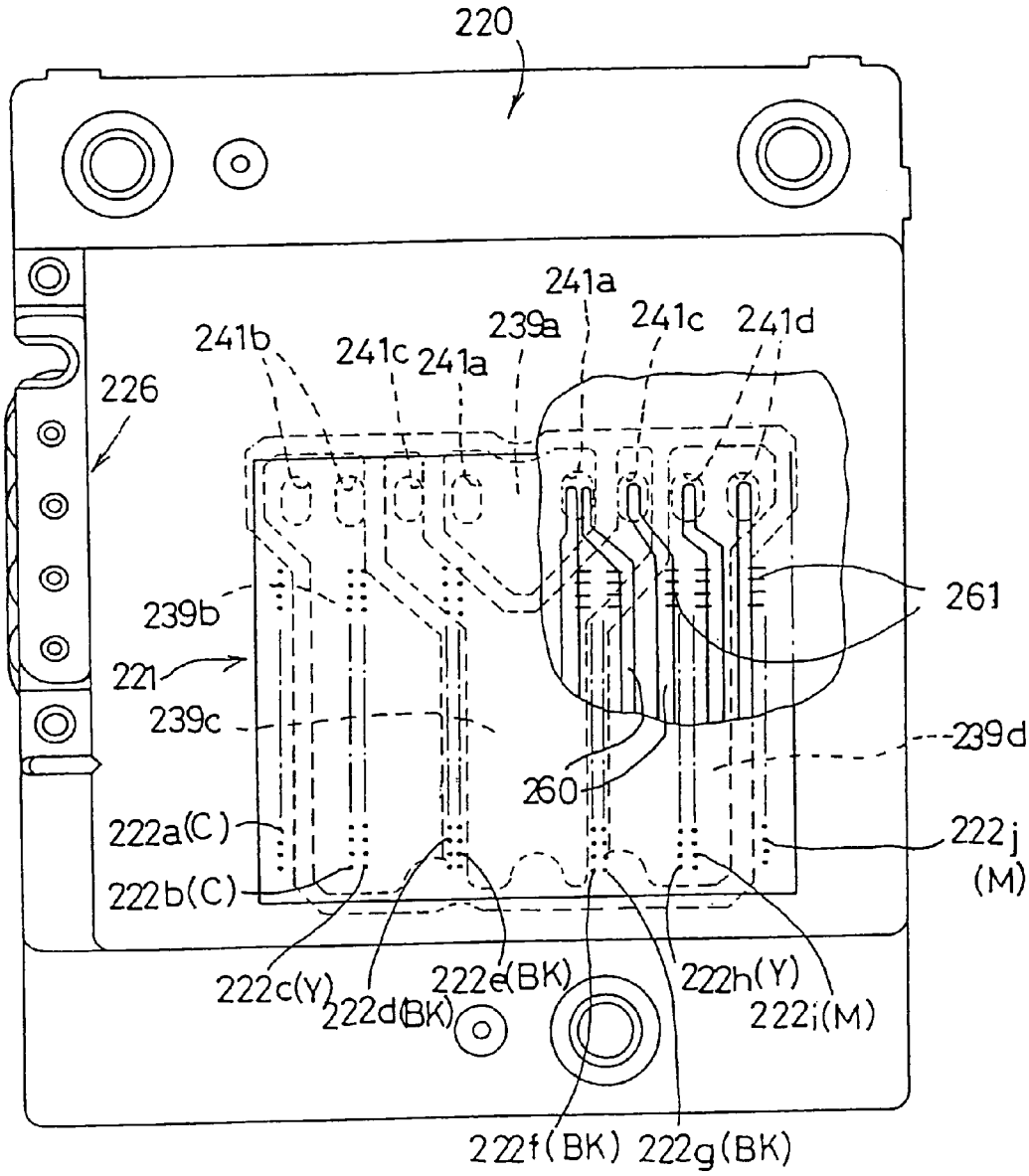
FIG. 37 is a bottom view of a head holder of another ink jet printer as a third embodiment of the present invention.

In the third embodiment, the four color inks, i.e., black, cyan, magenta, and yellow inks are employed, as described above. FIG. 37 is a bottom view of the two printing heads 221, and shows two arrays of cyan ink (C) nozzles 222*a*, 222*b*, one array of yellow ink (Y) of nozzles 222*c*, four arrays of black ink (BK) nozzles 222*d*, 222*e*, 222*f*, 222*g*, one array of yellow ink (Y) of nozzles 222*h*, and two arrays of magenta ink (M) nozzles 222*i*, 222*j* which are arranged, in the order of description, from the left-hand side to the right-hand side. Each array of nozzles 222 is elongate in a direction perpendicular to the recording direction in which the carriage 209 is moved, and the nozzles 222 are exposed to face downward, i.e., toward an upper surface of a sheet of paper P as a recording medium.

Like a known printing head disclosed by Japanese Patent Publication No. 2002-67312 or No. 2001-219560, the two printing heads 221 have, in respective portions of respective upper surfaces thereof, ten ink supply inlets, in total, which correspond to the four color inks, respectively, and which communicate with ten ink supply channels 260 (FIG. 37), respectively. Four ink supply inlets and four ink supply channels 260 are provided for the black ink; and two ink supply inlets and two ink supply channels 260 are provided for each of the cyan, magenta, and yellow inks, as shown in FIG. 37. Each of the four color inks is supplied to a number of pressure chambers 261 via corresponding two or four ink supply channels 260 out of the ten ink supply channels 260. Thus, the printing heads 221 have ten arrays of pressure chambers 261 corresponding to the ten arrays of nozzles 222*a*-222*j*, respectively, and ten arrays of actuators, not shown, such as piezoelectric elements, corresponding to the ten arrays of pressure chambers 261, respectively. The printing heads 221 eject a droplet of ink from an arbitrary one of the nozzles 222 when a corresponding one of the pressure chambers 261 is actuated by a corresponding one of the actuators. A flexible flat cable, not shown, for applying an electric voltage to the actuators is fixed to an upper surface of an actuator unit having the actuators. The four color inks are supplied from the four ink tanks 205*a*-205*d* to the ten ink supply inlets of the two printing heads 221 via the buffer tank 313.

In the third embodiment, the buffer tank 313 includes a case member 225 consisting of an upper case 231 and a lower case 232. The upper case 231 is liquid-tightly fixed, by, e.g., ultrasonic welding, to an upper end of the lower case 232.

Figure 45A:
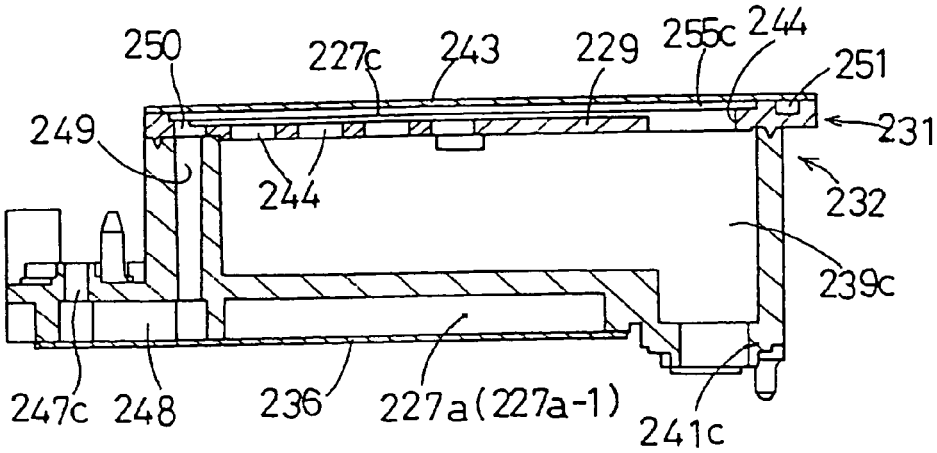
FIG. 45A is a cross-section view taken along arrows indicated at 45A, 45A in FIG. 44A.
Figure 45B:
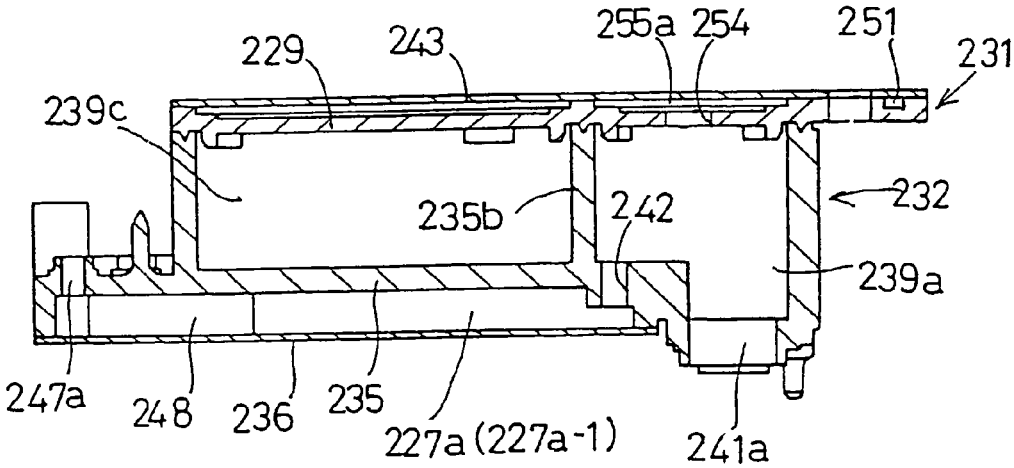
FIG. 45B is a cross-section view taken along arrows indicated at 45B, 45B in FIG. 44A.

The third embodiment resembles the second embodiment, in that, as shown in FIG. 45B, the lower case 232 has, under a main partition wall 235 thereof, a first chamber 227*a*-1 of an air buffer chamber 227*a* corresponding to the black ink (BK). The first chamber 227*a*-1 occupies a major portion of a lower surface of the lower case 232, and opens downward, and a flexible membrane 236 is bonded to the lower surface of the lower case 232 so as to cover the lower open end of the first chamber 227*a*-1. In addition, the lower case 232 has, in the vicinity of the lower open end of the first chamber 227*a*-1, the eight ink flow outlets 241*a*-241*d*. In the third embodiment, as shown in FIG. 37, the two central ink flow outlets 241*a* correspond to the black ink (BK); the two ink flow outlets 241*c* on either side of the central outlets 241*a* correspond to the yellow ink (Y); the left-hand two ink flow outlets 241*b* correspond to the cyan ink (C); and the right-hand two ink flow outlets 241*d* correspond to the magenta ink (M).

As shown in FIGS. 41A and 41B, a second chamber 239*a* of an air buffer chamber 227*a* corresponding to the black ink (BK) is defined, in its plan view, by a secondary partition wall 235*b* which is so formed as to surround the two central ink flow outlets 241*a*, and the second chamber 239*a* communicates with the first chamber 227*a*-1 via a communication passage 242 formed through the main partition wall 235. In addition, as shown in FIGS. 40A and 45B, the upper case 231 has, in an upper surface thereof, a third chamber 255*a* of the air buffer chamber 227*a* that is defined by a secondary partition wall 230*b* which is located in a plane extended from the secondary partition wall 235*b*. The third chamber 255*a* communicates with the second chamber 239*a* via an air hole 254 formed through the upper case 231.

The third embodiment also resembles the second embodiment, in that respective air buffer chambers 227*b*, 227*c*, 227*d* corresponding to the cyan, yellow, and magenta inks, respectively, are defined by two secondary partition walls 235*a* projecting upward from an upper surface of the main partition wall 235, and two central secondary partition walls 230 which project upward from the upper surface of the upper case 231 and are located in respective planes extended from the two secondary partition walls 235*a*. As shown in FIG. 44B, the air buffer chambers 227*b*, 227*c*, 227*d* consist of respective first chambers 227*b*-1, 227*c*-1, 227*d*-1 located above a bottom wall 229 of the first case 231, and respective second chambers 239*b*, 239*c*, 239*d* located below the bottom wall 229. As shown in FIG. 41A, the second chambers 239*b*-239*d* extend over a substantially entire length of the lower case 232, and communicate with the ink flow outlets 241*b*-241*d*, respectively. In the third embodiment, the second chamber 239*b* corresponding to the yellow ink (Y) has, in its plan view, a generally Y-shaped configuration; and the second chambers 239*c*, 239*d* corresponding to the cyan and magenta inks (C, M) are located on either side of the Y-shaped second chamber 239*b*, respectively.

The three first chambers 227*b*-1, 227*c*-1, 227*d*-1 provided in the upper surface of the upper case 231 are located above the corresponding second chambers 239*b*, 239*c*, 239*d*. However, the third embodiment does not have third chambers corresponding to the cyan, yellow, and magenta inks (C, Y, M). As shown in FIG. 45A, for each of the three first chambers 227*b*-1 to 227*d*-1, the bottom wall 229 has a plurality of first communication through-holes 244 in the vicinity of a corresponding one of three communication passages 250, described later, and additionally has one or two second communication through-holes 244 in the vicinity of corresponding two ink flow outlets out of the six ink flow outlets 241*b*-241*d*, so that the first and second communication through-holes 244 communicate between the each of the first chambers 227*b*-1 to 227*d*-1 and a corresponding one of the second chambers 239*b*-239*d*.

Figure 42A:
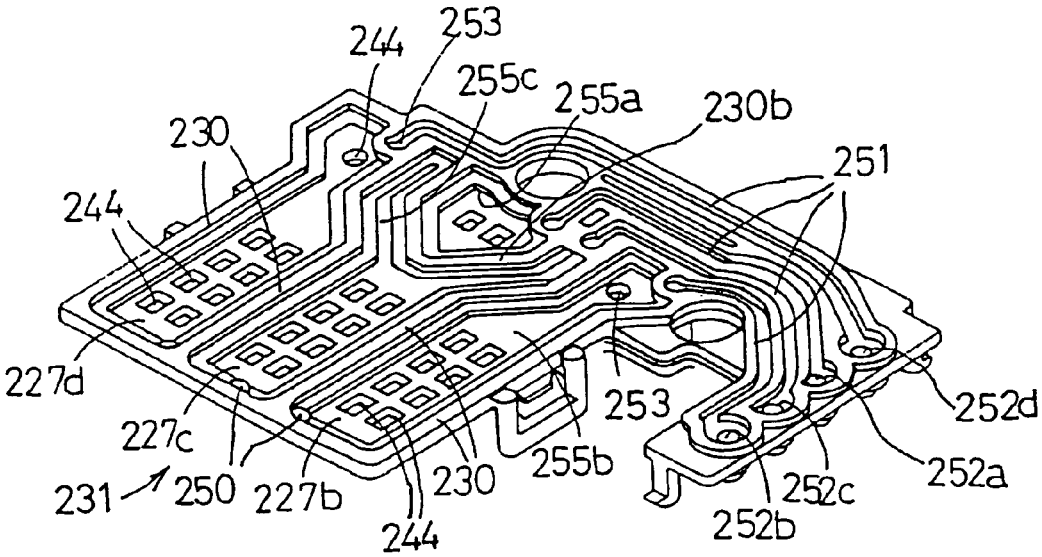
FIG. 42A is a perspective top view of the upper case of the ink jet printer of FIG. 37.
Figure 42B:
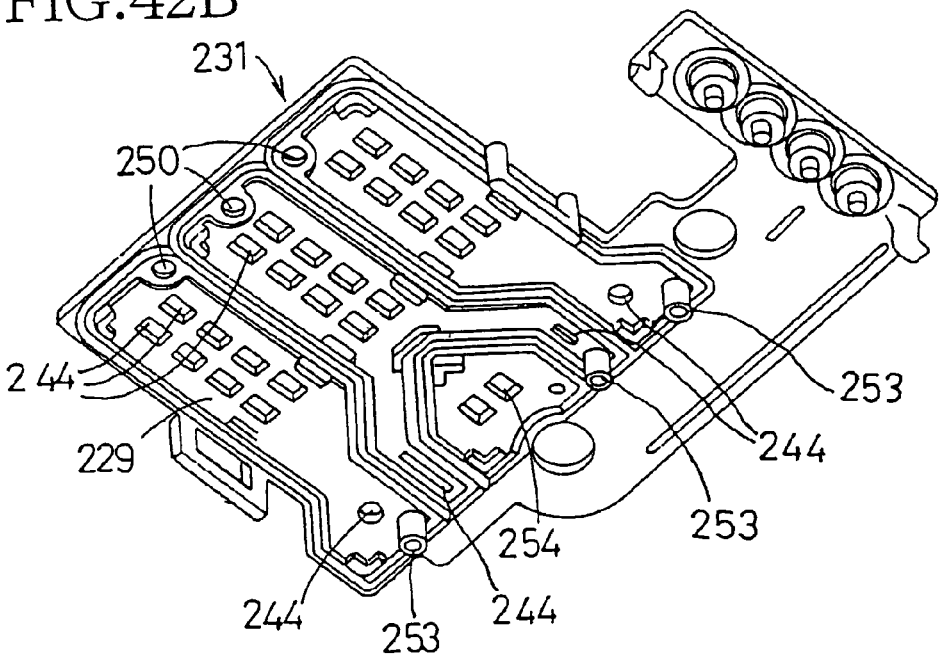
FIG. 42B is a perspective bottom view of the upper case of FIG. 42A.
Figure 43:
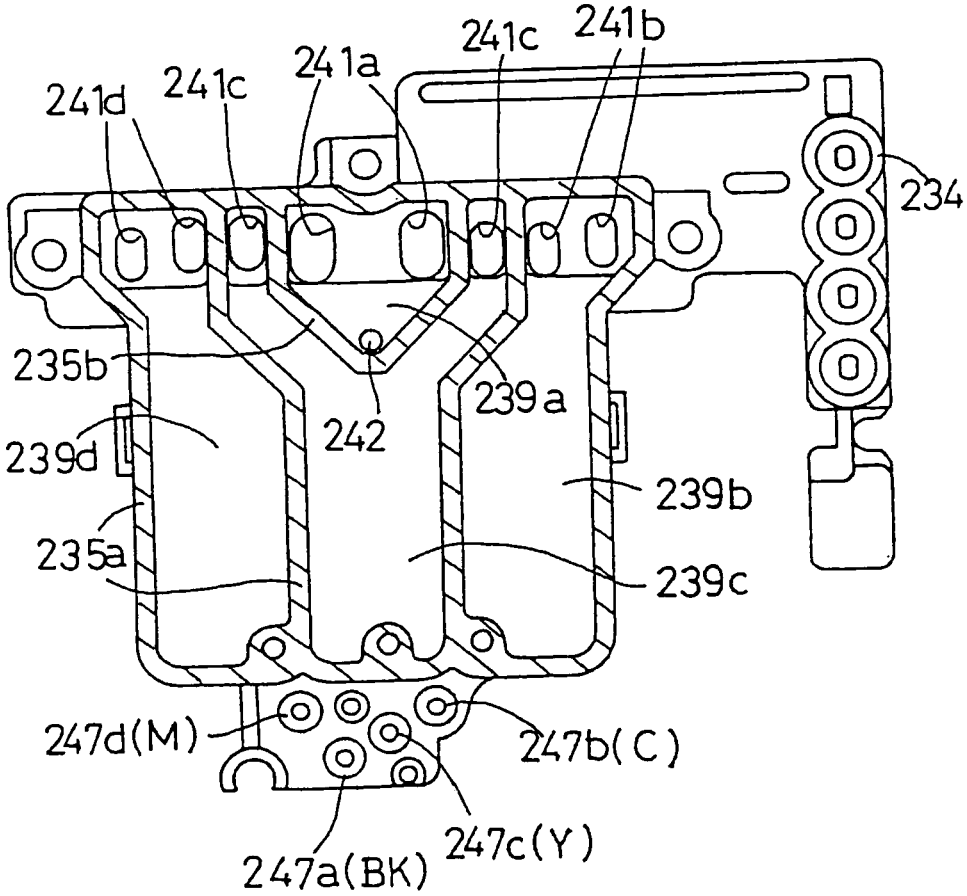
FIG. 43 is a plan view of the lower case of the ink jet printer of FIG. 37.
Figure 44A:
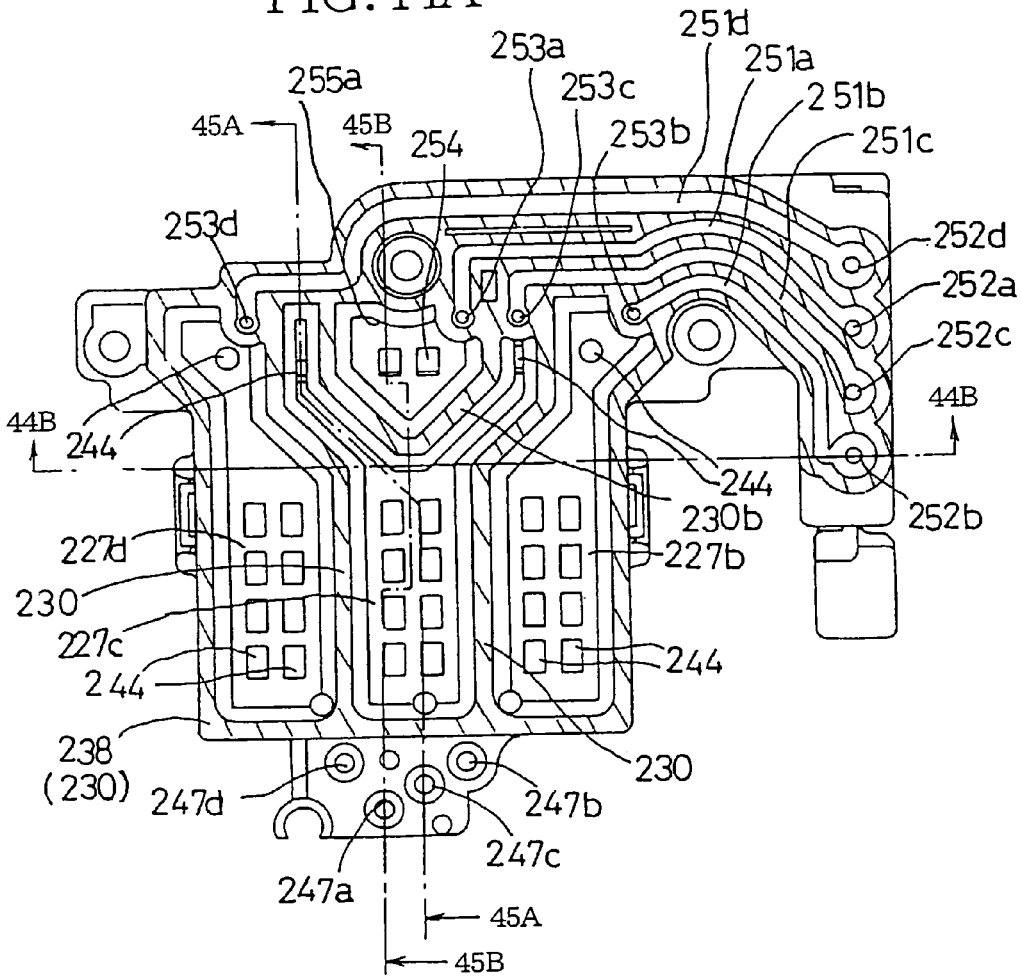
FIG. 44A is a plan view of the upper case of the ink jet printer of FIG. 37.
Figure 44B:
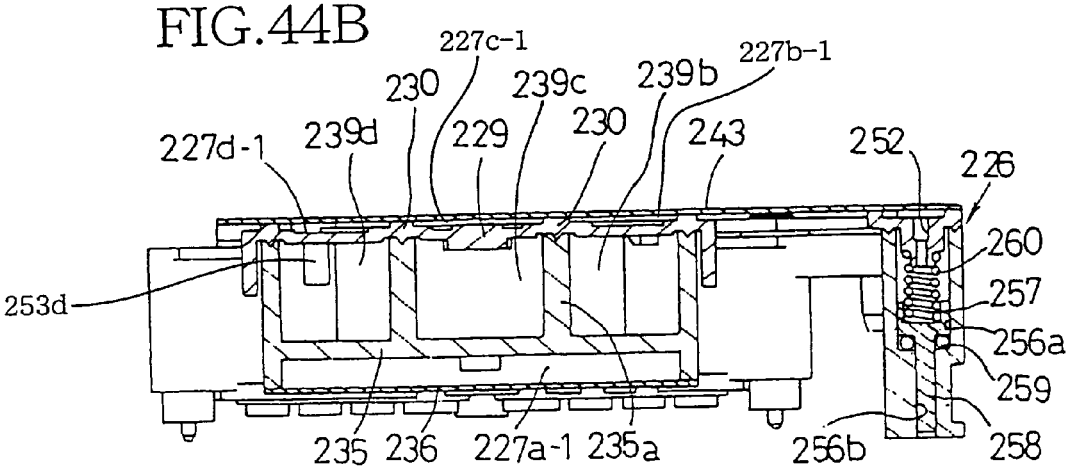
FIG. 44B is a cross-section view taken along arrows indicated at 44B, 44B in FIG. 44A.

As shown in FIG. 44A, the upper case 231 additionally has four air-discharge passages 251 (251*a*, 251*b*, 251*c*, 251*d*) in the form of grooves formed in the upper surface of the case 231. The air-discharge passages 251*a*-251*d* communicate, at respective air holes 253 (253*a*, 253*b*, 253*c*, 253*d*) as respective one ends thereof, with the second chambers 239*a*-239*d*, respectively, and communicate, at respective other ends thereof, with an air discharging valve device 226 whose construction is identical with that of the air discharging valve device 226 employed in the second embodiment. The third embodiment resembles the second embodiment, in that the three air holes 253*b*-253*d* corresponding to the cyan, yellow, and magenta inks (C, Y, M) open downward at respective height positions lower than those of respective ceiling surfaces of the three second chambers 239*b*-239*d*, as shown in FIG. 42B, so that respective spaces in which respective amounts of air are accumulated, are defined in respective upper portions of the second chambers 239*b*-239*d*, as shown in FIG. 44B.

Respective upper open ends of the three first chambers 227*b*-1, 227*c*-1, 227*d*-1, the third chamber 255*a* corresponding to the black ink, and the four air-discharge passages 251*a*-251*d* are covered by a single flexible membrane 243, as shown in FIG. 38.

Figure 39:
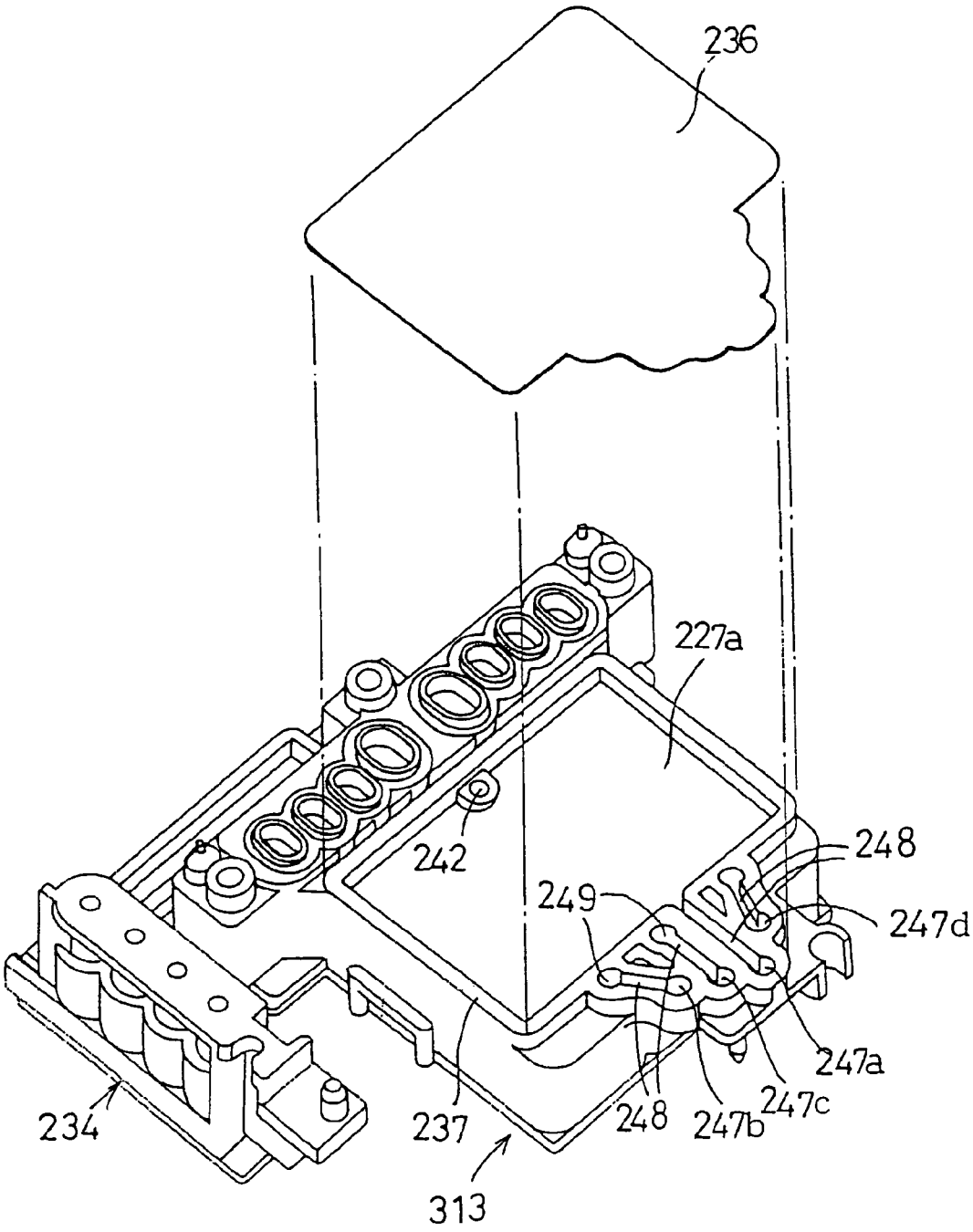
FIG. 39 is a perspective bottom view of the buffer tank and another flexible membrane 236 of the ink jet printer of FIG. 37.

The lower case 232 has the four ink flow inlets 247*a*-247*d* which are similar to the four ink flow inlets 247*a*-247*d* employed in the second embodiment. The ink flow inlet 247*a* corresponding to the black ink is connected to the air buffer chamber 227*a* (i.e., the first chamber 227*a*-1 thereof) corresponding to the black ink, via a communication passage 248 in the form of a groove; and the ink flow inlets 247*b*-247*c* corresponding to the cyan, yellow, and magenta inks are connected to the air buffer chambers 227*b*-227*d* (i.e., the first chambers 227*b*-1 to 227*d*-1 thereof) corresponding to the cyan, yellow, and magenta inks, via respective communication passages 248 in the form of grooves, respective communication passages 249, and respective communication passages 250, as shown in FIGS. 39 and 45A. Respective lower open ends of the ink flow inlets 247*a*-247*d* and the communication grooves 248 are closed by an extension portion of the flexible membrane 236.

Figure 46:
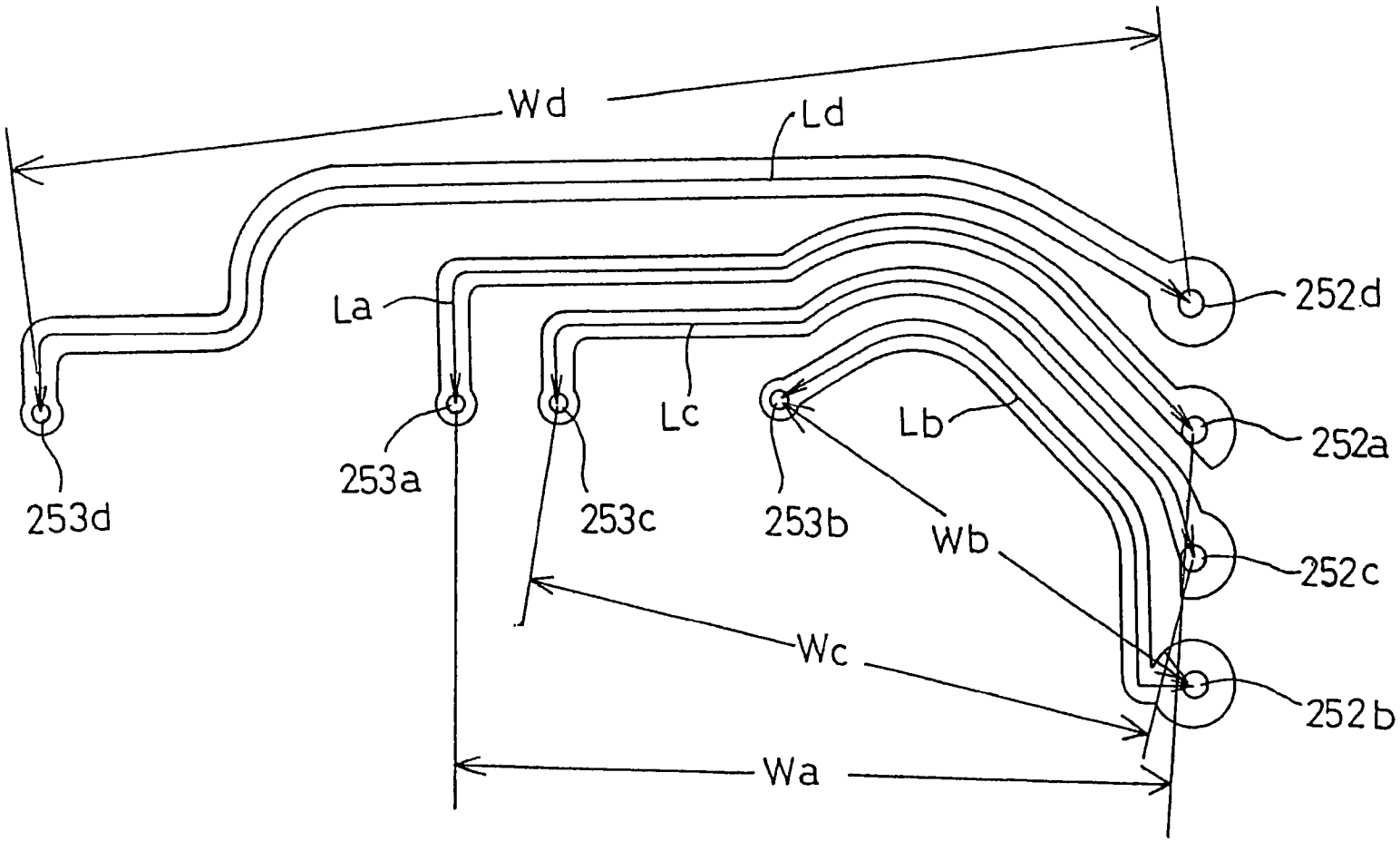
FIG. 46 is a diagrammatic view for explaining respective dimensions of air-discharge passages which are employed in the third embodiment.

The third embodiment resembles the second embodiment, in that the air holes 253 (253*a*-253*d*) as the respective one ends of the four air-discharge passages 251 (251*a*-251*d*) are arranged in the reciprocation directions in which the carriage 209 is reciprocated, and connection ports 252 (252*a*-252*d*) as respective other ends of the passages 251 are arranged in a direction perpendicular to the reciprocation directions, as shown in FIG. 44A. Thus, with respect to the four air-discharge passages 251*a*, 251*b*, 251*c*, 251*d* respectively corresponding to the black, cyan, yellow, and magenta inks, respective distances, W (Wa, Wb, Wc, Wd), of respective straight lines connecting between the four air holes 253*a*, 253*b*, 253*c*, 253*d* and the four connection ports 252*a*, 252*b*, 252*c*, 252*d* satisfy the following relationship: Wb<Wc<Wa<Wd, as shown in FIG. 46.

In addition, in the third embodiment, respective lengths, L (La, Lb, Lc, Ld), of the air-discharge passages 251 (251*a*-251*d*) between the respective air holes 253 (253*a*-253*d*) and the respective connection ports 252 (252*a*-252*d*) are made different from each other so as to compensate for the differences of respective distances W (Wa, Wb, Wc, Wd) of the same 251, i.e., satisfy the following relationship: Lb<Lc<La<Ld, as shown in FIG. 46.

The air-discharge passages 251 (251*a*-251*d*) employed in the third embodiment resemble the air-discharge passages 251 (251*a*-251*d*) employed in the second embodiment, in that respective fluid-flow resistance values R of respective flow passages between the ink tanks 205 (205*a*-205*d*) and the connection ports 252 (252*a*-252*d*) are made equal to each other. To this end, according to the above-indicated Expressions 1 and 2, respective equivalent radii $r_a$, $r_b$, $r_c$, $r_d$ of the four air-discharge passages 251*a*, 251*b*, 251*c*, 251*d* are determined and, based on the thus determined equivalent radii $r_a$-$r_d$ of the passages 251*a*-251*d*, respective cross-section areas of the same 251*a*-251*d* are determined. In the third embodiment, in order to make the respective flow resistance values of the passages 251*a*-251*d* equal to each other, respective widths of the passages 251*a*-251*d* are made different from each other, as shown in FIG. 44A, and additionally, respective depths of the passages 251*a*-251*d* are made different from each other, although not shown, so as to make the respective cross section areas of the passages 251*a*-251*d* different from each other.

In each of the first, second, and third embodiments, the respective fluid-flow resistance values of the four air-discharge passages 47*a*-47*d*, 251*a*-251*d* for discharging the air bubbles from the air bubble collecting chambers or air buffer chambers 40*a*-40*d*, 227*a*-227*d* are made equal to each other. Therefore, air can be discharged at a substantially same rate from the four chambers 40*a*-40*d*, 227*a*-227*d*. Thus, the respective operations of discharging the air bubbles from the four chambers 40*a*-40*d*, 227*a*-227*d* need a substantially same time to finish, i.e., those operations can be finished at a substantially same time. This leads to improving the efficiency of those operations. If air is discharged at different rates from the four chambers 40*a*-40*d*, 227*a*-227*d*, then the operation of discharging the air bubbles from one chamber 40, 227 is finished earlier than the other operations of discharging the air bubbles from the other chambers 40, 227, and some amount of ink is discharged from the one chamber following the air bubbles. This leads to wasting the ink. In contrast, according to the present invention, the respective amounts of inks discharged from the air-discharge passages 47*a*-47*d*, 251*a*-251*d* can be minimized, and accordingly the inks present in the air buffer chambers 40*a*-40*d*, 227*a*-227*d* can be efficiently used.

In the first embodiment, the respective lengths of the air-discharge passages 47*a*-47*d* are made equal to each other so as to make the respective fluid-flow resistance values of the passages 47*a*-47*d* equal to each other. On the other hand, in each of the second and third embodiments, the respective cross-section areas of the air-discharge passages 251*a*-251*d* are made different from each other so as to compensate for the differences of respective lengths of the passages 251*a*-251*d* and thereby make the respective fluid-flow resistance values of the passages 251*a*-251*d* equal to each other. Therefore, in each of the second and third-embodiments, it is not needed, unlike in the first embodiment, to increase intentionally the respective lengths La, Lb, Lc of the short passages 251*a*, 251*b*, 251*c*, for the purpose of making the respective fluid-flow resistance values of the passages 251*a*-251*d* equal to each other. Thus, the air-discharge passages 251*a*-251*d* can be easily located, and can be freely located in view of the layout of the other components. Therefore, the printing heads 221 as a whole can be easily reduced in size.

It is to be understood that the present invention may be applied to various sorts of ink jet printers.

It is to be understood that the present invention may be embodied with other changes and improvements that may occur to a person skilled in the art, without departing from the spirit and scope of the invention defined in the appended claims.

What is claimed is:

1. An ink-jet printer, comprising:

a printing head for performing printing on a print medium by ejecting ink from nozzles;

an ink tank for storing the ink to be supplied to the printing head;

an ink passage through which the ink is supplied from the ink tank to the printing head;

a buffer tank which stores the ink supplied through the ink passage; and an air-discharging device which discharges an air accumulated in the buffer tank through an air-discharge passage and which includes a valve member operable to open and close a communication opening that is provided in the air-discharge passage a part of which functions as a valve chamber and having: a valve portion which opens and closes the communication opening and which includes a sealing member; and a rod portion connected to the valve portion, wherein the sealing member moves together with the rod portion in a direction to open and close the communication opening.

2. The ink-jet printer according to claim 1, wherein the air-discharging device includes a valve seat surface formed around the communication opening, and wherein the valve member is slidable within the air-discharge passage, and the sealing member is held in abutting contact with the valve seat surface so as to close the communication opening while the rod portion is moved together with the sealing member in a direction in which the sealing member is separated away from the valve seat surface so as to open the communication opening.

3. The ink-jet printer according to claim 2, wherein the valve portion of the valve member includes a valve head having a diameter larger than that of the rod portion and the sealing member moves together with the rod portion while being in contact with the valve head, and wherein the valve head is opposed to the valve seat surface with the sealing member interposed therebetween.

4. The ink-jet printer according to claim 3, wherein the air-discharging device includes a spring member which biases the valve head in a direction in which the sealing member is held in abutting contact with the valve seat surface.

5. The ink-jet printer according to claim 1, wherein the sealing member is symmetrical in a direction of thickness thereof.

* * * * *